US005186695A

United States Patent [19]

Mangseth et al.

[11] Patent Number: 5,186,695

[45] Date of Patent: Feb. 16, 1993

[54] APPARATUS FOR CONTROLLED EXERCISE AND DIAGNOSIS OF HUMAN PERFORMANCE

[75] Inventors: Glen Mangseth, El Dorado Hills; Albert J. Lovas, Sacramento; Philip T. Dempster, St. Helena, all of Calif.

[73] Assignee: Loredan Biomedical, Inc., West Sacramento, Calif.

[21] Appl. No.: 603,657

[22] Filed: Oct. 26, 1990

Related U.S. Application Data

[63] Continuation of Ser. No. 306,737, Feb. 3, 1989, abandoned, and a continuation of Ser. No. 559,652, Jul. 30, 1990, abandoned.

[51] Int. Cl.[5] ..... A63B 21/005

[52] U.S. Cl. ..... 482/6; 482/4; 482/51; 482/900; 482/902; 482/903; 364/413.02; 128/25 R; 73/379.06; 434/247

[58] Field of Search ... 272/129, 130, 93, DIG. 4–DIG. 6; 128/25 R, 25 B; 73/379; 434/247, 392; 482/1, 4–9, 51, 900–903; 364/413.01, 413.02

[56] References Cited

U.S. PATENT DOCUMENTS

| | | | |
|---|---|---|---|
| 3,465,592 | 9/1969 | Perrine | 272/DIG. 6 X |
| 3,495,824 | 2/1970 | Cuinier | 73/379 X |
| 4,333,340 | 6/1982 | Elmeskog | 73/379 |
| 4,337,050 | 6/1982 | Engalitcheff, Jr. | 434/260 |
| 4,475,408 | 10/1984 | Browning | 73/379 X |
| 4,601,468 | 7/1986 | Bond et al. | 482/7 |
| 4,635,933 | 1/1987 | Schnell | 272/129 |
| 4,691,694 | 9/1987 | Boyd et al. | 128/25 R |
| 4,711,450 | 12/1987 | McArthur | 272/129 |
| 4,768,783 | 9/1988 | Engalitcheff, Jr. | 272/143 |
| 4,773,398 | 9/1988 | Tatom | 128/25 R |
| 4,869,497 | 9/1989 | Stewart et al. | 482/5 |
| 4,882,677 | 11/1989 | Curran | 73/379 X |
| 4,885,939 | 12/1989 | Martin | 73/379 X |

FOREIGN PATENT DOCUMENTS

| | | | |
|---|---|---|---|
| 2045215 | 2/1971 | France | 272/129 |

*Primary Examiner*—Richard J. Apley
*Assistant Examiner*—Joe H. Cheng
*Attorney, Agent, or Firm*—Townsend and Townsend

[57] ABSTRACT

Muscle exercise and diagnostic apparatus with an output shaft, a servo motor coupled in driving relation to the output shaft, and a support mechanism for mounting the output shaft and the servo motor in a selectable stationary position. A plurality of work simulation tools and coupling arrangements are provided, including coupling arrangements on the output shaft and each of the tools for removably coupling one of the tools to the output shaft. A composite output shaft with a larger diameter, high torque section and a smaller diameter, low torque section, each with its own separate torque measuring strain gauge arrangement is provided. A shaft position sensor senses the angular position of the output shaft and produces an output shaft position signal. A servo control circuit responds to a preselected command signal measuring device for measuring a preselected servo control signal parameter associated with the servo motor and shaft and operatively related to the command signal. Exercise control circuitry coupled to the servo circuit and receiving the output shaft position signal and the torque signal controls the servo motor and shaft in accordance with a preselected exercise control algorithm.

40 Claims, 35 Drawing Sheets

FIG. 20

PATIENT DATA ENTRY

NAME LAST FIRST

ID #1 ID #2

PHYSICIAN

THERAPIST

PATHOLOGY

DIAG/SURG

COMMENTS

"

WEIGHT (lb)

HEIGHT (in)

AGE

DOM SIDE

INV SIDE

SEX

FIG. 21

TOOL SELECT MENU

| TEST #1 ■ Large Wheel | TEST #2 Large Wheel | TEST #3 Large Wheel | TEST #4 Large Wheel |
|---|---|---|---|
| Large Wheel | Flat Knob 10 | | Ball Knob 14 |
| Small Wheel | Flat Knob 11 | | Ball Knob 15 |
| Wrist Flex/Extend | Flat Knob 12 | | Ball Knob 16 |
| Elbow Flex/Ext | Flat Knob 13 | | Ball Knob 17 |
| Shlder Flex/Ext | Shlder Abd/Add | | Shlder Ext/Int |
| Crank | Turret | | Screwdriver |
| Lever Arm | Linear Motion | | Key |
| Grip Device | Pinch Tool | | Stirrup Handle |

FIG. 22

SETUP TEST PARAMETERS

TEST #1

Isokinetic

TOOL Large Wheel

Isotonic

RESOLUTION (ft – lb)

Isometric

MOTION

1 Alternate

2 Rotate CW

3 Rotate CCW

MODE

1 Constant Torque

2 Ramp Up

3 Ramp Down

4 Ramp Up/Down

5 Breakaway

6 CW- Con Tor/Resist

TORQUE (ft – lb)

start 2 end 35

VELOCITY LIMIT (deg/sec)

CW 900

CYCLES

4

FIG. 26

Here are the parameters you have chosen:

| | |
|---|---|
| TOOL | : Large Wheel |
| EXERCISE TYPE | : Isotonic |
| MOTION | : Alternate |
| MODE | : Constant Torque |
| SIDE | : Left |
| RESOLUTION | : (ft-lb) |

CAUTION: It is critical that the tool shown above matches the tool attached to the shaft.
Please verify.

Enter tool number to proceed: ▨

DATE: 7/10/1988 LIDO WorkSET TEST RESULT(S) TIME: 23:58:09

NAME:
ID#1:
PHYSICIAN:
THERAPIST:
PATHOLOGY:
DIAG/SURG:
COMMENTS:

ID#2:

Large Wheel
Weight (lb):
Height (in):
Age:
Dom Side:
Inv Side:
Sex:

7-10-88 TEST RESULTS 23:58:09

NAME:
SIDE: Left

TOTAL TIME: 0:00:21
REPETITIONS: 14

POWER GOAL: 50 ft-lb/s
WORK GOAL: 1000 ft-lb/s

TOOL : Large Wheel
TYPE : Isotonic
MOTION : Alternate
MODE : Constant Torque

| | CW | CCW | Overall | % of Goal |
|---|---|---|---|---|
| Torque Settings (ft-lbs) | 10 | 10 | | |
| Average Power (ft-lbs) | 48 ± 3 | 47 ± 2 | 48 ± 2 | 95% |
| Coefficient of Var. | 6 | 4 | 3 | |
| Peak Power (ft-lb/s) | 52 | 51 | | |
| Average Work (ft-lbs) | 37 ± 2 | 36 ± 1 | 36 ± 1 | |
| Coefficient of Var. | 5 | 4 | 4 | |
| Total Work (ft-lbs) | 511 | 504 | 1015 | 101% |
| Average R.O.M. (degrees) | 109 ± 5 | 107 ± 4 | 108 ± 4 | |
| Coefficient of Var. | 5 | 4 | 4 | |
| Fatigue Index (%) | 105% | 109% | 107% | |

FIG. 33

DATE: 7-10-1988 LIDO WorkSET TEST RESULT(S) TIME: 23:58:44

NAME:
ID#1
PHYSICIAN:
THERAPIST:
PATHOLOGY:
DIAG/SURG:
COMMENTS:

ID#2

Large Wheel
Weight (lb):
Height (in):
Age:
Dom Side:
Inv Side:
Sex:

7-10-1988 TEST RESULTS 23:58:44

NAME: ,
SIDE: Left

TOTAL TIME: 0:00:33
REPETIONS: 19

TOOL : Large Wheel
TYPE : Isokinetic
MOTION : Alternate
MODE : Constant Velocity

| | CW | CCW |
|---|---|---|
| Velocity Settings (degree/s) | 180 | 180 |
| Average Peak Torque (ft-lbs) | 8±1 | 10±1 |
| Coefficient of Var. | 10 | 11 |
| Peak Torque (ft/lbs) | 10 | 12 |
| Average Work (ft-lbs) | 10±2 | 10±2 |
| Coefficient of Var. | 19 | 17 |
| Total Work (ft-lbs) | 186 | 185 |
| Average R.O.M. (degrees) | 128±8 | 128±6 |
| Coefficient of Var. | 6 | 5 |
| Fatigue Index (%) | 136% | 120% |

FIG. 34

FIG. 35

SAVE/LOAD TEST

| TOOL | LEFT | RIGHT |
|---|---|---|
| Large Wheel | TAKEN | ----- |
| Large Wheel | TAKEN | ----- |
| Large Wheel | TAKEN | ----- |
| Large Wheel | TAKEN | ----- |

FIG. 36

SAVE/LOAD TEST

NAME: Smith, Joe
DATE: 7/27/89
TIME: 22:32
JOINT: SHOULDER
ext/int rotation (90 deg)
DOCTOR:

VELOCITY

Concentric 240

STATUS

| ext | LEFT | RIGHT |
|---|---|---|
| 30 | ----- | ----- |
| 120 | ----- | ----- |
| 180 | ----- | ----- |
| 240 | ----- | ----- |

ENTER PATIENT LAST NAME -- Smith
ENTER DATE mm/dd/yy -- 7/27/89
press enter to continue, space bar to select

APPARATUS FOR CONTROLLED EXERCISE AND DIAGNOSIS OF HUMAN PERFORMANCE

This is a continuation of U.S. patent application Ser. No. 07/306,737, filed Feb. 3, 1989, abandoned, and of U.S. patent application Ser. No. 07/559,652, filed Jul. 30, 1990, abandoned, both titled Apparatus for Controlled Exercise and Diagnosis of Human Performance.

FIELD OF THE INVENTION

This invention relates generally to apparatus for diagnosing and improving human performance by means of controlled exercise and more specifically to apparatus for performing work simulating exercise tasks and accompanying diagnosis of human performance.

BACKGROUND OF THE INVENTION

Occupational therapists and physical therapists are engaged in assessing and rehabilitating patients who have injuries which threaten their ability to continue working at prior occupations involving performance of specific physical tasks. In addition, these health care professionals are increasingly being called upon to evaluate the job task related skill and strength level of job applicants. It has been determined that, in both of these cases, better results are achieved when the tools employed and the exercise apparatus utilized simulate the real-world job task. In this way, the actual muscle groups and joints involved in the job task are utilized in performing the simulated task and measurement of their capability is achieved.

Engalitcheff U.S. Pat. Nos. 4,337,050, 4,471,957, and 4,768,783 describe prior art apparatus and methods for performing exercise tasks using tools that simulate the tools used in various job tasks. Exercise apparatus disclosed in these patents is limited in its capability to simulate the real-world forces exerted on the tool. Baltimore Therapeutic Equipment Company (BTE) of Baltimore, Md., sells a work hardening station of the general type disclosed in the Engalitcheff patents. The apparatus consists of an actuator head mounted on a portable stand with a separate computer console for control and data acquisition. The actuator is limited to providing a selectable level of constant resisting torque to the shaft to which the work simulating tool is attached. The actuator head mounting arrangement limits the possible positions and orientations of the tools. The torque handling capability of the BTE system is limited to about sixty foot pounds in static and dynamic testing and this is far below the torque that strong persons can apply with some tools having a large lever arm. In addition the torque resolution of the BTE apparatus is limited to a few inch/lbs. This resolution is considered inadequate for testing with a number of low torque tools.

Biodex Corporation of Shirley, N.Y., has in the past offered a variety of work simulation attachments as accessories to its multijoint testing and rehabilitation equipment based on an active servo motor dynamometer system. In the Biodex system, positioning flexibility of the dynamometer power head is limited and thus limits the patient to tool positioning relative to real world work tasks. Exercise modes do not include isotonic or torque control modes required to simulate accurately the resisting torque in work tasks. The output shaft on the power head is limited to less than a full rotation and precludes simulation of a large number of work tasks that involve multiple rotations of a tool. Data acquisition and reporting capabilities are also limited. No exercise mode programming for specific work simulating exercise tasks is provided.

The Loss Prevention Center of the Liberty Mutual Insurance Group has developed a prototype work hardening station that is being used in a clinic in Boston, Mass. The actuator in this system is based on a braking system as in the BTE unit so no active exercise modes are possible. In addition the Liberty Mutual system has limited torque handling and measurement capability.

None of the prior art systems offer flexible, easy to use computer programming interfaces for the therapist to use in setting up exercise tasks, selecting appropriate motions and modes, and entering appropriate parameters. Accordingly it should be apparent that there is considerable room for improvement in work task simulating exercise and diagnostic apparatus.

SUMMARY OF THE INVENTION

Objects of the Invention

It is the principal object of this invention to provide improved apparatus for performing work simulating exercise tasks.

It is another object of this invention to provide work simulating exercise and diagnostic apparatus for performing a wider variety of work simulating exercise tasks.

It is another object of this invention to provide work simulating exercise and diagnostic apparatus with improved torque handling and measurement capability.

It is another object of this invention to provide work simulating exercise and diagnostic apparatus with improved computer control of exercise motions and modes.

It is another object of this invention to provide work simulating exercise and diagnostic apparatus with improved therapist programming interfaces for test set up.

It is another object of this invention to provide work simulating exercise and diagnostic apparatus with improved output shaft and tool mounting arrangements.

It is another object of this invention to provide work simulating exercise and diagnostic apparatus with improved work simulating tools.

Features and Advantages of the Invention

One aspect of this invention features muscle exercise and diagnostic apparatus which includes an output shaft having first and second shaft sections with the first shaft section having a larger diameter than the second shaft section to handle higher torque loads. The second shaft section is coaxial with the first shaft section and carries first torque sensing means for sensing torque applied to the first shaft section. The second shaft section carries second torque sensing means for sensing torque applied to the second shaft section. The apparatus further includes a plurality of high torque tools and a plurality of low torque tools. A first coupling means removably couples the high torque tools to the first shaft section and a second coupling means removably couples the low torque tools to the second shaft section.

This dual shaft section, dual torque measurement feature of the invention provides the advantage of high resolution measurement of torque 'produced by low torque tools, e.g., down to a few inch-ozs, with adequate torque handling capability for high torque tools, e.g. up to about 150 ft.-lb.

In one embodiment of this invention, the second shaft section extends forward from the first shaft section, and the first coupling means comprises a first mating surface configuration formed on a forward end surface of the first shaft section surrounding the second shaft section, a hollow tool mounting shaft carried on each of the high torque tools adapted to extend over the second shaft section and having a second mating surface configuration formed on a forward end surface thereof adapted to mate with the first mating surface configuration to form a torque transfer mating relationship between the first shaft section and the tool mounting shaft, and a shaft coupler adapted to mount over both the forward end of the first shaft section and the forward end of the tool mounting shaft for coupling the first shaft section to the tool mounting shaft and including means for urging the first and second mating surfaces into tight mating engagement.

This high torque coupling arrangement provides a lash free high torque coupling without requiring the use of special tools to make the coupling. The shaft coupler provides easy removable mounting of high torque tools since the shaft coupler can be hand tightened and loosened.

Another aspect of this invention features muscle exercise and diagnostic apparatus which includes an output shaft, a servo motor coupled in driving relation to the output shaft for multiple full rotations thereof and support means for mounting the output shaft and the servo motor in a selectable stationary position. The apparatus further includes a plurality of tools and coupling means including coupling arrangements on the output shaft and each of the tools for removably coupling one of the tools to the output shaft. A torque measuring means is carried on and rotates with the output shaft for producing a torque output signal corresponding to measured torque applied thereto by the servo motor and the tool. A torque signal receiving means is carried on the support means and includes a torque signal channel and signal coupling means for coupling the torque output signal from the torque measuring means into the torque signal channels thereon. A shaft position sensing means senses the angular position of the output shaft and producing an output shaft position signal. Servo control means responsive to a preselected command signal controls operation of the servo motor and includes servo signal measuring means for measuring a preselected servo control signal parameter associated with the servo motor and shaft and operatively related to the command signal. Exercise control means coupled to the servo control means and receiving the output shaft position signal and the torque signal controls the servo motor and shaft in accordance with a preselected exercise control algorithm.

This aspect of the invention provides the concurrent advantages of multiple full rotation exercise with controllable servo motor technology for multiple exercise types using different exercise control algorithms, such as isokinetic, isotonic, Continuous Passive Motion, with both concentric and eccentric operation.

Preferably the exercise control means comprises programmable computer means including program storage means for storing a plurality of exercise mode control programs operative to control said servo control means and said servo motor in accordance with a plurality of prearranged exercise control algorithms each having a set of control parameters associated therewith, and program interface means providing program facilities for selecting an exercise mode and for entering values for said control parameters associated therewith.

More specifically, another aspect of this invention features muscle exercise and diagnostic apparatus with an output shaft, a servo motor coupled in driving relation to the output shaft, and support means for mounting the output shaft and the servo motor in a selectable stationary position. A plurality of work simulation tools and coupling means are provided, including coupling arrangements on the output shaft and each of the tools for removably coupling one of the tools to the output shaft. Torque measuring means is carried on the output shaft and produces a torque output signal corresponding to measured torque applied thereto by the servo motor and the tool. Shaft position sensing means senses the angular position of the output shaft and producing an output shaft position signal. Servo control means responds to a preselected command signal for controlling operation of the servo motor and includes servo signal measuring means for measuring a preselected servo control signal parameter associated with the servo motor and shaft and operatively related to the command signal. Exercise control means coupled to the servo control means and receiving the output shaft position signal and the torque signal controls the servo motor and shaft in accordance with a preselected exercise control algorithm. The exercise control means comprises programmable computer means including program storage means storing a plurality of exercise mode control programs operative to control the servo control means and the servo motor in accordance with a plurality of prearranged exercise control algorithms each having a set of control parameters associated therewith. The computer means further includes program interface means including type means for selecting an exercise type from a set of prearranged exercise types, motion means for selecting an exercise motion from a set of prearranged exercise motions associated with the selected exercise type, mode means for selecting an exercise mode from a set of prearranged exercise modes associated with the selected exercise motion, and parameter means for entering values of control parameters associated with the selected exercise mode. This aspect of the invention provides an advantageous marriage of real time digital computer control of servo motor operation and sophisticated personal computer application program interfaces to enable the therapist to program the system with ease to achieve sophisticated control functions by following step by step program facilities including interactive menu screens.

Other objects, features and advantages of this system will be apparent from a consideration of the following detailed description of one embodiment taken in conjunction with the accompanying drawings.

BRIEF DESCRIPTION OF DRAWING FIGURES

FIGS. 20-36 illustrate various menu, programming, biofeedback and data report screens associated with the application program interface shown in FIG. 19.

DETAILED DESCRIPTION

Figure 2:
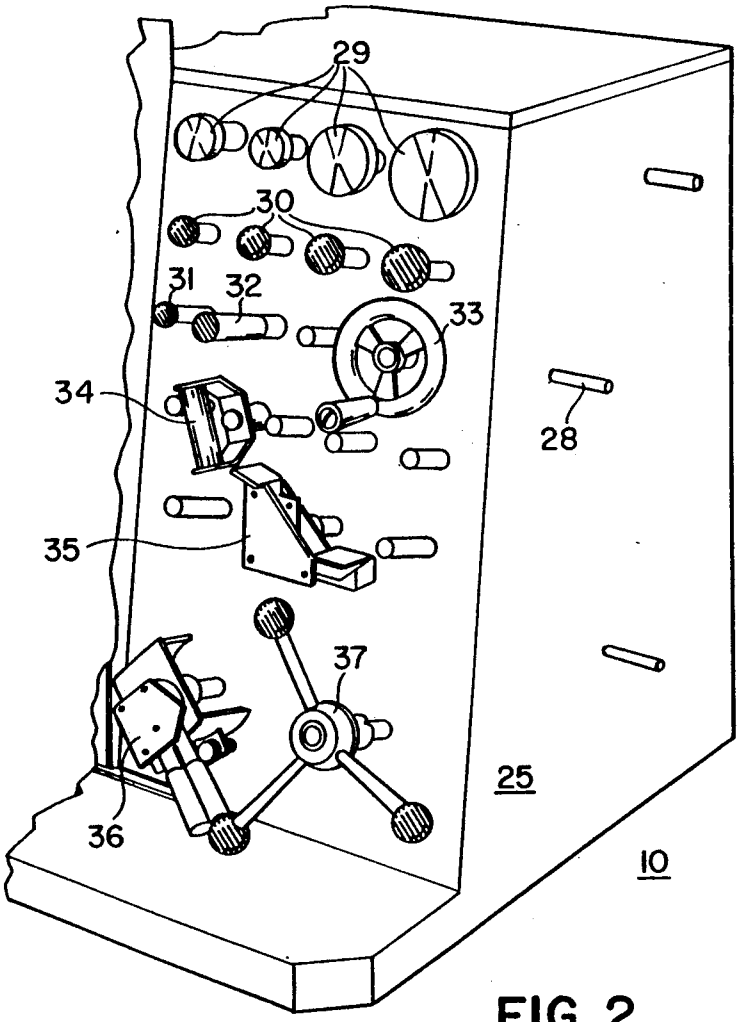
FIG. 2 is a fragmented perspective view of a portion of muscle diagnostic apparatus in accordance with this invention.

General Components (FIGS. 1, 2, and 11-14)

FIGS. 1, 2, and 11-14 illustrate the major components of an exercise and diagnostic apparatus 10 in accordance with this invention. Power head 11 is carried on a mounting yoke assembly 12 which is in turn carried on an elevator assembly 13. Power head 11 is mounted for rotation on yoke assembly 12 in a manner that provides for selectable but fixed angular positioning of the power head and a tool or exercise accessory, such as wheel 26, mounted thereon relative to the mounting yoke as will be discussed in detail below. Elevator assembly 13 includes a motor and acme screw drive arrangement for positioning mounting yoke 12 at a selected vertical height above the floor.

Power head 11 is connected via a multiline cable 14 to a power amplifier 15 and controller 16. Power amp 15 and controller 16 are also coupled via a cable 17 to a programmable digital computer system 18 which includes a computer console 19, keyboard 20 and CRT display 21. A safety disable switch 22 is also connected to controller 16 via cable 14 or by way of a separate cable.

Figure 1:
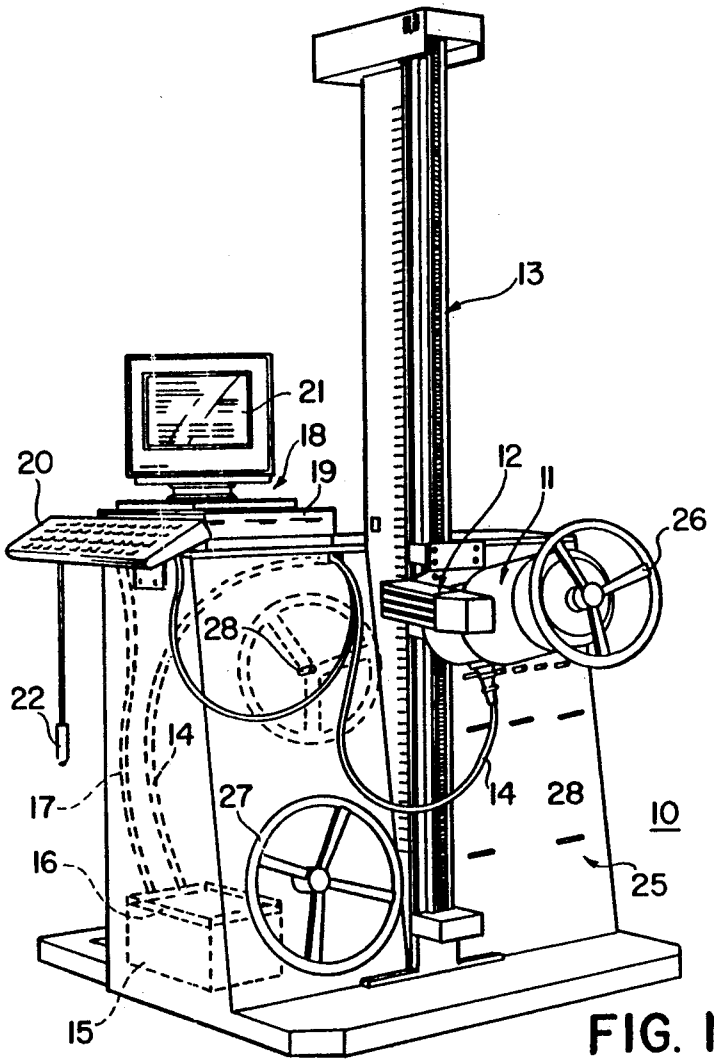
FIG. 1 is a perspective view of muscle exercise and diagnostic apparatus in accordance with this invention.

A cabinet 25 carries a plurality of tools, such as wheels 27, on mounting pegs 28 as shown in FIG. 1. Other work simulating tools are illustrated in FIGS. 2, and 11-14. Some of the tools are low torque tools and others are high torque tools, the significance of which will also be discussed below.

Low Torque Tools

A set of flat knobs 29 with different handle diameters, e.g. one through four inches, are provided for use in finger, hand and wrist exercise with a hand open grasp. These tools are used to simulate control knobs on appliances and machine tools, jar tops, and the like.

A set of round knobs 30 with different diameters may be used in finger, hand and wrist exercises with a closed grasp. They also simulate control knobs of the type that twist as well as other tools.

A key 31 is provided to simulate an actual door key or a rotary selection switch.

A screwdriver handle 32 is used to simulate the finger, wrist and hand exercise involved in using that type of tool.

A crank 33 is used for simulating control and positioning cranks used on machine tools.

A stirrup handle 34 is provided for various wrist exercise movements, including supination-pronation movements and radial and ulnar deviation movements. In the former the wrist and arm of the patient are generally in line with the axis of the shaft of the tool and in the latter the wrist and arm are aligned in the plane of the handle perpendicular to the shaft.

A pinch tool 35 is provided for strength assessment and exercise of the hand with various types of pinching movements.

It will be appreciated that a wide variety of other low torque tools could also be supplied for various work simulation exercises. Arrangements for removable coupling of these low torque tools to an output shaft on power head 11 will be discussed below.

High Torque Tools

Smaller wheel 26 and larger wheel 27 are provided for use in general exercise involving shoulder and arm movements to rotate a wheel and also in simulation of vehicle steering and valve wheel turning types of work tasks.

Grip device 36 simulates various gripping tools such as pliers and shears, and is also provided to facilitate assessment of grip strength and endurance in various types of exercise modes.

Turret lever 37 simulates the type of handle found on various machinery.

Figure 11:
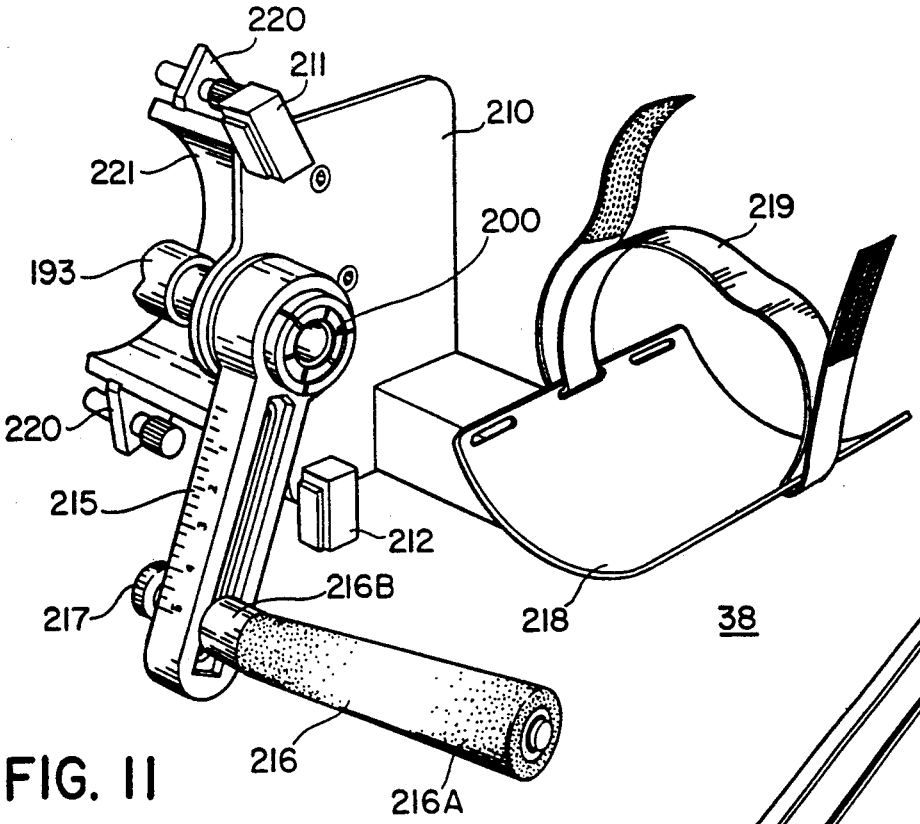
FIG. 11 is a perspective view of a wrist exercise attachment useful in muscle exercise and diagnostic apparatus in accordance with this invention.

Wrist tool 38 shown in FIG. 11 provides for flexion and extension exercises of the wrist with the forearm stabilized.

Figure 12:
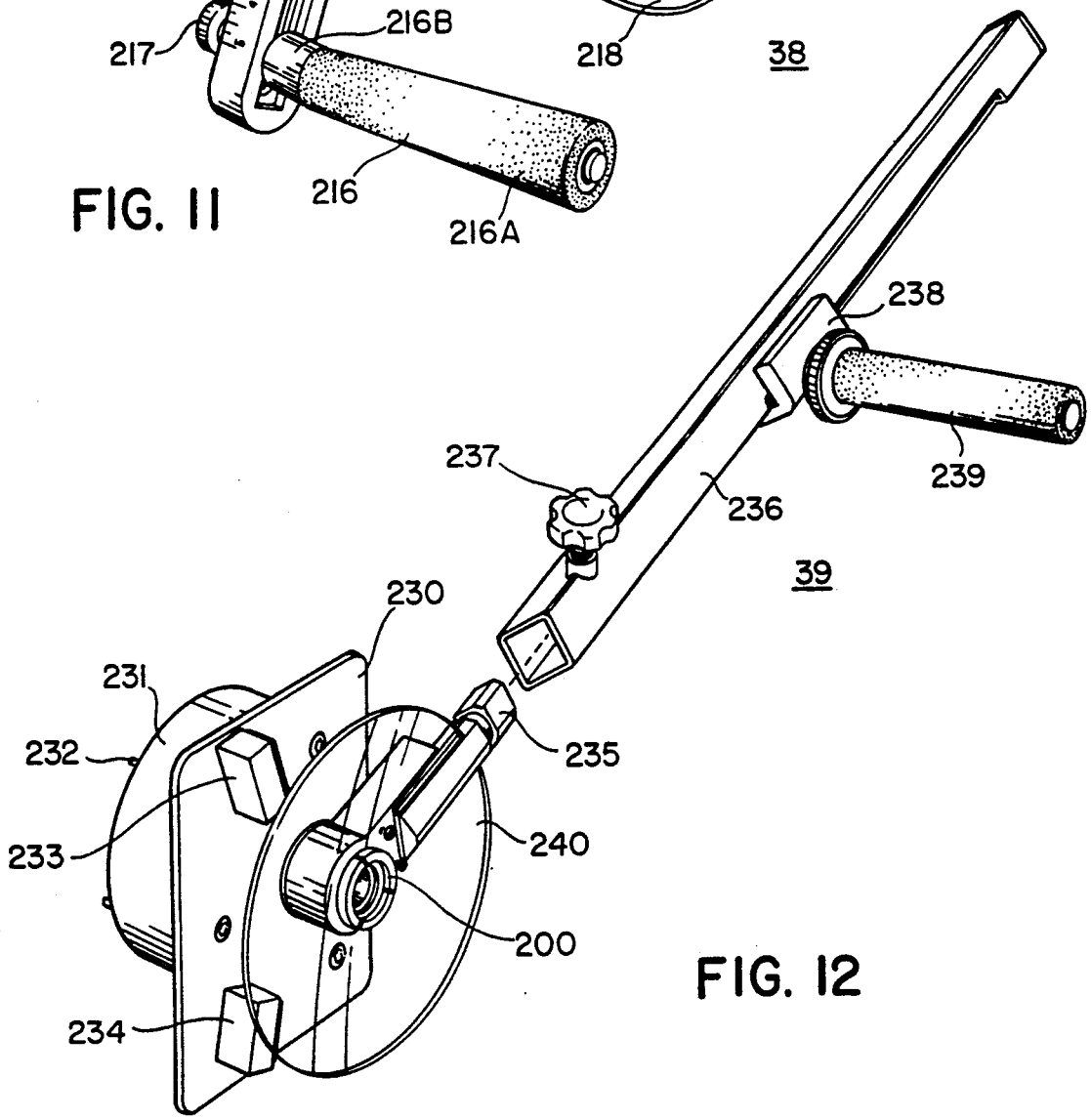
FIG. 12 is a perspective view of an elbow exercise accessory which is exemplary of upper body exercise attachments useful in a muscle exercise and diagnostic apparatus in accordance with this invention.

A variety of lever arms and upper extremity tools such as elbow bar assembly 39 shown in FIG. 12 are provided to simulate tools such as pump handles, wrenches, brake handles, and other levering devices as well as for functional exercise of elbow and shoulder joints and associated muscle groups. Linear motion device 40, shown in FIGS. 13 and 14 and discussed in more detail below, converts the apparatus of this invention from a rotary to a true linear exercise device. Different types of handles can be mounted to the linear reciprocating carriage on the device to simulate many forms of exercise and work tasks. In addition, the device can be mounted on power head 11 in a variety of orientations, such as horizontal for push-pull tasks such as mopping and brooming or vertical for window washing or painting. Handles can be provided for tasks such as sanding, sawing or opening a sliding door.

Arrangements in accordance with this invention for removably coupling these various high torque tools to an output shaft on power head 11 will be described below. It will be appreciated that there are a large variety of low and high torque tools that could be provided with this type of apparatus. The power return capability of power head 11 enables the simulation of spring return tools and tools that involve eccentric muscle loading.

Figure 3:
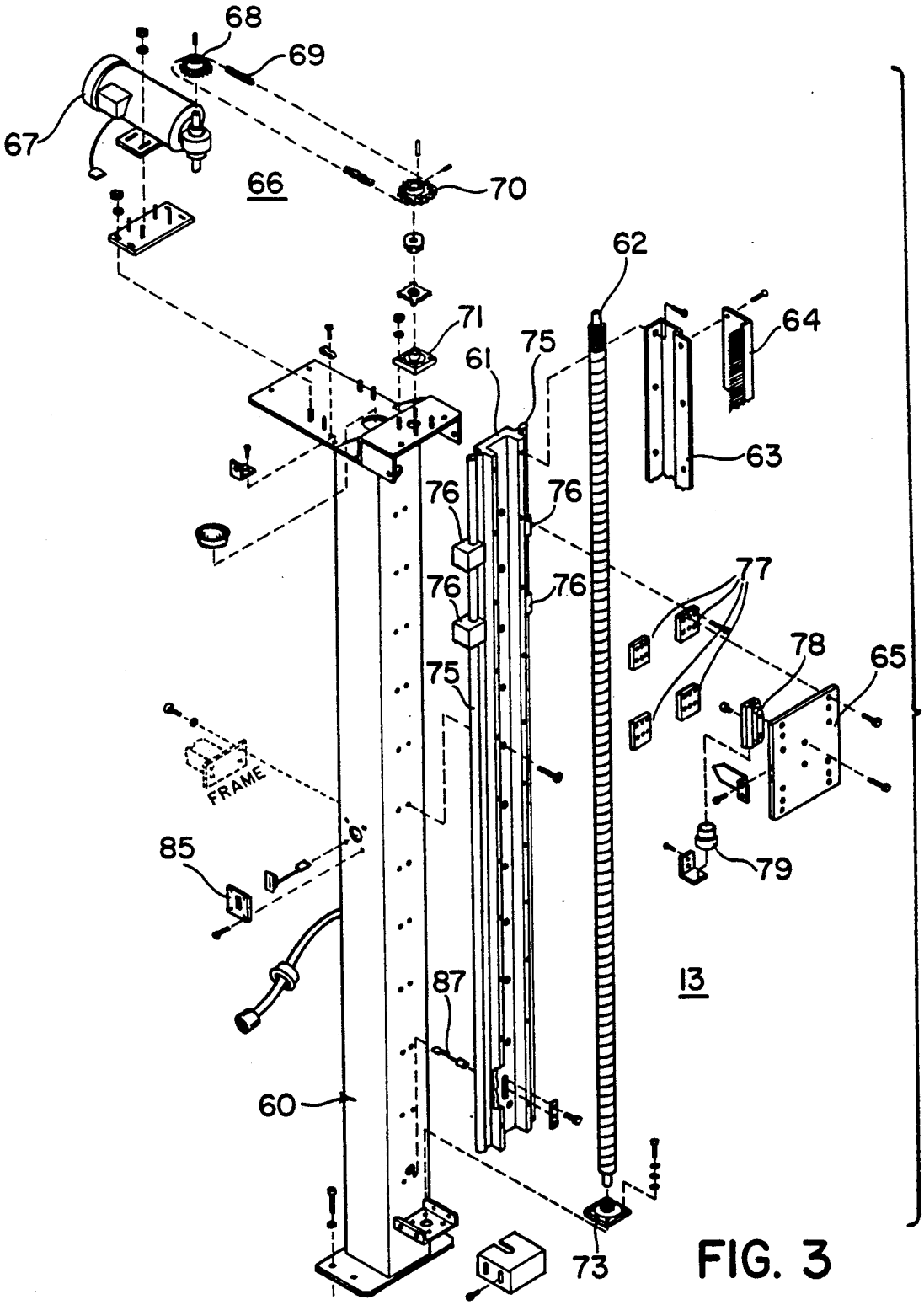
FIG. 3 is an exploded perspective view of a power head elevator assembly useful in muscle exercise and diagnostic apparatus in accordance with this invention.

Elevator Assembly (FIG. 3)

Referring now to FIG. 3, the details of structure and operation of an elevator assembly 13 useful in this invention will be described. Main support column 60 carries a linear bearing and slide arrangement 61 on a front surface thereof with appropriate mounting bolts and nuts utilized to fasten them together. Acme screw 62 is mounted in front of bearing and slide arrangement 61 with ends thereof journaled in upper bearing 71 and lower bearing 73. The acme screw and nut arrangement provides self-locking of the nut and screw in a loadbearing position. Yoke mounting plate 65 and spacer blocks 77 are mounted to the slide bearings 76 which travel on slides 75 on which travel on slides 75 bearing and slide arrangement 61. Drive nut 79 and housing 78 are mounted on the rear of yoke mounting plate 65 and travel on drive screw 62 as it is rotated by the motor drive arrangement 66.

Motor drive arrangement 66 includes a motor 67 and a screw drive arrangement such as a chain drive comprising sprockets 68 and 70 and chain 69. Other drive arrangements, such as gears and belt drives could also be used. Sprocket 70 is mounted to the top of drive screw 62. An up/down switch arrangement 85 is mounted on one side of support column 60 and control operation of drive motor 67. Limit switches such as switch 87 are mounted at the top and bottom of the bearing and slide arrangement 61 to signal when the yoke assembly is at bottom and top limits of travel and to turn the drive motor off. Safety covers 63 and a brush cover arrangement 64 are mounted on both sides of the bearing and slide arrangement 61 to hide and protect the drive screw.

Mounting Yoke Assembly (FIGS. 4–8)

FIGS. 4–8 illustrate the structural and operational features of mounting yoke assembly 12 and power head 11. Yoke assembly 12 includes a back plate 100 that fastens to yoke mounting plate 65 on support column assembly 13 shown in FIG. 3. Right and left support arms 101 and 102 extend forward from back plate 100 and each has a mounting aperture 103 formed therein for receiving a shaft and bearing mounting assembly for rotational mounting of power head 11 thereon.

Figures 4, 5:
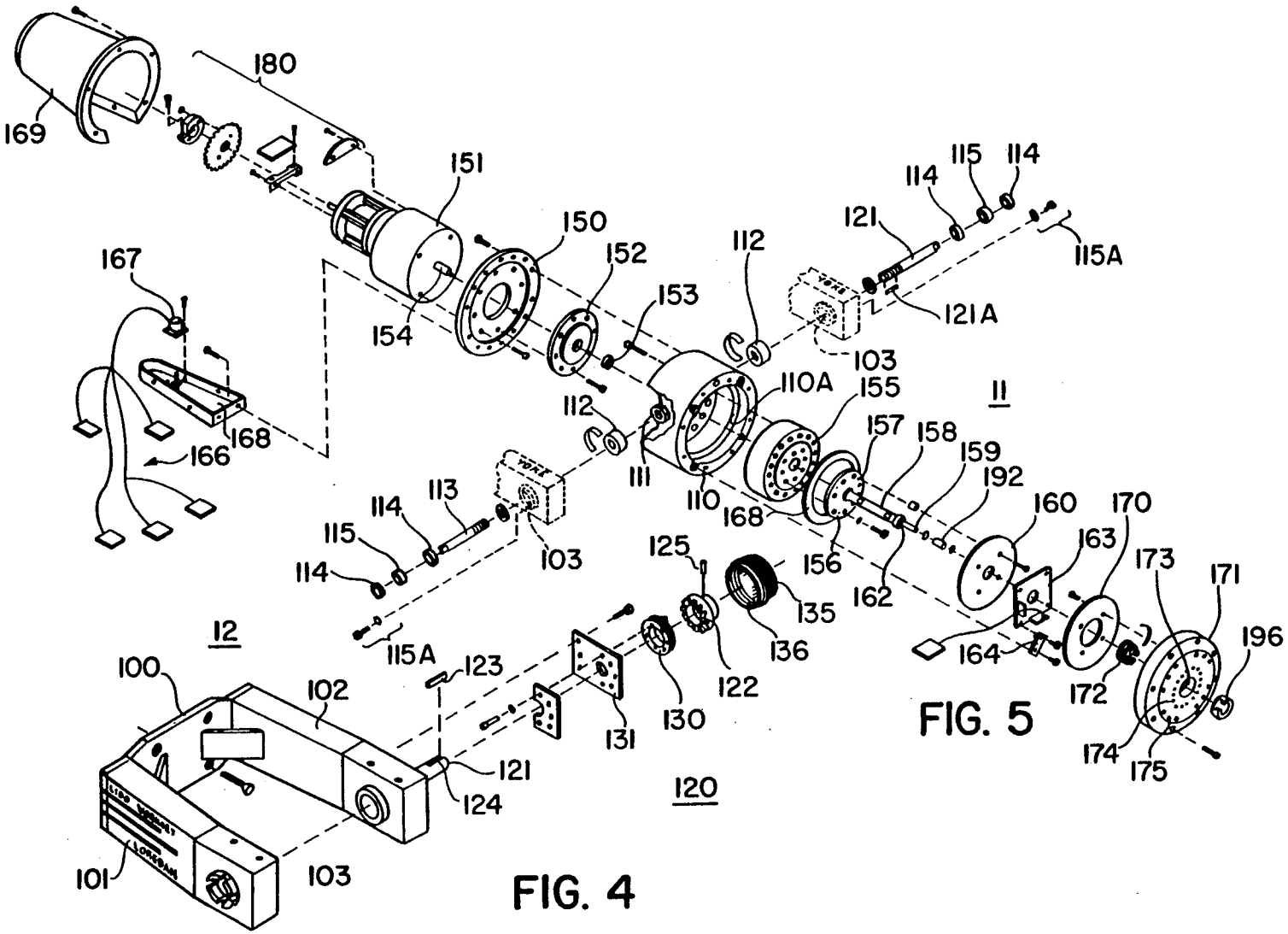
FIG. 4 is an exploded perspective view of a yoke support assembly useful in muscle exercise and diagnostic apparatus in accordance with this invention.
FIG. 5 is an exploded perspective view of a power head assembly useful in muscle exercise and diagnostic apparatus in accordance with this invention.
Figure 6:
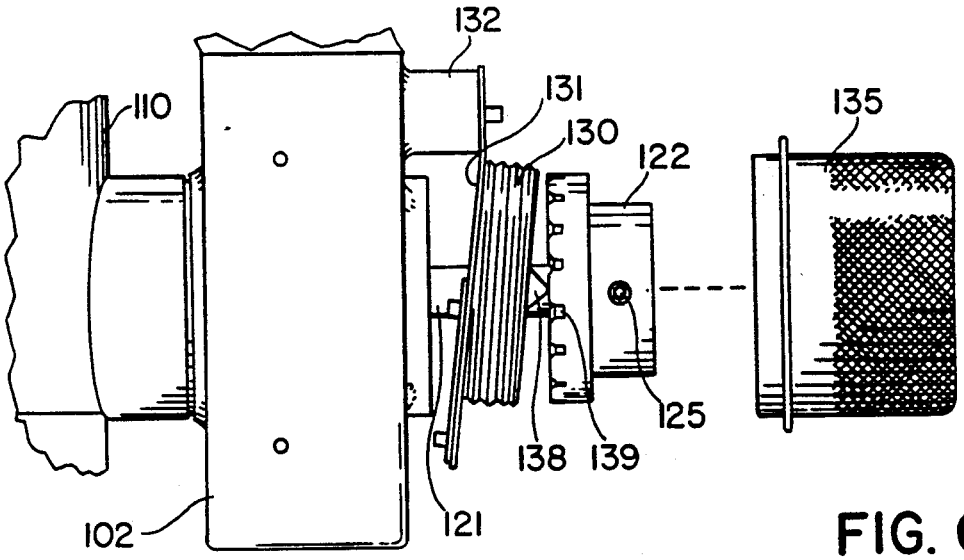
FIGS. 6 and 7 are top plan views of a detented power head mounting arrangement useful in muscle exercise and diagnostic apparatus in accordance with this invention.
Figure 7:
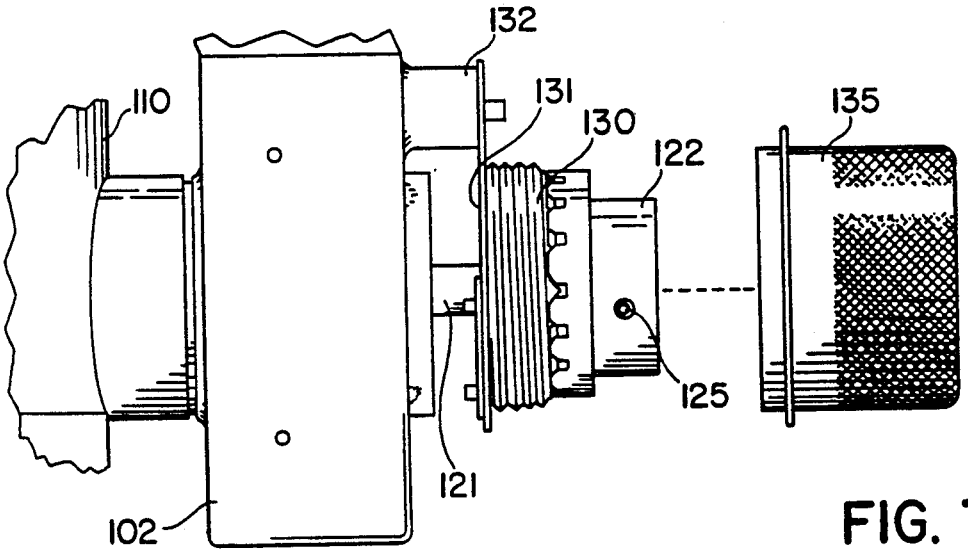

As shown in FIG. 5, power head 11 includes a main housing 110 with a pair of trunion nuts 111 mounted in internal recesses (not shown) at the end of mounting apertures therethrough and receiving a threaded end portion of shaft 113 on one side and shaft 121 on the other side to mount the shafts to housing 110. Shaft 121 is keyed with key 121A to the mounting aperture in the housing to rotate therewith. Trunion collar 112 fits over shaft 113 and is positioned between housing 110 and the inner surface of arm 101. Bearing 115 and spacers 114 are Carried in mounting aperture 103 and journal shafts 113 and 121 and housing 110 for rotation about the axis of the two shafts. Bracket and screw arrangements 115A retain the bearing and spacer arrangements within the mounting apertures 103.

Figure 8:
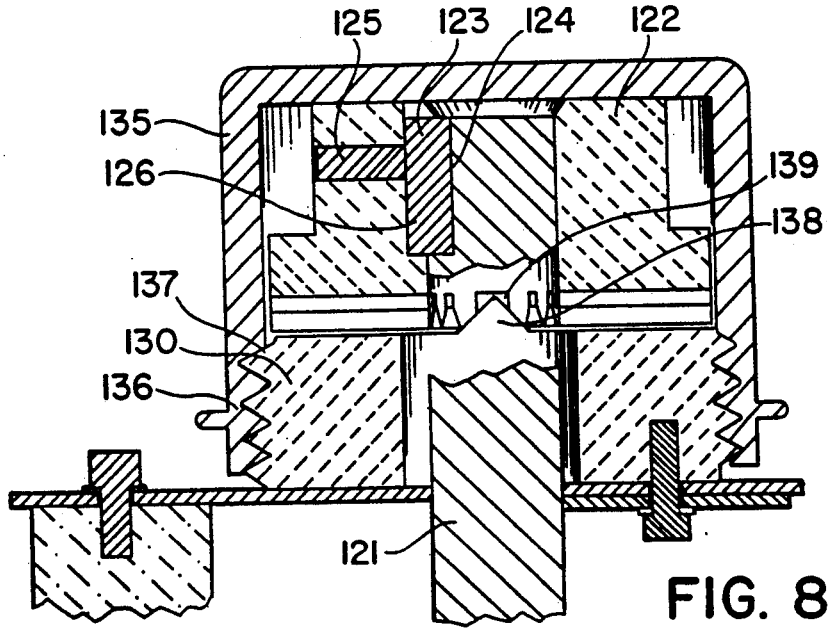
FIG. 8 is a section view of the detented power head mounting arrangement shown in FIGS. 6 and 7.

As shown in FIGS. 4, and 6–8 a detent locking arrangement 120 is provided on shaft 121. Locking ring 122 is mounted in a fixed manner on the outer end of shaft 121 by means of a key 123 carried in keyway 124 in shaft 121, corresponding keyway 126 in ring 122 and set screw 125. In this manner, locking ring 122 rotates with shaft 121 which in turn rotates with housing 110 of power head 11. A second locking ring 130 is mounted on a spring plate 131 which in turn is mounted on mounting block 132 on the outer sidewall of yoke arm 102 as shown best in FIGS. 6 and 7. A locking nut 135 mounts over the locking rings 122 and 130 as shown in FIG. 8. Internal screw threads 136 on locking nut 135 thread over external threads 137 on locking ring 130 and urge locking ring 122 and locking ring 130 together after a pair of diametrically opposite projections 138 on locking ring 130 have entered one diametrically opposite pair of detent notches 139 on locking ring 122. Detent notches are spaced at 15 degree intervals on ring 122, providing twenty-four detented mounting positions.

The operation of this detent locking arrangement should now be apparent. With locking nut 135 removed, housing 110, shaft 121 and locking ring 122 are free to turn with projections 138 riding in and out of detent notches 139 against the pressure of spring 131. When the desired position of power head 11 has been achieved, the locking nut 135 is threaded over the locking ring 130 until the two locking rings are tightly coupled together as shown in FIG. 8. This provides a lash free coupling of the power head 11 in selectable angular positions on mounting yoke assembly 12. The advantage of this locking rotatable coupling arrangement is that no tools are required to reposition power head 11 relative to mounting yoke 12. Hand tightening and loosening of locking nut 135 is all that is required. A knurled outer surface on locking nut 135 facilitates hand tightening and loosening of the locking nut. The leverage afforded by the power head housing 110 makes it easy to rotate the locking ring 122 relative to locking ring 130 from one detent position to another. When the coupling arrangement is tightened, the torque on housing 110 and shaft 121 is resisted by the spring plate 131.

Power Head Assembly (FIG. 5)

FIG. 5 illustrates structural and operational features of power head 11. An epicyclic reducer 155, such as a Dojen drive available from Dolan Jenner Industries of Woburn, Mass., is bolted into the inside cavity 110A of housing 110. A motor mounting plate 150 is bolted to the front of servo motor assembly 151 and a bearing mounting plate 152 is used to mount bearing 153 around shaft 154 of servo motor 151. This subassembly is then bolted to the back of housing 110 so that shaft 154 is received in a drive aperture of reducer 155.

An output shaft assembly 156 is bolted to the front of reducer 155. Output shaft assembly 156 includes shaft mounting flange 157, a high torque shaft section 158 and a low torque shaft section 159 formed on the front of high torque shaft section 158 and coaxial therewith. The details of this dual torque shaft assembly and the arrangements provided for removably coupling low torque and high torque tools to these shafts will be discussed below in connection with FIGS. 9 and 10.

Figures 45, 46:
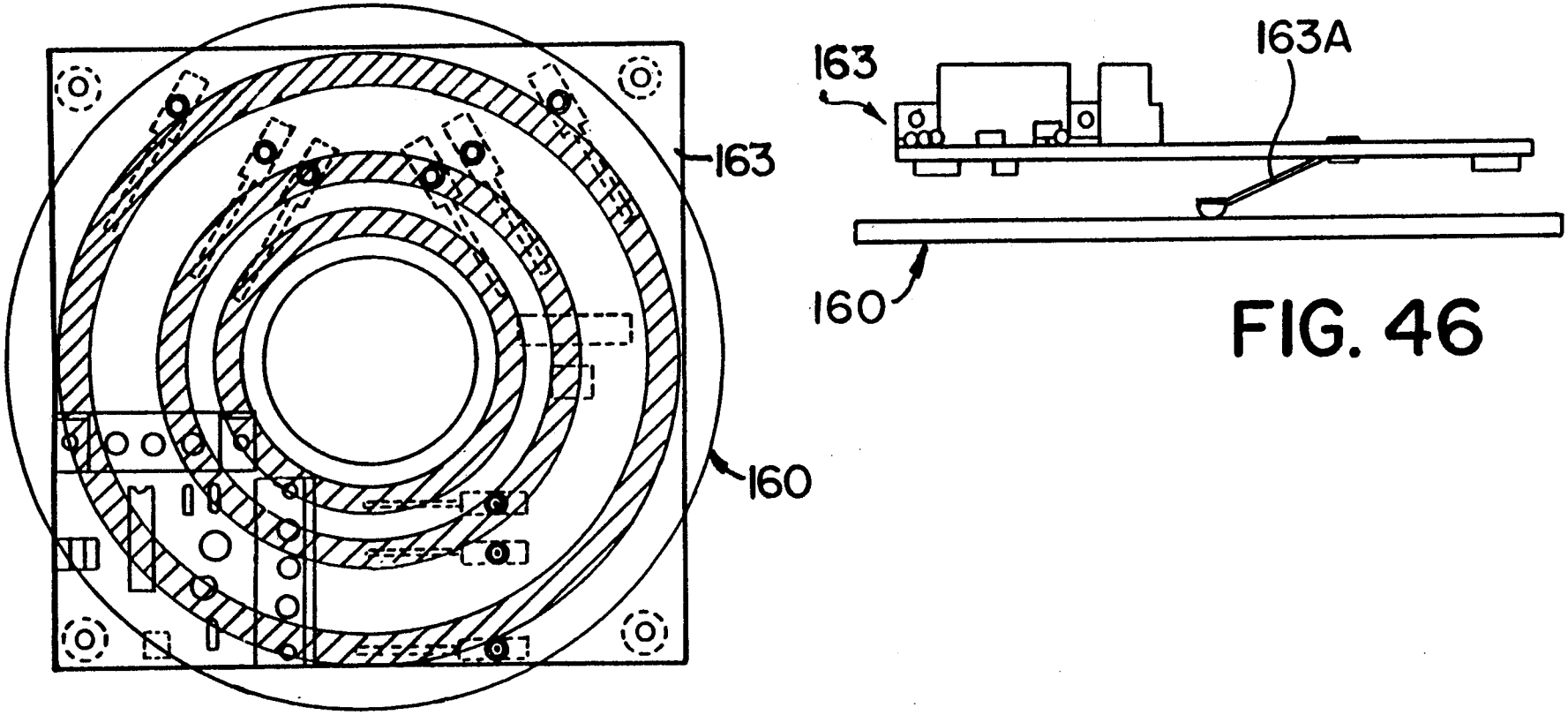
FIG. 45 is a partial top plan view of a dual channel torque measuring system useful in a muscle exercise and diagnostic apparatus in accordance with this invention.
FIG. 46 is a side view illustrating features of the dual channel torque measuring system of FIG. 45.

A dual channel torque board 160 is mounted on the front of shaft mounting flange 157. A torque sensing strain gage arrangement 161 mounted on high torque shaft section 158 and a second torque sensing strain arrangement 162 is mounted on low torque shaft section 159. These two strain gage arrangements are wired to separate load cell circuits of conventional type on torque board 160. A torque signal receiving board 163 is mounted to the front of housing 110 using four mounting brackets 164. As shown in FIGS. 45 and 46, a combination of spring loaded signal connecting brushes 163A on receiving board 163 and slip rings on torque board 160 couple the two torque signals into two signal channels. A third slip ring couples a fifteen volt power signal to the torque board for electrical operation of the components thereon. The torque signal outputs are wired back through the housing 110 to connector assemblies 166 which feed into a multiwire cable connector 167 fastened in a lower section 168 of housing cover 169.

A hole cover ring 170 is mounted to the rear wall of housing faceplate 171, which in turn is mounted to the front of housing 110. A faceplate collar 172 surrounds the output shaft where it extend through aperture 173 in faceplate 171. An array of regularly spaced alignment apertures 174 are formed in the front wall of faceplate 171 and an outer ring of tool fastening apertures 175 are also formed in the front wall of faceplate 171. These are used to align and mount baseplates which are part of some high torque and low torque tool assemblies, such as the ones shown in FIGS. 11-14.

Servo motor assembly 151 includes a servo motor with tachometer and brake. An incremental position sensing assembly 180 is mounted on the back of servo motor assembly. This particular assembly uses a toothed wheel to interrupt two light beams and provide differential position sensing accurate to within one-half degree. This is based on the number of teeth in the wheel and the ratio of the reducer. Cover 169 mounts over servo motor assembly 151 and bottom section 168 mounts to flange 150 to complete power head 11.

Figure 9:
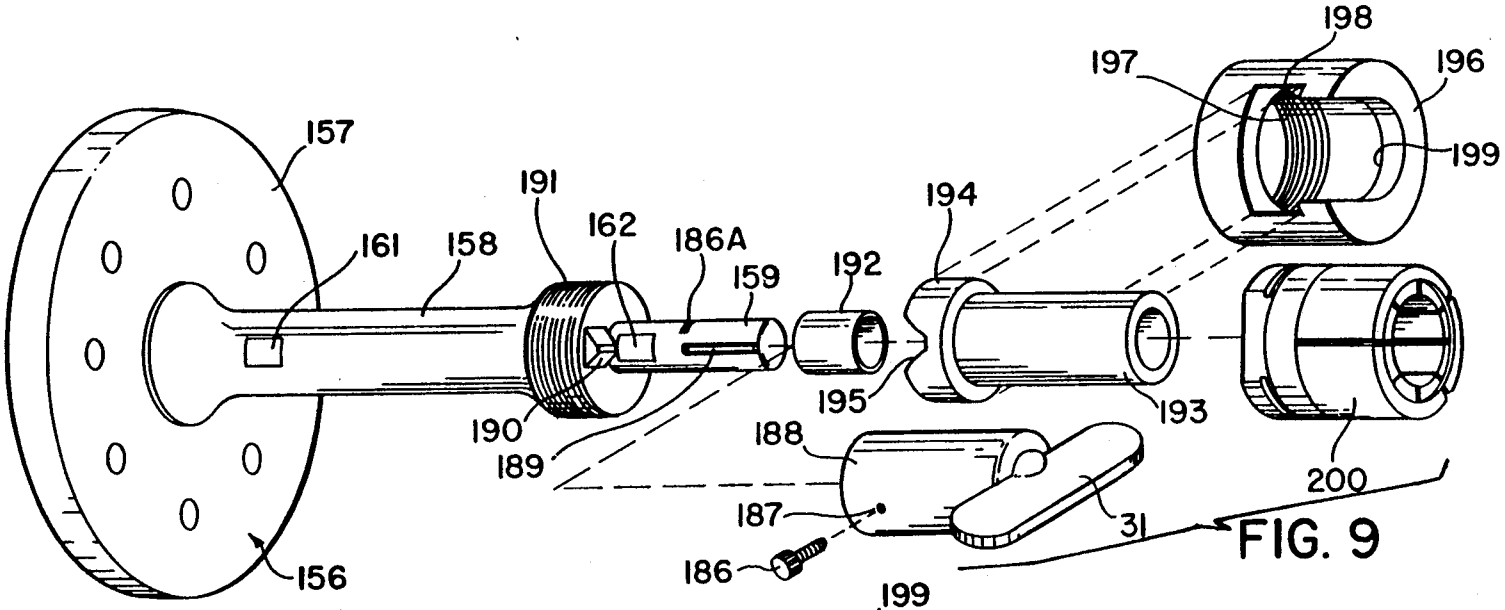
FIG. 9 is an exploded perspective view of dual torque shaft and low and high torque tool coupling arrangements in accordance with this invention.
Figure 10:
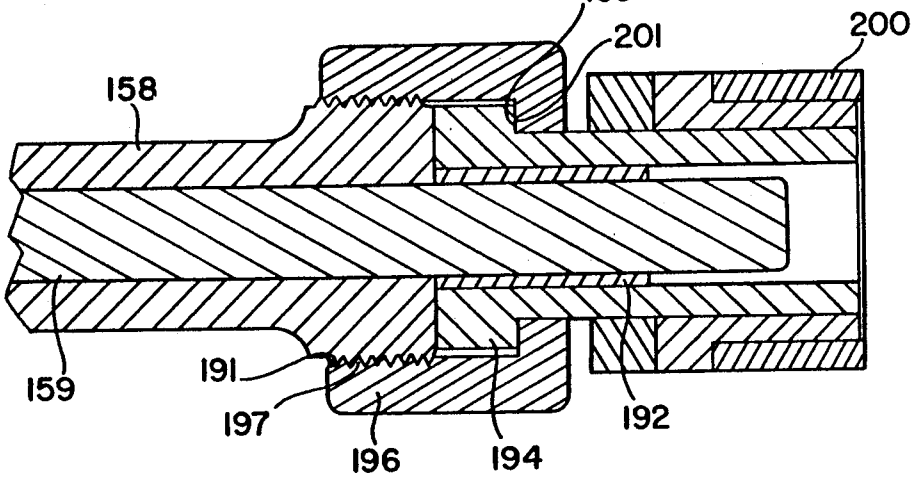
FIG. 10 is a section view through an assembled high torque coupling arrangement in accordance with this invention.

Tool Mounting Arrangements (FIGS. 9 and 10)

FIGS. 9 and 10 illustrate output shaft and tool mounting arrangements in accordance with this invention. First consider the mounting arrangements for low torque tools on low torque shaft section 159. A low torque tool, key 31, for example, includes a hollow tool mounting shaft 188 which mounts over low torque shaft section 159. An internal keyway (not shown) on tool mounting shaft 188 cooperates with key 189 mounted on shaft section 159 to couple torque from the tool to the shaft section. A screw 186 extends through a threaded aperture 187 into a small slot 186A on shaft section 159 to removably retain the tool in place on the shaft. Finger pinch assembly 35 uses this same tool shaft mounting arrangement, but also employs a pair of alignment pins on a baseplate member to maintain the baseplate and one of the pinch arms in position on faceplate 171.

High torque tools are mounted to high torque shaft section 158 using a hollow tool shaft 193 and a shaft coupler nut 196. Shaft coupler nut 196 mounts over tool shaft 193 before it is placed over the small shaft section 159. Enlarged diameter portion 194 on tool shaft 193 fits into the window 198 formed in the side of shaft coupler nut 196. A gage protection ring 192 fits over strain gages 162 to protect them from damage from tool shaft couplers 193. A first mating surface configuration 190 in the form of a pair of tapered projections formed on diametrically opposite sides of a forward end of high torque shaft section 158 cooperate with a corresponding second mating surface configuration in the form of a pair of tapered slots 195 formed on a forward end 194 of tool coupling shaft 193 to form a torque transfer mating relationship between these two elements. Shaft coupler nut 196 includes internal screw threads 197 which screw onto external screw threads 191 on shaft section 158 to couple the tool coupling shaft 193 to the high torque shaft section 158 with the shoulder 199 on coupler nut 196 pushing on shoulder 201 on tool coupling shaft 193 to urge the tapered projections 190 into tight fitting, torque transfer engagement with the tapered slots 195. Hand tightening of coupler nut 193, with the assistance of a knurled outer surface thereon, produces an essentially lash free coupling of the high torque tools to the high torque shaft section.

It should be obvious that the various elements of this coupling arrangement could be rearranged without affecting their operation. For example, the tapered projections and slots could be exchanged from one element to the other. Also the screw threads could be exchanged from one part to the other. It should also be recognized that the coupler nut 196 could be permanently provided on each tool shaft coupler 193 rather than using a single coupler nut for a plurality of tools.

All of the high torque tools that have limited range of motion due to mechanical stops, such as those shown in FIG. 11 and 12, utilize a friction slip coupler 200 to transfer torque from the tool to the tool coupler shaft 193. The friction slip coupler limits the torque between tool and shaft to about 180 ft/lb. to prevent damage to the tool in the event the power head 11 were to drive the tool against a mechanical stop with high torque. Above the threshold torque, the friction slip coupler allows slippage between the tool and shaft.

High Torque Tool Examples (FIGS. 11, 12)

FIGS. 11 and 12 illustrate two examples of high torque tools with a wrist exercise tool 38 in FIG. 11 and an elbow exercise tool 39 in FIG. 12. Wrist exercise tool 38 includes a baseplate 210 with mechanical stops 211 and 212 mounted thereon to physically limit the range of motion of lever arm 215. Each of the mechanical stops carries an energy absorbing material on the surface thereof that engages the tool.

A standoff section 221 extends back from the baseplate 210 and has alignment pins (not shown) in the front edge surface thereof which cooperate with fastening screws 220 to mount baseplate 210 securely in position on faceplate 171 of power head 11. Referring to FIG. 5, the outer hole pattern 175 cooperates with the positions of fastening screws 220 to limit the orientations that wrist exercise tool can be mounted in on faceplate 171.

Tool coupler shaft 193 and coupler 200 are rotatably mounted to baseplate 210. Handle 216 is carried on lever arm 215 and can be adjusted in radial position by loosening mounting screw 217. Handle 216 includes a grip section 216A oriented at a small angle to base section 216B to fit the gripping angle of the hand. This angle is adjustable by reorienting the handle when the mounting screw 217 is loosened so that the same handle can be used for exercise of left and right hand and wrist. Arm support 218 and strap 219 immobilize the forearm on the baseplate to facilitate wrist flexion-extension exercise. This is the only tool which straps the patient to the tool and care is required to set an appropriate working range of motion via the computer control system as described below.

Elbow exercise tool 39 shown in FIG. 12 comprises a baseplate 230 with mechanical range of motion stops 233 and 234 mounted thereto to limit the angular excursion of lever arm 235. Guard 240 is mounted to the lever arm to help prevent fingers from being pinched between the lever arm and the mechanical stops. Standoff mounting section 231 cooperates with the tool mounting shaft (not shown) of the typical type used for high torque tools to mount this tool to the power head 11 using alignment pins 232 to fix the position of the baseplate on the faceplate of the power head 11. These alignment pins take the force exerted on the mechanical stops if the lever arm is driven by the motor into one of these stops. A lever arm extension 236 mounts to the lever arm base section 235 using a mounting screw 237 to fasten it in position. Handle 239 is carried on an internal and external slide arrangement 238 for altering the radial position of handle 239. Various upper extremity tools can share this same baseplate and lever arm base section assembly.

Figure 13:
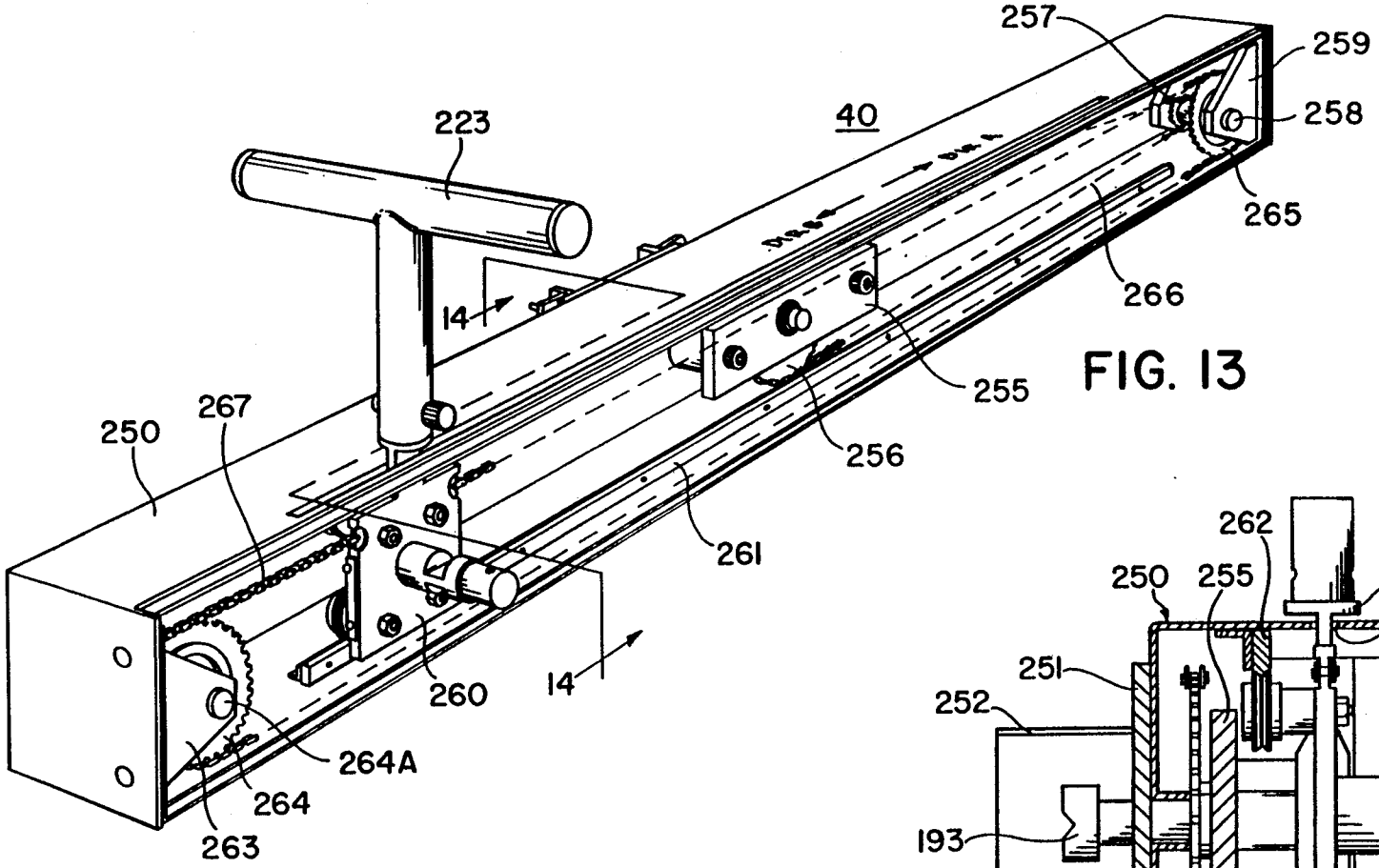
FIG. 13 is a perspective view of a linear to rotary motion accessory in accordance with this invention.
Figure 14:
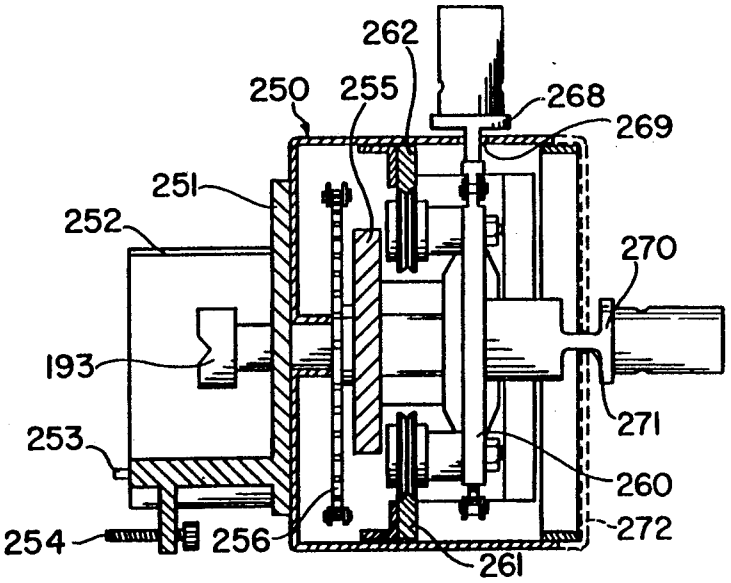
FIG. 14 is a section view of the linear to rotary motion accessory shown in FIG. 13.

Linear Motion Tool (FIGS. 13, 14)

FIGS. 13 and 14 illustrate a rotary to linear reciprocating motion conversion tool assembly 40. Baseplate 251 and standoff section 252 cooperate with alignment pins 253 and fastening bolts 254 to mount linear tool assembly 40 in one of several mounting positions on faceplate 171 of the power head 11. Tool coupling shaft 193 and an associated torque limiting coupler (not shown) are mounted for rotation relative to baseplate 251 and mounting bracket 255. A chain drive sprocket 256 is carried on tool coupling shaft 193 to rotate therewith. A drive chain 266 carried on sprocket 256 extends around sprocket 257 mounted on shaft 258 which is journalled for rotation on mounting bracket 259 carried on one end of housing 250.

A carriage assembly 260 is carried on linear tracks 261 and 262 for an accurately guided linear reciprocating movement of tool coupler 268 is mounted on top of carriage assembly 260 and extends through an elongated slot 269 in a top wall of housing 250. A second tool coupler 270 is optionally mounted on the rear of carriage assembly 260 and extends thorough an elongated slot 271 in a back wall 272 of housing 250. Back wall 272 may be removable for assembly and servicing. A sprocket 265 is mounted on shaft 258 and a sprocket 264 is mounted on shaft 264A carried on bracket 263 at the opposite end of housing 250 to form, with drive chain section 267, a drive arrangement for carriage assembly 260 which is coupled to the first drive chain and sprocket arrangement previously described. Chain 267 has its opposite ends fastened to opposite sides of carriage assembly 260 to couple the linear reciprocating motion of carriage assembly 260 to shaft 258 and from there through the first chain drive arrangement to tool coupler shaft 193. The diameters of the sprockets 256, 264 and 265, all of which are keyed to their respective shafts, determine the gear reduction ratio of the drive mechanism.

The carriage and track arrangement provide smooth, accurate linear reciprocating motion with little friction for accurate measurement of forces placed on the tool by the patient. A T-bar handle 273 is shown mounted to the tool coupler 268. As previously noted, a variety of tool handles can be mounted to this assembly to imitate various work related push-pull movements. Direction A and Direction B labels are shown on housing 250 to key those directions to the range of motion setting routine discussed below.

Microprocessor Based Controller (FIGS. 15–18)

Figures 15, 16:
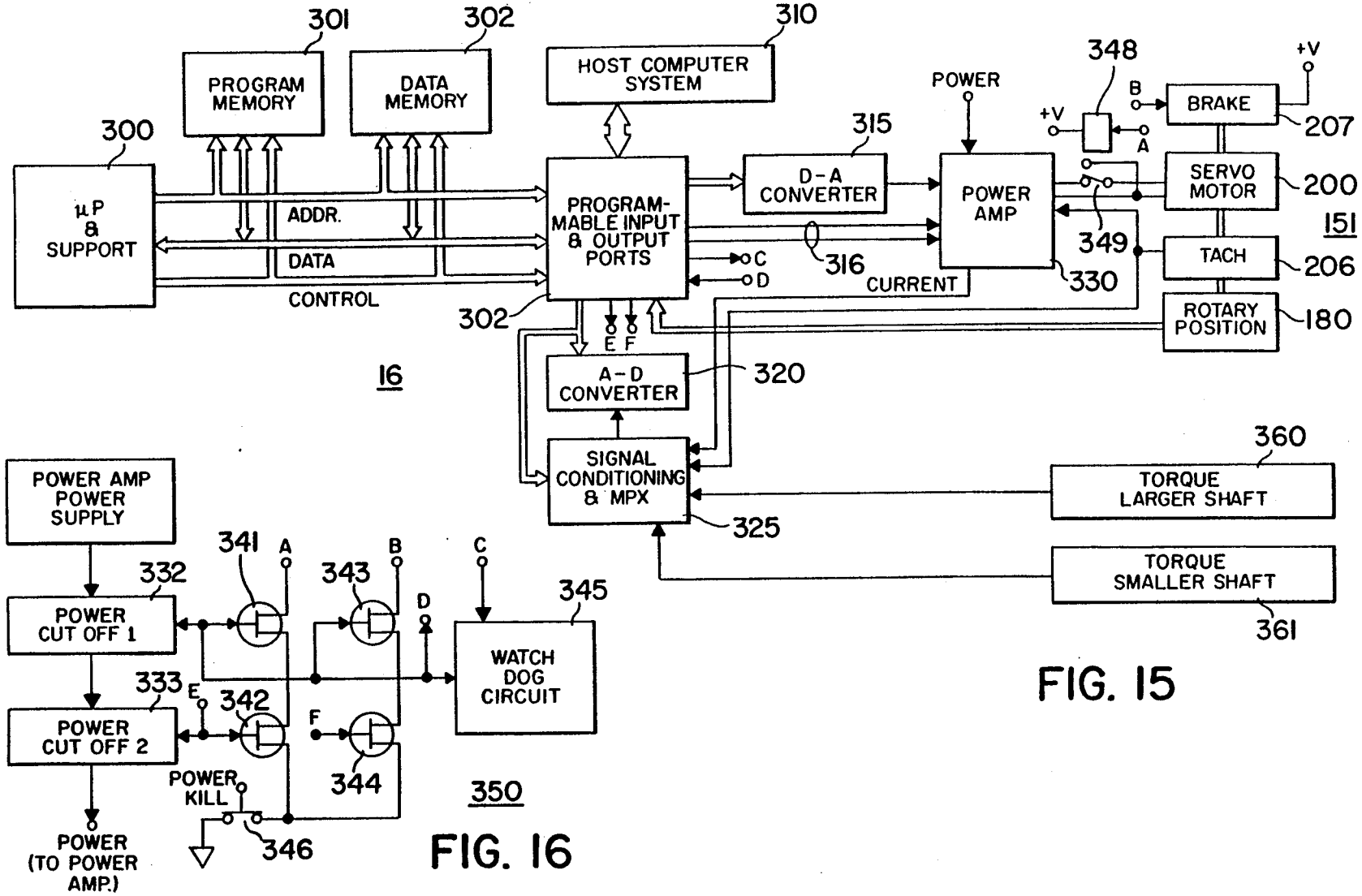
FIGS. 15 and 16 are block schematic diagrams of a real time controller system in accordance with this invention.

FIGS. 15 and 16 are block diagrams which illustrate one embodiment of a computer control system used as a controller 16 for the servo motor and drive arrangement 151 in accordance with this invention. The computer control arrangement is based on a standard real time microprocessor control system architecture which does not need to be explained in detail. A microprocessor and support circuit arrangement 300 of standard design communicates via data, address and control busses with program memory 301, data memory 302, and programmable input and output ports 302. Ports 302 provide data and control communication channels to a host computer system 310, a digital to analog converter 315 and analog to digital converter 320. D/A converter 315 has its output coupled to power amplifier 330. This is the path by which microprocessor 300 sends a velocity command to power amp 330 which operates with servo motor 200 and tachometer 206 in a velocity servo loop. This invention is not limited to any particular form of servo control system and other forms that velocity servo control may be employed.

Ports 302 also directly couple two disable signal channels 316 into power amp 330 so that the microprocessor can immediately disable the power amp under certain emergency conditions when it detects that the system is not behaving in a safe manner. These are redundant disable channels and completely disable the power amp from driving the servo motor in either direction. Ports 320 also send and receive signals on direct channels C, D, E, and F to a safety circuit 350 shown in FIG. 16.

A/D converter 320 provides the channel through which microprocessor acquires digital versions of the various signals which are sent out by various parts of the system. Rotary position encoder 180 provides a digital signal output directly into port arrangement 302. All other signal inputs are analog and are routed through a signal conditioning and multiplexing circuit 325 which conditions each signal as necessary relative to range of amplitude and also does some low pass filtering and buffering as needed. This circuit then multiplexes one signal at a time in sequence to the A/D converter 320. In this manner the microprocessor obtains the value of the output signals from tachometer 206 and the two channels of torque signals 360 and 361 from power head 11. It also obtains the current from power amp 330. If desired, an absolute rotary position signal could also be acquired if a multiturn potentiometer is coupled to the output shaft in the power head.

FIG. 16 illustrates a safety circuit system which functions together with relay 348 and brake 207 to prevent the servo motor system from operating in an unsafe manner. Relay 348 is connected in a series circuit with two field effect transistor (FET) switching devices 341 and 342 and a power kill switch 346. For relay 348 to be operated to maintain contact arrangement 349 in the position shown, the power kill switch 346 must be closed and both FETs 341 and 342 must be on. Brake 207 is connected in a series circuit with two FETs 343 and 344 as well as kill switch. When no power is applied to brake 207 it is in a brake applied condition and prevents rotation of the servo motor shaft. When power is applied, the brake is off.

Power kill switch 346 (22 in FIG. 1) has normally closed contacts and can be operated by a person monitoring the system's performance to open the circuit to relay 348. When relay 348 has its power interrupted, switch 349 connects the ends of the windings of the servo motor together and servo motor 200 operates in a regenerative braking mode and brakes itself and the output shaft and tool thereon to a stop. Operation of the power kill switch 346 also interrupts power to brake 207 and brake 207 responds by immediately braking the shaft and motor to a stop.

A signal over line E from port 302 can be sent by the microprocessor to turn off FET 342 and another separate signal can be sent over line F to FET 344. A signal on line E operates cut off 333 and turns off relay 348 to disable the power amp and cause the servo motor to brake itself. A signal on line F only applies the brake 207. These provide the computer with the ability to shut down the servo motor system under defined safety conditions. Also the direct control of the operation of the brake is used by the computer during an isometric hold mode of operation of the system. This avoids requiring the servo motor to absorb all of the torque applied during an isometric hold and eliminates the possibility of overheating the motor during a long isometric hold.

Watchdog circuit 345 receives a series of pulses from microprocessor 300 over line C from port 302. If the microprocessor and its program are operating correctly, these pulses will arrive at a nominal rate of one hundred Hertz. If the frequency of arrival of these pulses goes outside of upper and lower limits built into the watchdog circuit 345, it will produce an output that turns off both FETs 341 and 343 and turns off power cutoff device 332 to disable the power amp 330.

It is thus seen that there are five separate and independent systems and methods for shutting down the servo motor drive system under safety or fault conditions:

1. turn off relay 348 and thereby disconnect the motor 200 from the power amp 330 while also reconnecting the motor windings to each other to produce regenerative braking;
2. Disable power amp 330 via commands over lines 316;
3. Disconnect the AC power to power amp 330 via a command over line E or an output from watchdog circuit 345;
4. Command the amplifier to halt the motor by a zero velocity command sent through the D-A converter 315; and
5. Disconnect power to the circuit which holds brake 207 in brake off position via a signal on line F.

When microprocessor 300 shuts down the system, it uses all five methods. When watchdog circuit 345 shuts down the system, it uses methods 1,3, and 5. When the Kill button 346 is pressed, it uses methods 1 and 5. Microprocessor 300 senses a system shutdown by other safety system and immediately uses all other shut down approaches. The watchdog circuit 345 and microprocessor 300 have separate systems to accomplish the shutdown approaches 1, 3, and 5.

Examples of various emergency conditions that might be experienced by the system and produce shutdown are as follows:

Tool is out of range of outer range of motion limits set in host computer system;

Measured position or velocity is inconsistent with commands sent to the power amp;

Microprocessor 300 stops running altogether due to circuit problems, or power supply failure; and Communication failure with the host computer.

SOFTWARE CONTROL SYSTEM AND METHOD

The overall software control system and method used in the system and method of this invention involves minor modifications of the software system and method that is used in a commercially available exercise system called the "LIDO ACTIVE" system. This exercise system is sold by Loredan Biomedical Inc. of Davis, Calif., and the software control system is available for purchase from Loredan on the basis of a source code license involving an initial license fee and a per unit royalty. The information given below together with the operating description the workings of this invention are sufficient for persons of ordinary skill in the software control field to author computer programs to accomplish the necessary control tasks. Thus the specific details of the software control system need not be described here.

Figure 17:
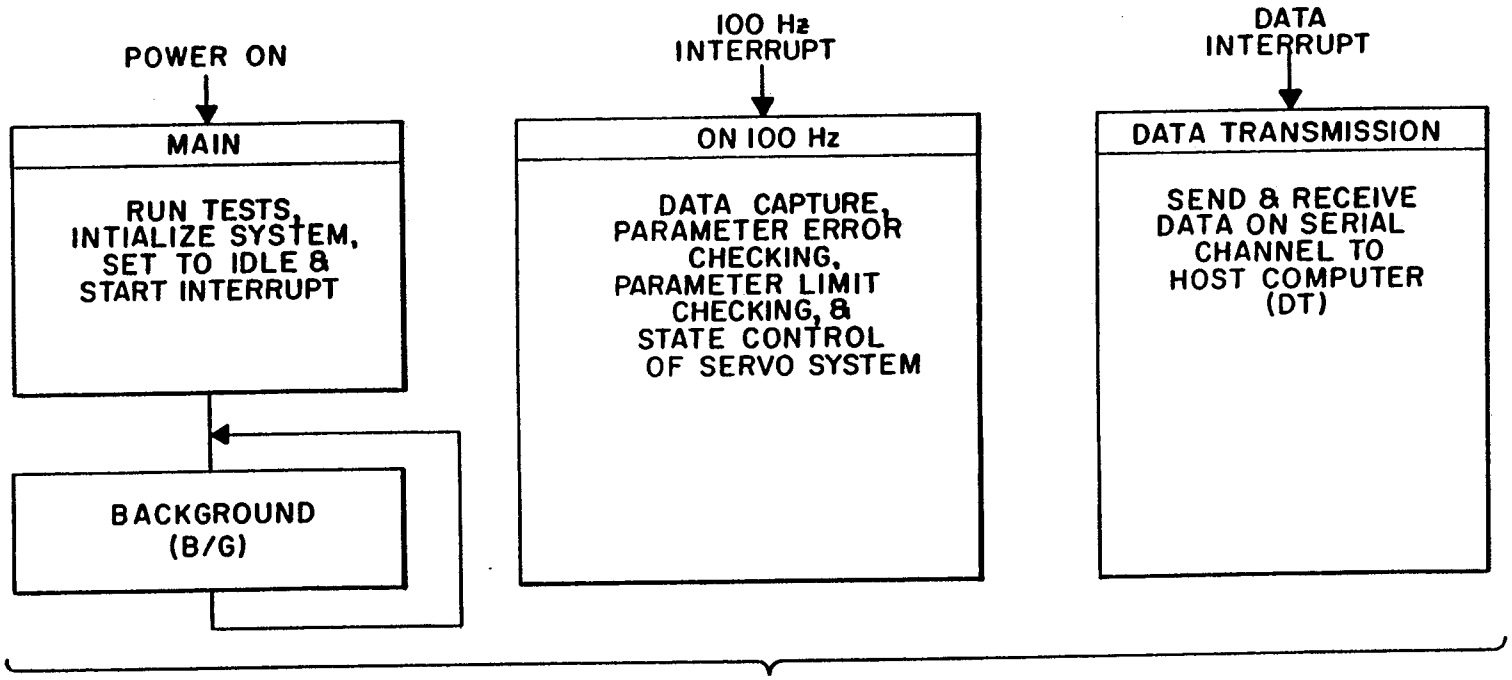
FIG. 17 is a diagram illustrating the operation of a real time software control program useful in muscle exercise and diagnostic apparatus in accordance with this invention.
Figure 18:
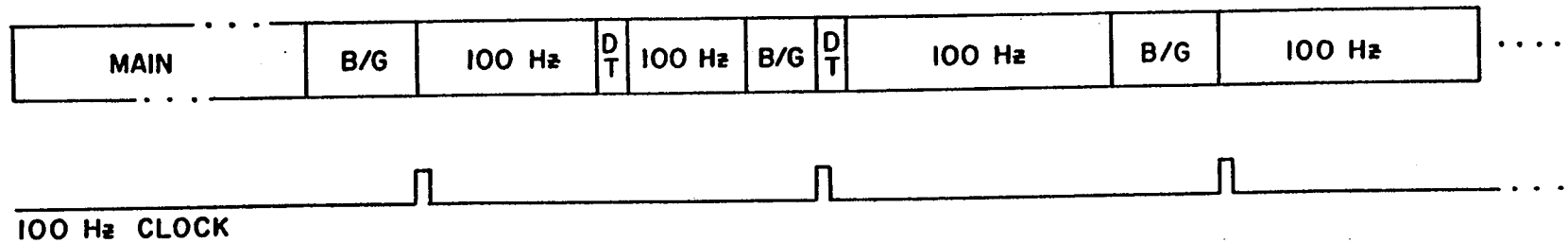
FIG. 18 is a diagram illustrating the operation of the software control program arrangement of FIG. 17.

FIGS. 17 and 18 illustrate the structure of the software routines which comprise one implementation of software control methods for this invention. A Power ON or MAIN routine executes when the system is first powered up to perform the following sequence of steps:

perform a check sum test on ROM program memory 301;

perform a read/write test of RAM data memory 302;

test the operation of the watchdog circuit 345;

initialize data variables in RAM data memory 302;

initialize hardware control ports 302, e.g. the serial communications controller, the interrupt timer and the analog to digital converter;

set the operating state to "idle";

start the interrupt system and go to begin execution of BACKGROUND routine.

The BACKGROUND routine executes in a continuing loop until there is a 100 Hz interrupt. The main operations of the BACKGROUND routine are to maintain the control system in an "idle" state while looking for a "Change of State" flag. When such a flag is noted, depending on the new state indicated, some initialization is performed. This routine also controls switching of states in the 100 Hz interrupt and waits for the 100 Hz routine to finish execution and go back to the idle state.

Every 1/100th of a second the 100 Hz interrupt clock ticks and the 100 Hz routine begins to execute and continues to execute unless there is a data transmission interrupt which has the highest interrupt priority. The 100 Hz routine performs basic parameter data capture via operation of the multiplexer 325 and the A-D converter 320 and by obtaining the shaft position data from the rotary position encoder (optical encoder) 108 via a separate port, and performs parameter error checking to determine if the system is behaving normally. For example, a velocity check is performed by comparing the output signal from tach 206 with a velocity value calculated from changes in shaft position values. The 100 Hz routine also performs limit checking on parameters downloaded from the host computer 310 such as tool shaft position limits and/or torque limits.

The 100 Hz routine also operates the control system in one of the various states programmed into the system. During the idle state, the power amp is turned off and the brake is off. This is the state that the system is in while parameters are being set up for use in the other states.

Another state is the "initialize" state for baseline torque and shaft position determination. During this state the baseline value of the torque transducers and the zero position of the shaft is set. The steps for this will be discussed later.

Figure 41:
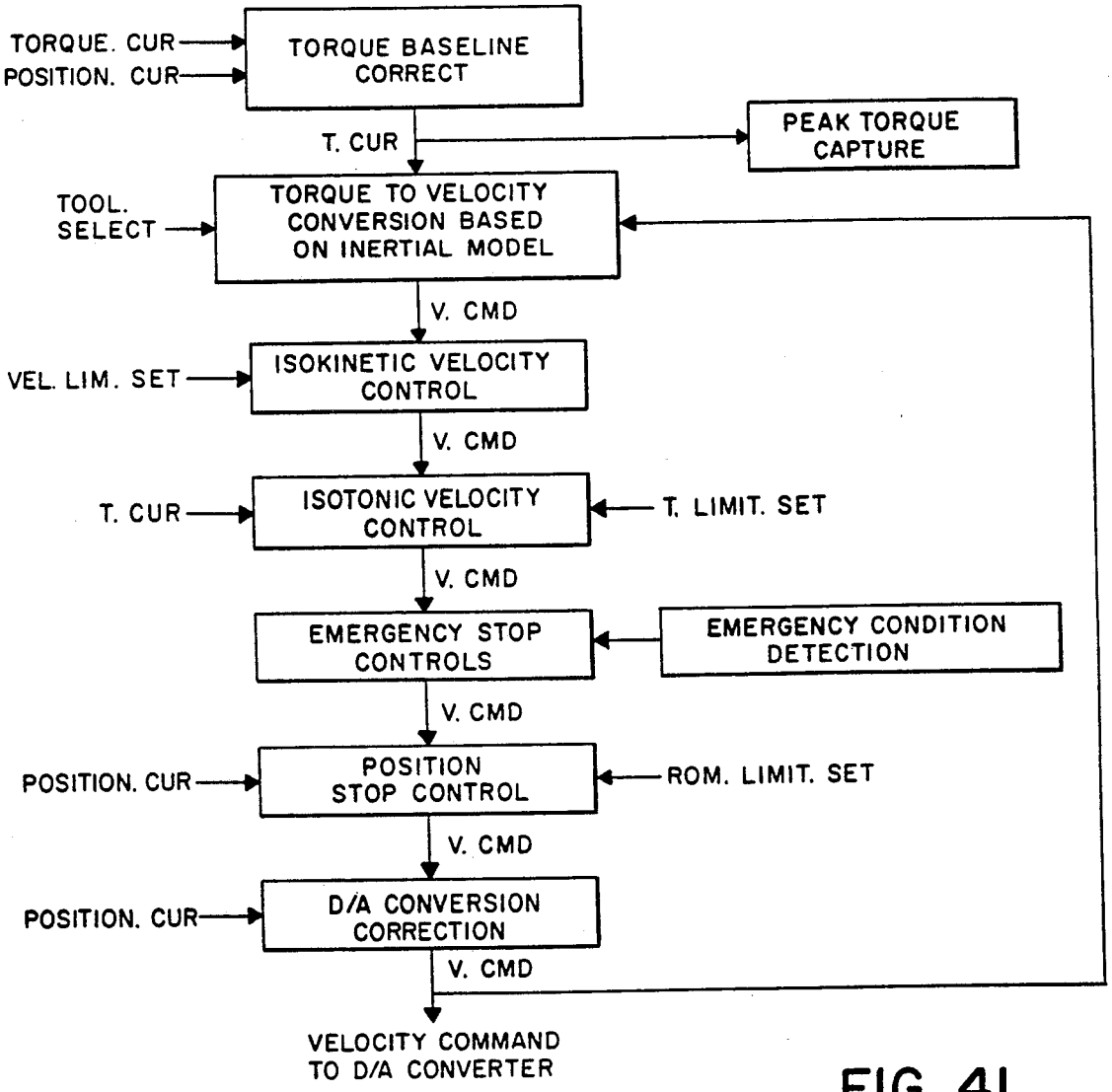
FIGS. 41-44 are diagrams of various movement control program modules in accordance with this invention.
Figure 42:
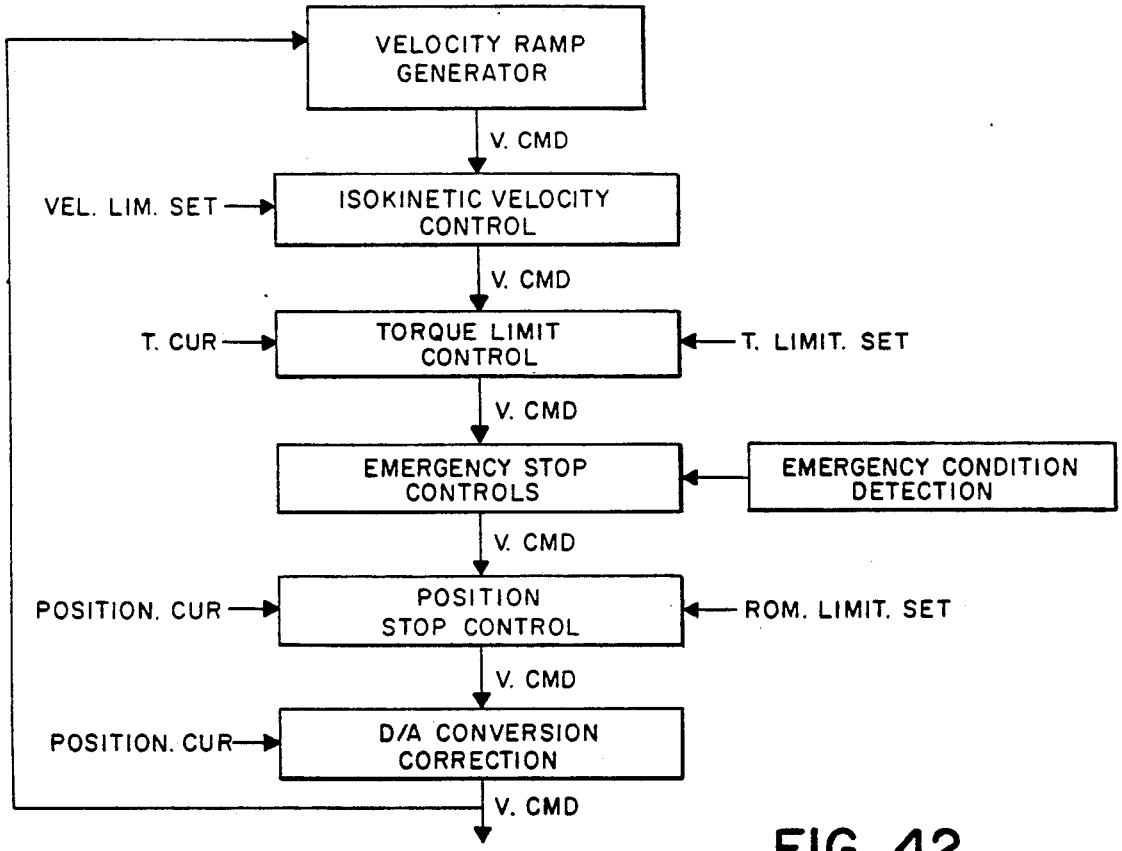
Figure 43:
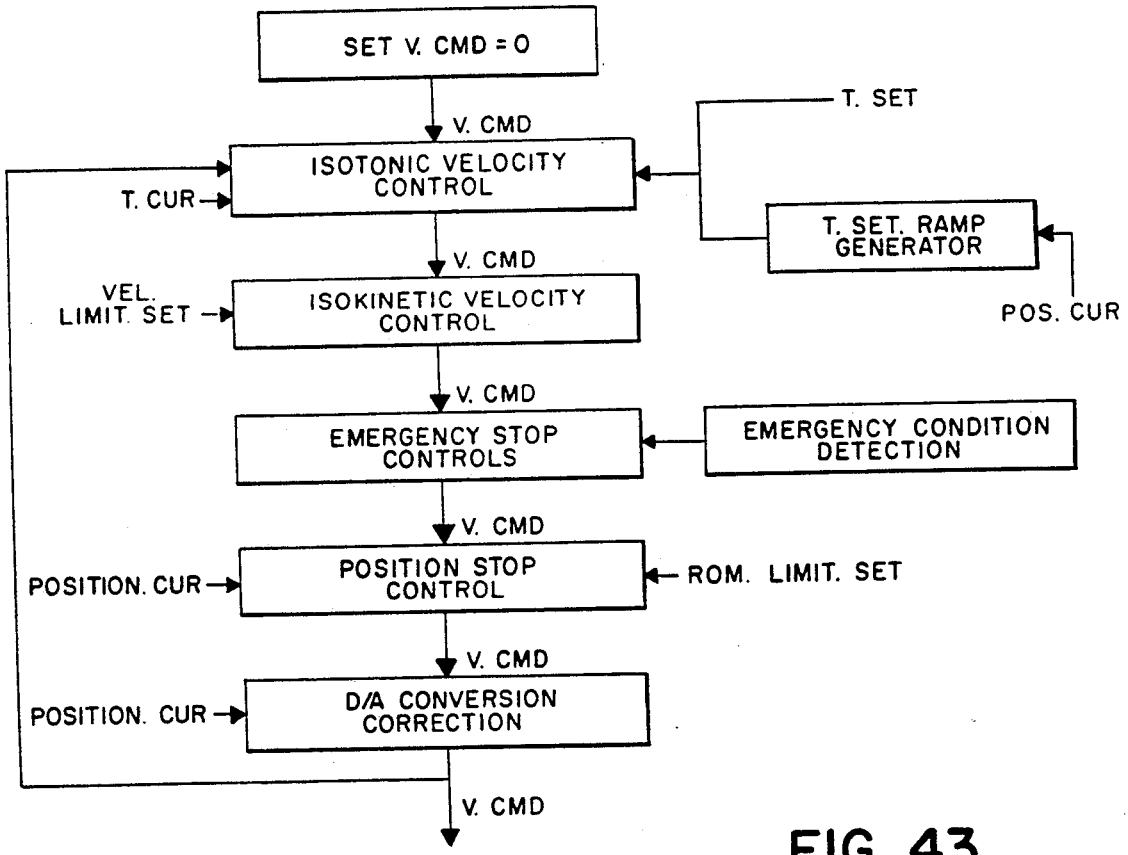
Figure 44:
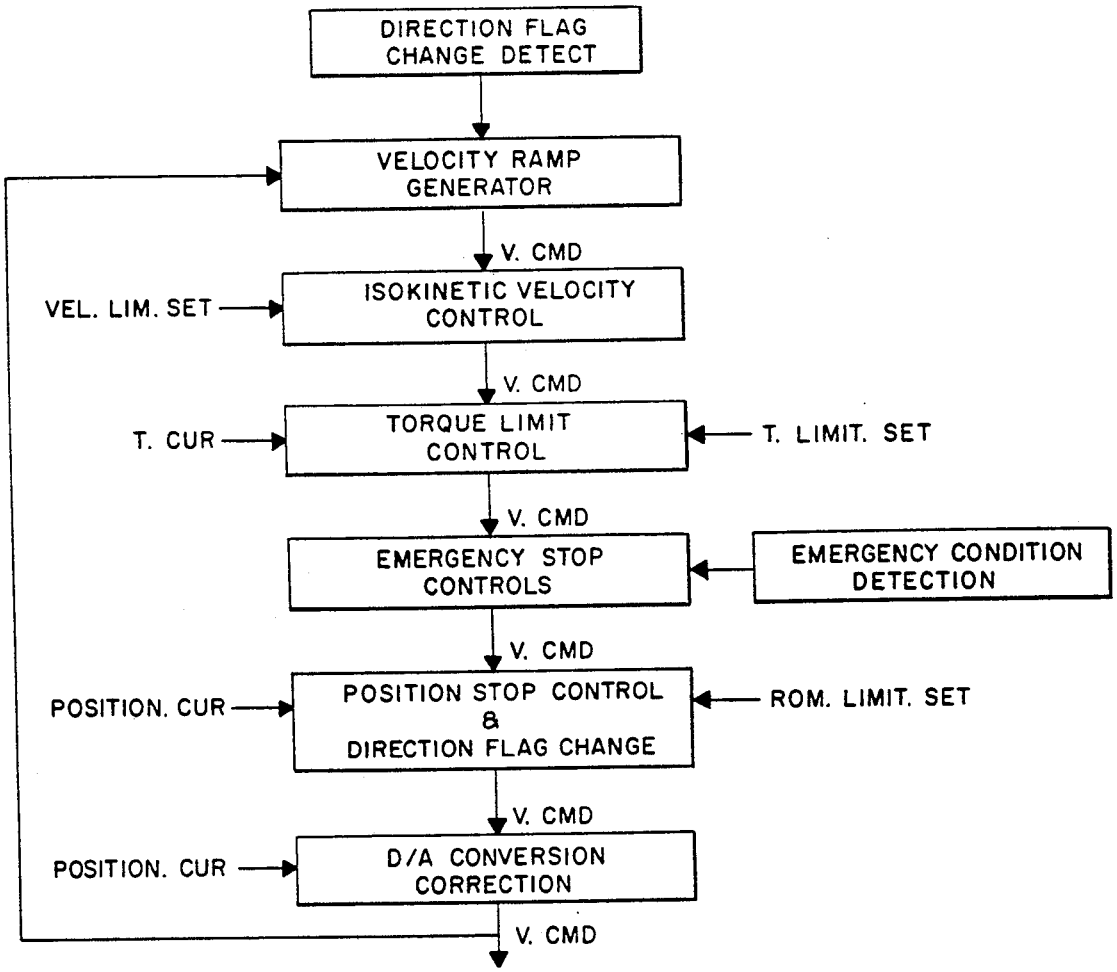

Another state is the concentric motion control state in which the servo system is controlled according to an inertial model which converts torque to velocity with accompanying algorithms for isokinetic velocity control and isotonic velocity control such as illustrated in FIG. 41. The system is also capable of operating in an eccentric control state as illustrated in FIG. 42. FIG. 43 illustrates the routines of a Continuous Passive Motion Control state and FIG. 44 illustrates an Isotonic Motion Control state and the associated routines. Another operating state is provided for the isometric mode during which the output shaft is held in a fixed position while shaft torque measurements are being made. This is a simplified version of the state and associated routine used in the LIDO Active system and is not diagrammed herein. The other operating routines will be described in more detail below.

The concentric/eccentric and isometric states involve routines which are similar to those executed in the LIDO Active software. The LIDO Active software also acquires "lever length" data and uses that as a proportioning factor in some of the control algorithms, but that parameter is not involved in the exercise task control routines involved in this invention.

Communication between microprocessor 300 and host computer 310 is done via a serial RS 232 communication path and is interrupt driven as mentioned above. Commands received by microprocessor from the host computer either set the value of some variable or flag in the microprocessor controller or cause some variable or flag to be read and sent back to the host.

SYSTEM OPERATION (FIGS. 19–42)

Operation of the system or apparatus of this invention is set up and controlled by the computer using a plurality of menu screens and program modules.

The Main Menu Screen

After loading of the program, the first screen that appears is the Main Menu Screen which provides access to the major program modules in the host computer system. Table I gives an example of a Main Menu screen and the program modules that can be accessed therefrom.

TABLE I.

Main Menu Selection

1: Patient Data Entry
2: Setup Test Parameters
3: Run Test or Display Results
4: Save or Load Results
5: Configure Defaults
6: Quit Selection of a program module to run is done either by entering the number of the selected module and striking the ENTER key or positioning the cursor on the screen on the line of that selected module and hitting the ENTER key.

The Patient Data Entry module contains program facilities for entering specific patient data to be used in building a patient record in the test data base.

The Setup Test Parameters module permits selection of the test to perform and entry of certain test parameters and information.

The Run Test or Display Results module provides command input facilities to command actual running of a test as well as providing biofeedback screen displays during the performance of exercise and displaying and printing of test results after the test has been completed.

The Save or Load Results module provides facilities for storing the test results on a data disk and for recalling prior test results from a data disk for display or printing.

The Configure Defaults module provides program facilities for saving to disk configurations of test parameters that have been previously set up using the Setup Test Parameters module.

Figure 19:
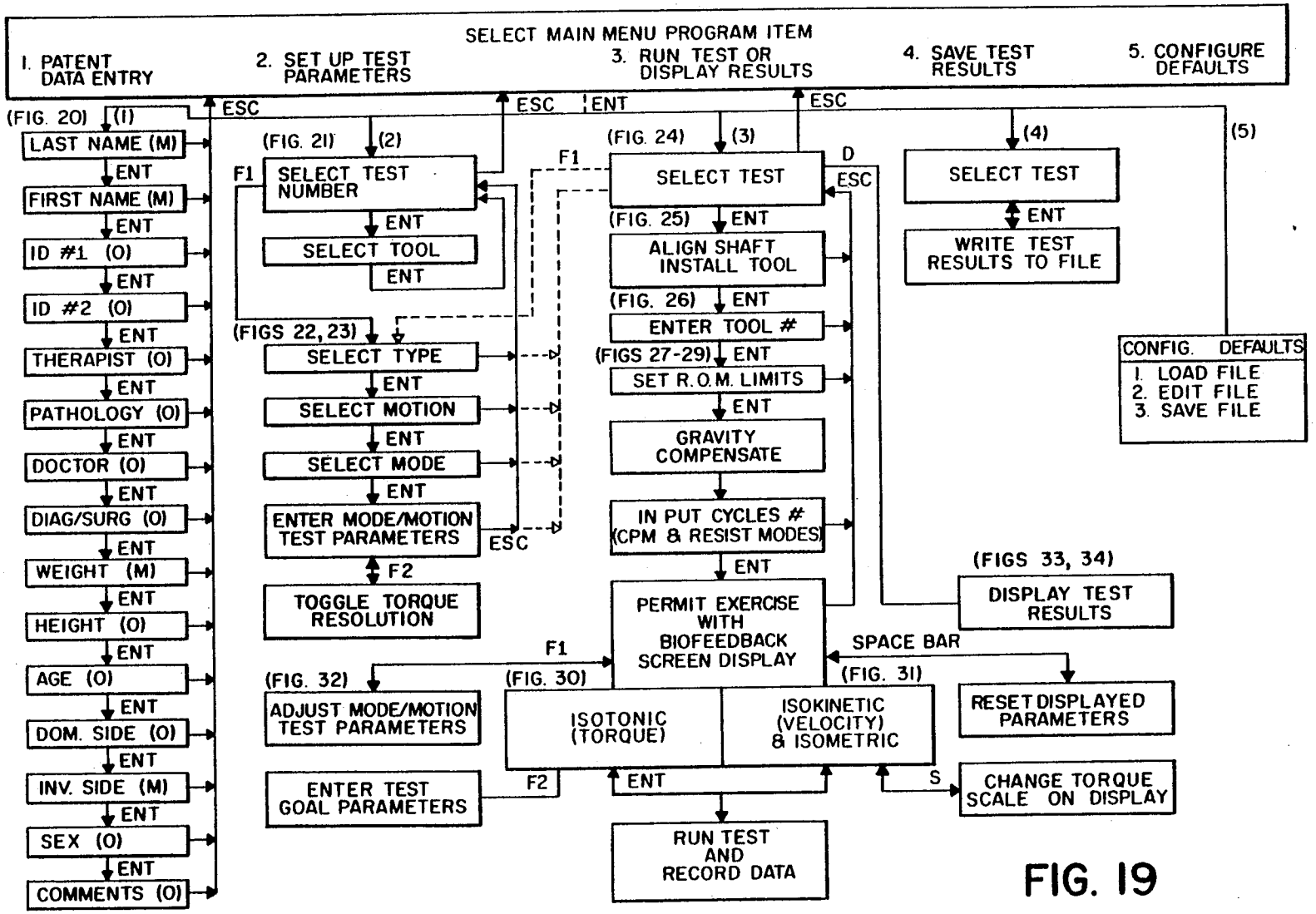
FIG. 19 is a diagram of the operation of an application program interface for programming a muscle exercise and diagnostic apparatus in accordance with this invention.

FIG. 19 illustrates the basic flow of the operating program modules accessible from the Main Menu Screen. The underlying programming for such operating programs is readily apparent to persons of ordinary skill in the computer programming arts from this diagram and accompanying discussion and need not be discussed in further detail.

The Patient Data Entry Module

FIG. 20 illustrates a typical Patient Data Entry screen that may be employed with this module. Entry of the patient data is guided by the combination of a blinking cursor and a highlighted active data field on the screen which indicates the information to be entered and the length of the data field that can be entered. Most of the information on this screen is self-explanatory. The "DOM SIDE" field is for entry of information on whether the patient is right or left handed. The "INV SIDE" field is for entry of whether the right or left side of the patient is involved in the test.

This module does not require entry of all of the information requested on the screen, but complete data analysis and storage requires the entry of name, weight, and involved side. Optional fields are identified on FIG. 19 with the designation (O) and mandatory fields are designated (M). After entry of the patient information in mandatory fields, hitting the ESC key returns the program to the Main Menu display. This Patient Data Entry module needs only be selected and implemented when a new patient is being logged into the data base. one a test on a patient has been saved into the data base, the patient data can be recalled for subsequent tests using the Save or Load Results module accessed from the Main Menu screen.

The Setup Test Parameters Module

This module of the program presents a sequence of menu screens that are used to setup one or a plurality of tests to run on a patient. As illustrated in FIG. 21, this embodiment of the invention includes a TOOL SELECT MENU which provides a facility for setting up four separate tests to run on a particular patient. Each of these four tests can utilize either the same tool or a different tool. For example, it might be desired to set up a patient test protocol in which the same tool is used in four different tests, but each of the tests utilizes a different exercise/diagnostic mode or the same mode but with different test parameters. Alternatively, different tools might be selected for each test. FIG. 21 displays the names of the different tools that are available for use in testing.

Referring to FIG. 19 in conjunction with FIG. 21, to perform tool selection with this menu, the first step is to select one of the test numbers using the cursor positioning keys until the desired test number field is highlighted and then pressing the ENTER key. The highlighted field indicator then moves to the lower window of the screen and the cursor positioning keys are used to move that highlighted window to the particular tool to be used for the selected test number. The ENTER key is again pressed to select the tool and its name will then be presented in the name field under the selected test number and the highlighted window will return to that test field.

Figure 23:
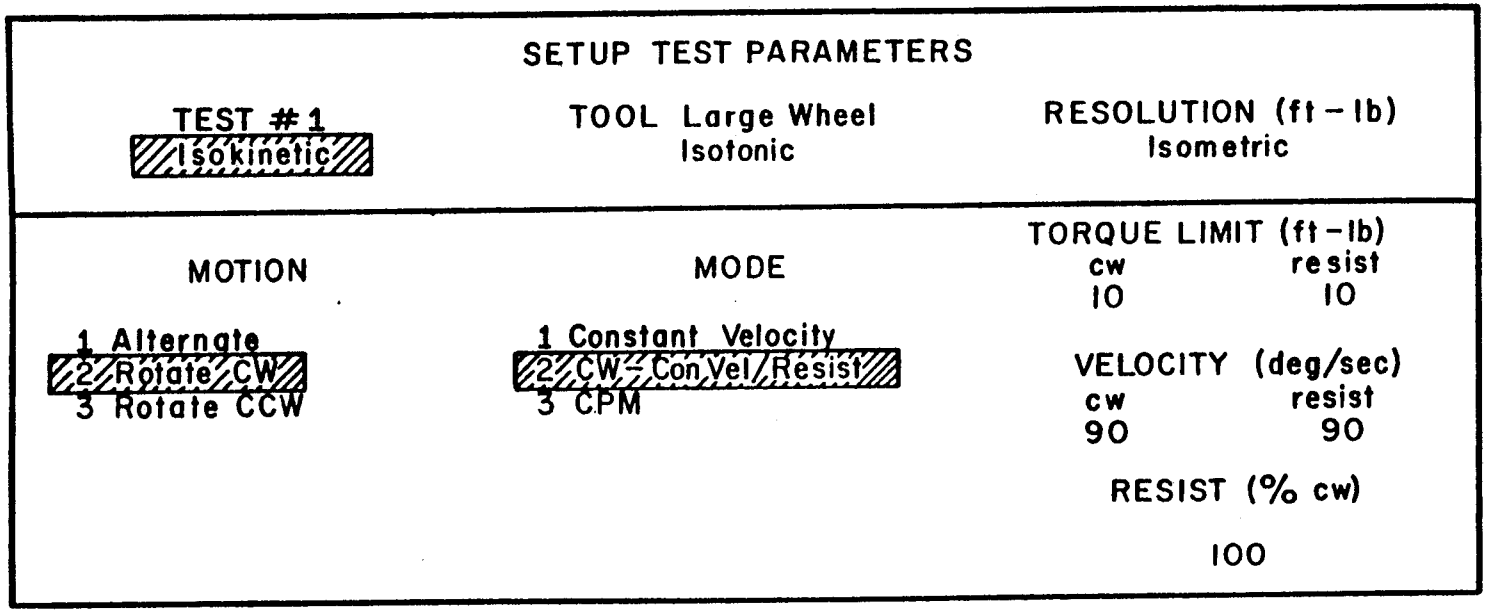

Tool selection may be performed in this manner for all of the test numbers, but it is not necessary for more than one test number and tool selection for that test to be entered with this menu. After tool selection for one or more test numbers has been completed, pressing of function key F1 moves the program to a display of a SET UP TEST PARAMETERS screen, examples of which are shown in FIGS. 22 and 23.

The upper window of the SET UP TEST PARAMETERS screen displays the number of the test being set up, the tool previously selected in the TOOL SELECT menu and the currently selected RESOLUTION on the torque parameter. It also displays three different general types of exercise that can be selected: Isokinetic, Isotonic (Torque), and Isometric. Below the upper window are three parameter selection or parameter entry windows whose contents depend on the exercise type selected. FIG. 22 displays an example of the contents of a parameter selection windows for the Isotonic (Torque) type of exercise. FIG. 23 displays parameter selection windows for the Isokinetic type of exercise. The parameter selection windows for the isometric type of exercise are like the isokinetic type in FIG. 23 except that there is just one Mode: "Isometric", and the parameter selection involves only maximum torque settings which may optionally be entered if the therapist wishes to preclude the patient from exerting more than a certain torque level on the tool. With maximum torque settings in this isometric mode, the system operates like a breakaway mode. The use of these menus and the characteristics of the exercise produced under various set up test conditions will be described in more detail below.

After completing the test set up for one or more tools using this Setup Test Parameters program module, the user "escapes" back to the main menu.

Run Test or Display Results Module (FIGS. 24–34)

Figure 24:
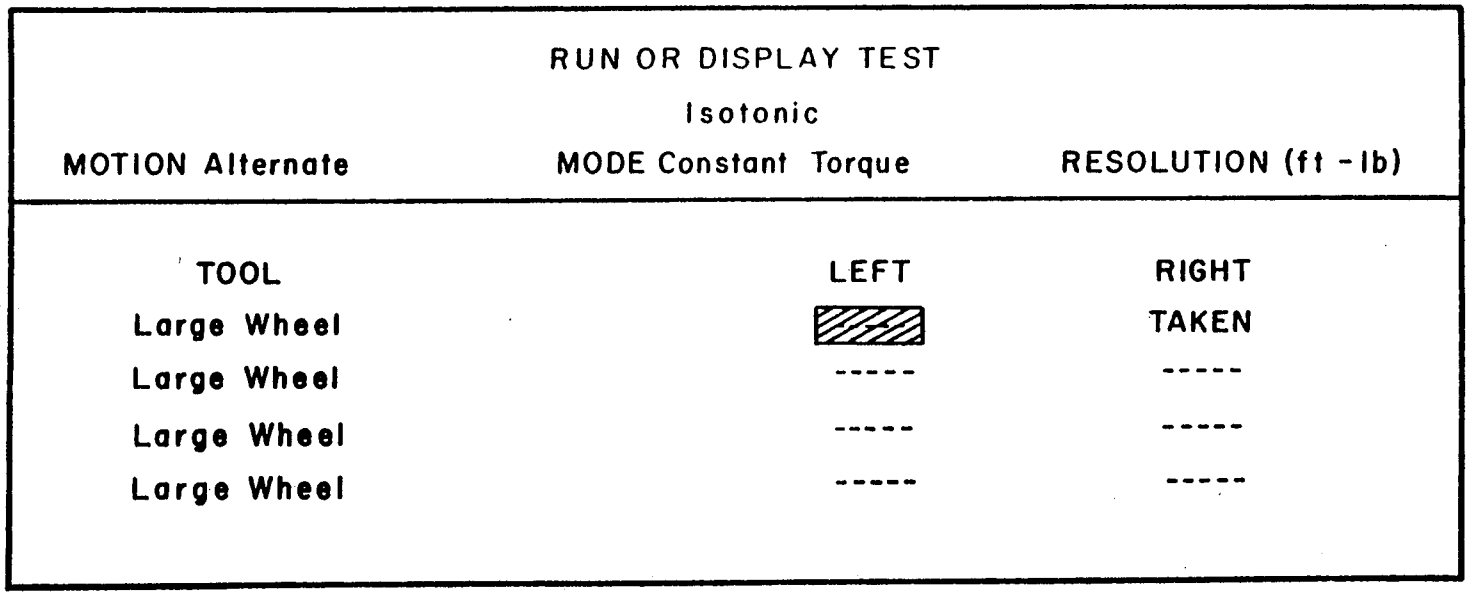

This module is accessed from the Main Menu and presents a screen as shown in FIG. 24. The bottom window lists the tests that have been set up by the name of the tool involved. The LEFT and RIGHT columns adjacent the names of the tools are used to select right or left side of the body to be exercised. The cursor positioning keys are used to move a highlighted window between the eight different tool-side selections available on the lower screen window. The upper window displays basic information on the currently selected test, in this case the information for test number one using the large wheel for Isotonic exercise with Alternate motion and Constant Torque Mode.

If it is desired to check and/or change the exercise parameters for this test, pressing function key F1 returns the program to the Setup Test Parameters menu. If it is desired to run this test, the ENTER key is pressed to advance to the Install Tool screen shown in FIG. 25.

Figure 25:
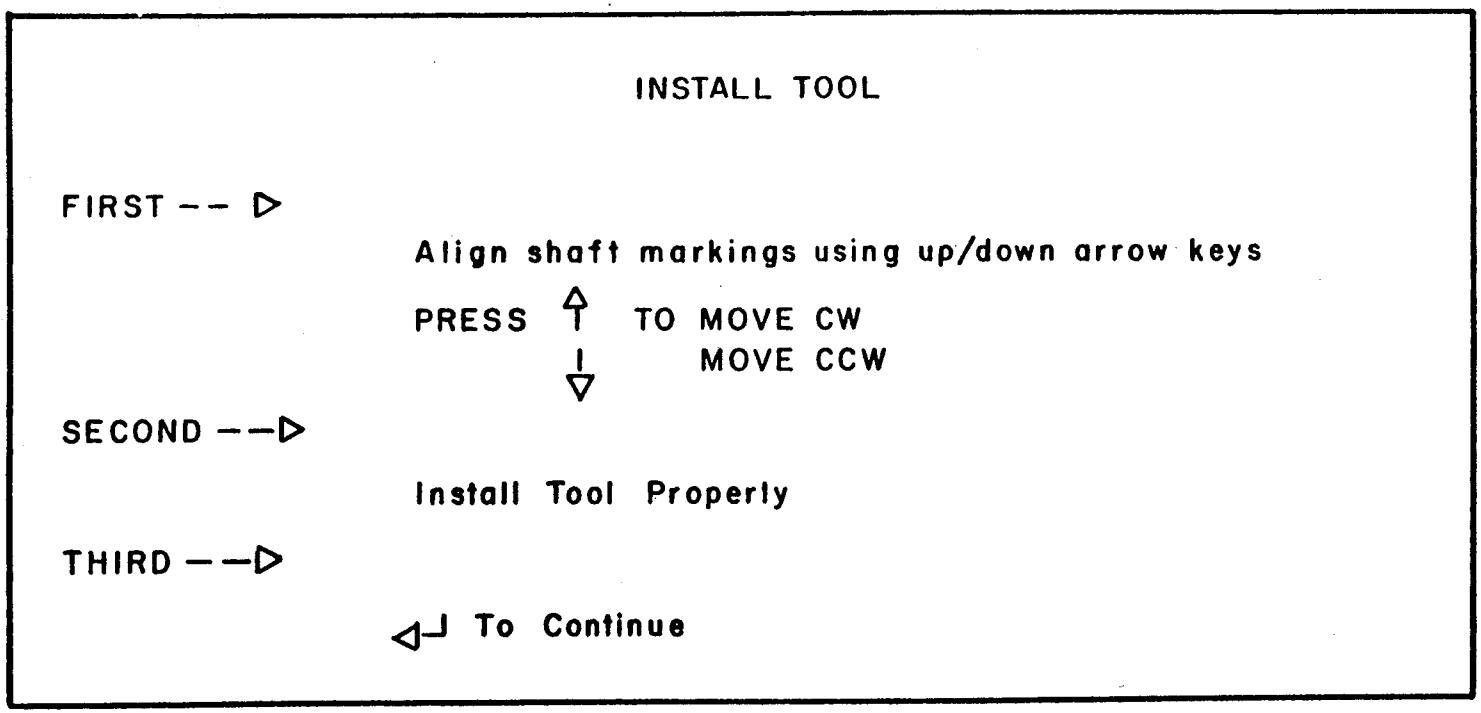

Install Tool Screen (FIG. 25)

This screen gives the basic instructions for installing the tool to be used for the exercise. Installation of a tool on the shaft of the system requires correct alignment of the tool coupler shaft on the tool and the output shaft of power head 11. This is particularly important for tools that have a limited working range of motion defined by mechanical stops on the tool itself. Alignment marks are provided on the rotating shaft and the faceplate of the power head and at this location in the program the up and down cursor positioning keys can be used to rotate the shaft clockwise or counterclockwise to align these marks. With the shaft aligned in this manner, tool installation is facilitated with the moving part of the tool placed in the middle of its working range prior to placing it over the shaft on which it mounts.

After completion of tool installation, the ENTER key is pressed to advance to the ENTER TOOL NUMBER routine which displays the screen shown in FIG. 26. The only activity required here is to enter the tool number of the tool that has been installed on the shaft of the system and press the ENTER key. The therapist is prompted to make sure that the tool number mounted on the power head 11 is the same as the one displayed on the screen. By forcing entry of the tool number on the tool that is mounted on the power head 11, the setup program can check that the tool mounted matches the tool selected for the setup. If the entered number doesn't match the tool selected in the set up program, an error message is displayed advising that either the wrong tool has been mounted or the wrong number entered. The tool actually mounted must be the same as the one selected for the test for the computer system and controller to accurately perform some control routines and data collection and checking routines.

Figure 27:
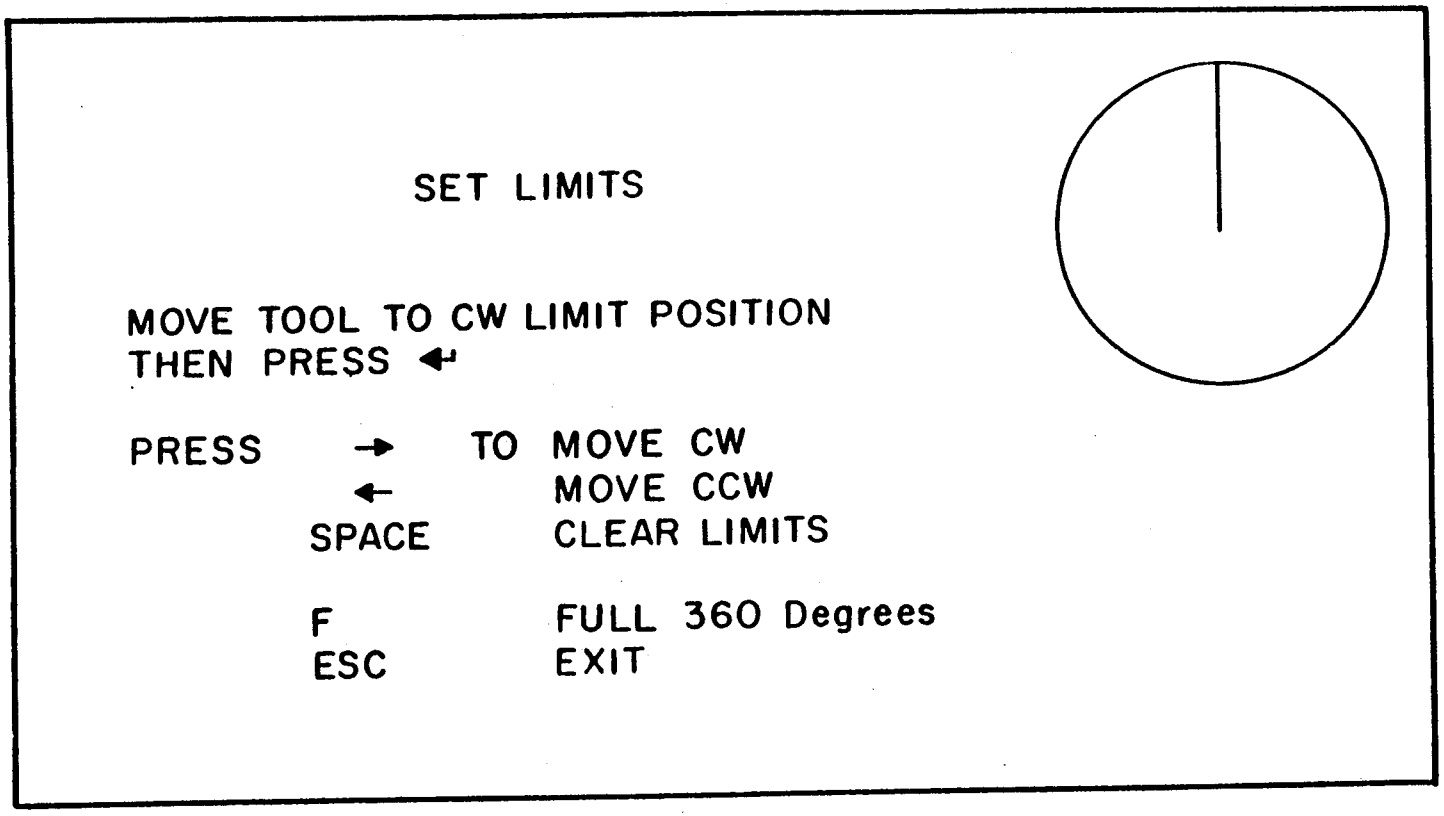
Figure 28:
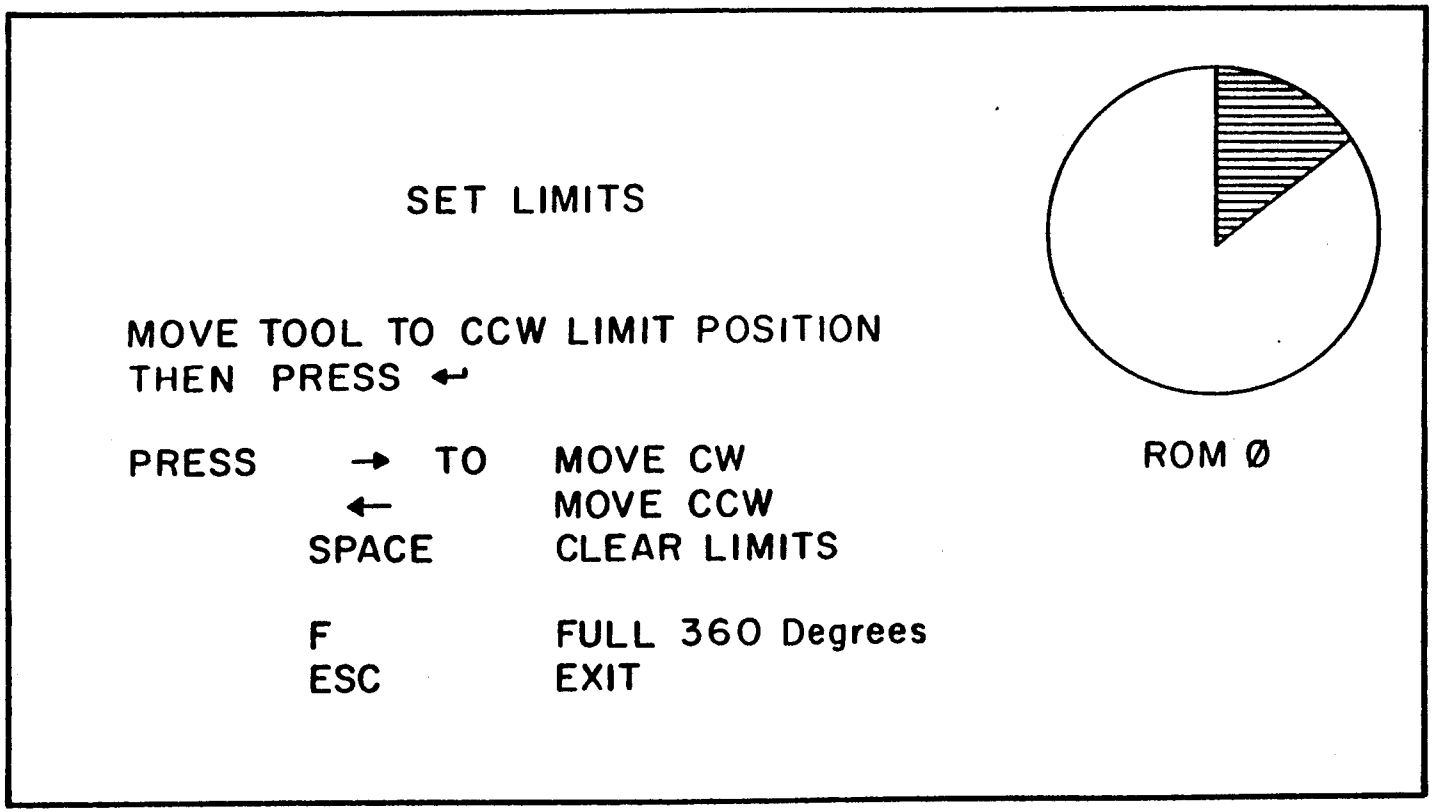
Figure 29:
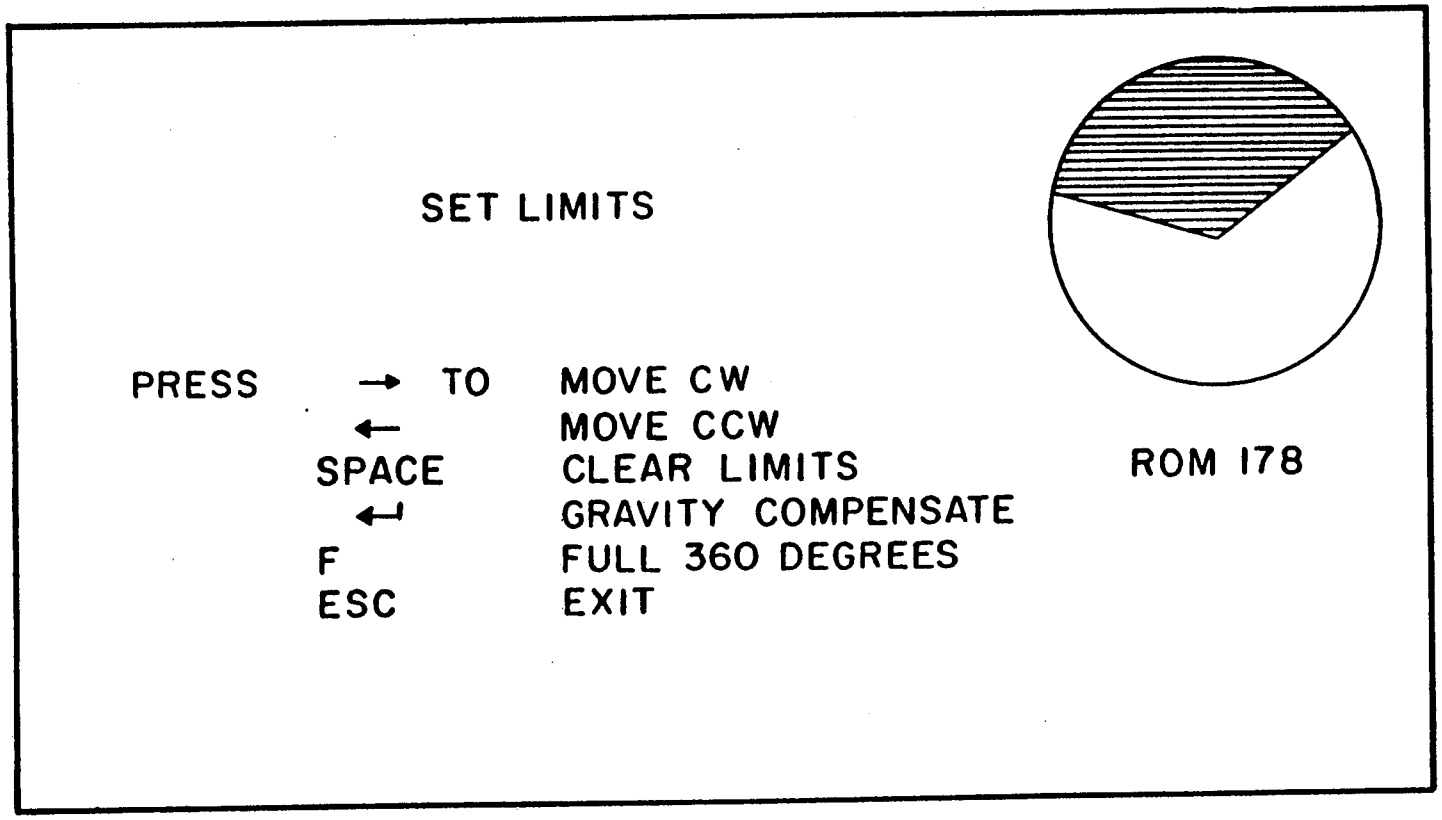

Set Limits Screens (FIGS. 27–29)

After tool number entry, the program steps to the SET LIMITS routine which permit the setting of an active range of motion within the full working range of the tool. The initial screen display is shown in FIG. 27. Tool position is indicated by a line at the zero position on the circular pie display on the screen. This is not the actual tool position, but the relative starting tool position when mounted on power head 11.

If the selected tool is capable of full 360 degree rotation and no limits on rotation are desired, the F key may be pressed to select full rotation as the range of motion permitted. If F is pressed, the program steps directly to the gravity compensation routine discussed below. Alternatively, the program could be arranged to require a pressing of ENTER after F is pressed to step to the gravity compensation routine. This would permit clearing that selection of full rotation and setting a more limited range.

For tools having mechanical stops defining a working range of motion, it is necessary to set an active range of motion within the confines of the full working range of motion of the tool. The following steps are performed to accomplish this range of motion limit setting for rotary motion tools.

a. Setting the CW limit position

As instructed on the screen, the right and left cursor movement keys are used to cause the servo motor to rotate the tool to the desired CW limit position. Then ENTER is pressed to record and store that CW limit value. At this point the screen display is as illustrated in FIG. 28. In this example the tool has been actually moved clockwise about 45 degrees from the initial position, but it should be understood, that for some tools the CW limit position of the tool could be set at a position that is counterclockwise b. Setting the CCW limit position Following the instructions on the screen display shown in FIG. 28, the cursor keys are used to cause the servo motor to move the tool to the CCW position. The ENTER key is then pressed to record that CCW limit position. The screen display then becomes that depicted in FIG. 29. The number of degrees of range of motion is shown both graphically by the pie chart and as a number of degrees.

At this point two limits can be changed by pressing the SPACE bar to clear the limits. This returns the screen to the one shown in FIG. 27 without movement of the tool.

For linear motion tools, the range of motion limit setting routine is very similar. The graphical display is a bar rather than a pie and the instructions on the screen would instruct use of cursor keys to move to a direction A limit position first and then a direction B limit position. These directions are marked on the linear tool so that clockwise rotation of the output shaft of power head 11 moves the linear tool in direction A and counterclockwise rotation moves the linear tool in direction B. The ROM setting displayed is in inches (or other units of length).

Once the range of motion limits have been set by the therapist, the ENTER key is pressed to send the program to the gravity compensation routine. During this routine the computer displays a "HANDS OFF" screen (not shown) to warn against touching the tool and causing false readings of gravity compensation on the tool itself. The microcomputer controller automatically rotates the tool through the programmed range of motion and takes and stores data on torque versus tool position to use later during exercise by the patient. The stored value for each position is then deducted from the torque sensed by strain gauge 161 or 162 during the exercise motion to effect gravity compensation as discussed below. For exercise with joint rotation tools such as the elbow flexion-extension tool, or the wrist tool, the gravity compensation routine could be performed with the patient's limb in position and moved with the tool through the range of motion to record limb weight induced torque along with the tool induced torque at each position.

After the gravity compensation routine has finished running, an INPUT CYCLES screen (not shown) will be displayed only if a rotary tool is used for the active test, the range of motion is set at a full rotation, and a resist mode, such as CW ConTor/Resist, of the system has been selected for one direction of motion. This permits the therapist to set, for example, three full rotations of a wheel as the range of motion to be traversed by the patient before the eccentric return movement of the tool is performed.

Figure 30:
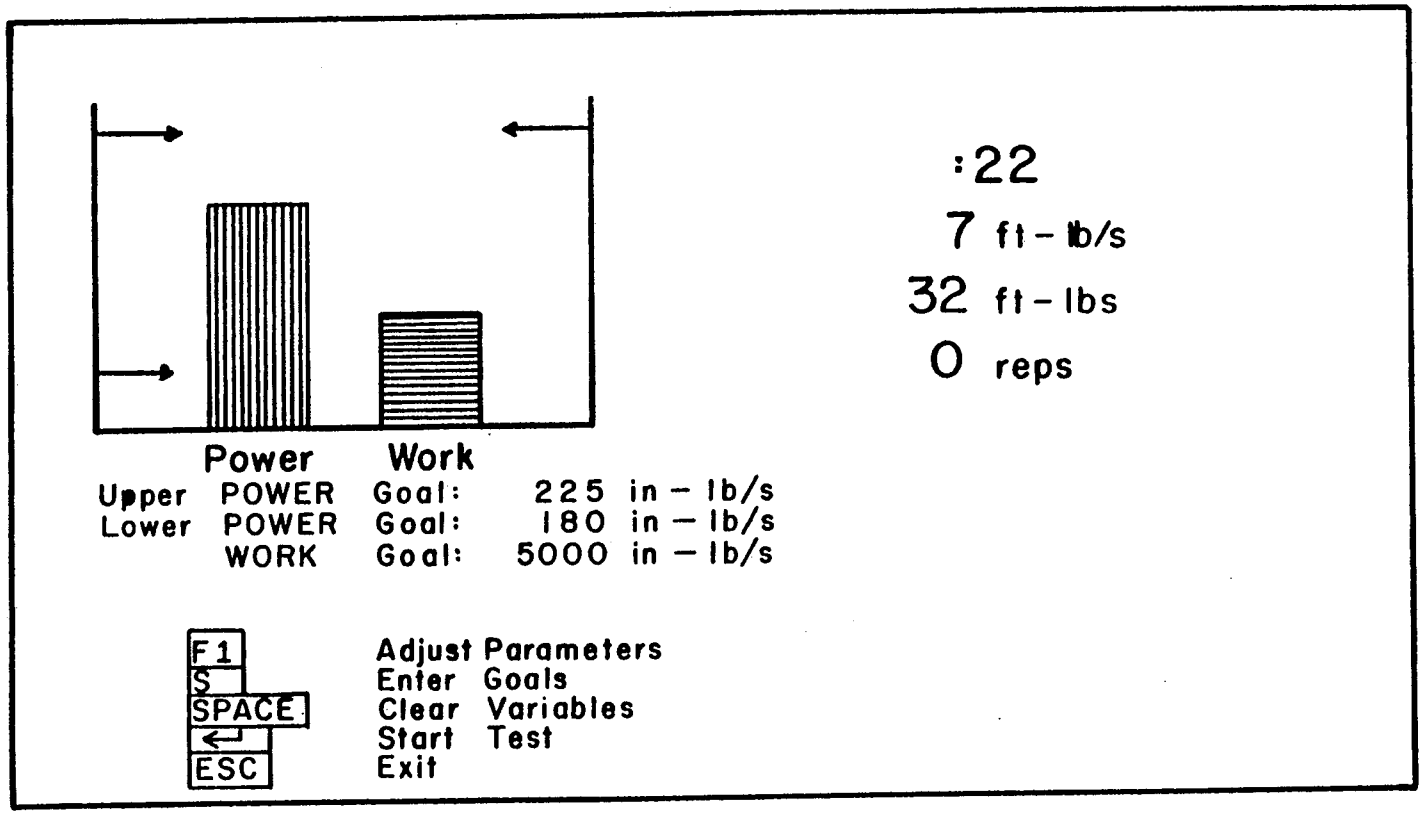
Figure 31:
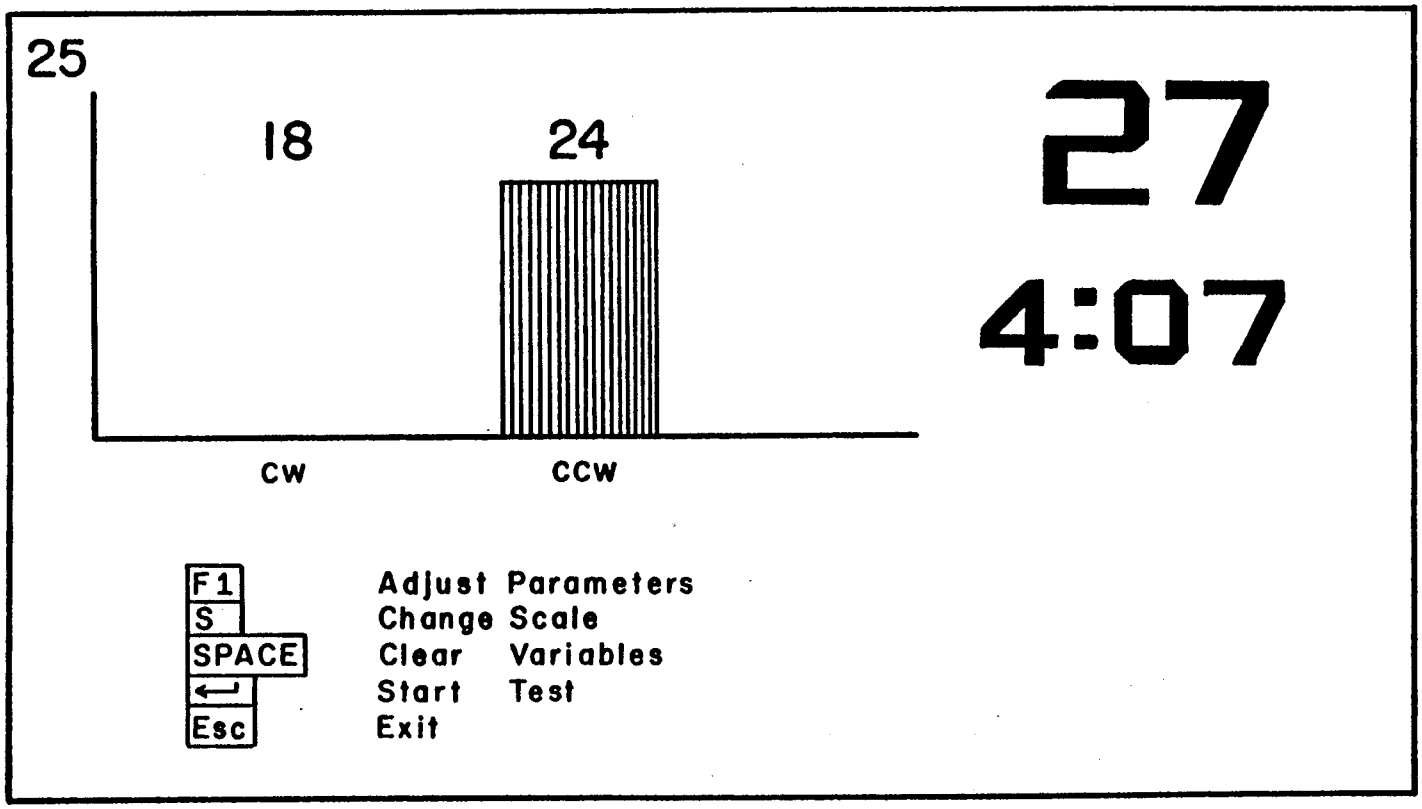

Next a biofeedback screen will be presented with the content of the screen dependent on the type of exercise selected. An example of a biofeedback screen for Isotonic (Torque) Exercise is shown in FIG. 30 and an example of a biofeedback screen for Isokinetic Exercise is shown in FIG. 31. The biofeedback screen for Isometric exercise is essentially the same as that shown in FIG. 31, and the bar graph displays torque in the direction applied. The number over the bar in this case is the peak torque on that Repetition of the exercise.

Isotonic (Torque) Biofeedback Screen

As shown in FIG. 30, the upper left portion of this screen display is two bar graphs labelled POWER and WORK. The POWER graph displays the current rate at which the patient is exercising in either inch-ounces/per second, inch-pounds per second or foot-pounds per second depending on the previously selected torque resolution. The WORK graph displays the accumulated work done during the exercise bout.

Below the two bar graphs is a three line display of UPPER POWER GOAL, LOWER POWER GOAL, and WORK GOAL. The upper and lower arrows adjacent to the POWER bar graph correspond to the values of the UPPER POWER GOAL and the LOWER POWER GOAL and indicate to the patient the range of work rate that the therapist desires for this exercise bout. The arrow to the right of the WORK bar graph corresponds to the value of the WORK GOAL. If a work goal has been set, the system will stop the exercise bout when that work goal has been achieved by the patient.

The system does not force the patient to work in the power range indicated on the biofeedback screen. The power goal display provides visual feedback to the patient of what is the goal set by the therapist, but the patient is free to attempt to achieve or to ignore the set goal. As will be seen later, the report displayed and printed on this type of exercise includes "Average Power" and "Percent of Power Goal" so the therapist will have a record of the patient's performance during the exercise bout or test.

To the right of the bar graphs is a display of the elapsed time of the exercise bout on the top line, the numerical value of the current power or work rate on the next line down, the numerical value of the accumulated work done on the next line down and the number of repetitions of the exercise motion on the next line.

Figure 32:
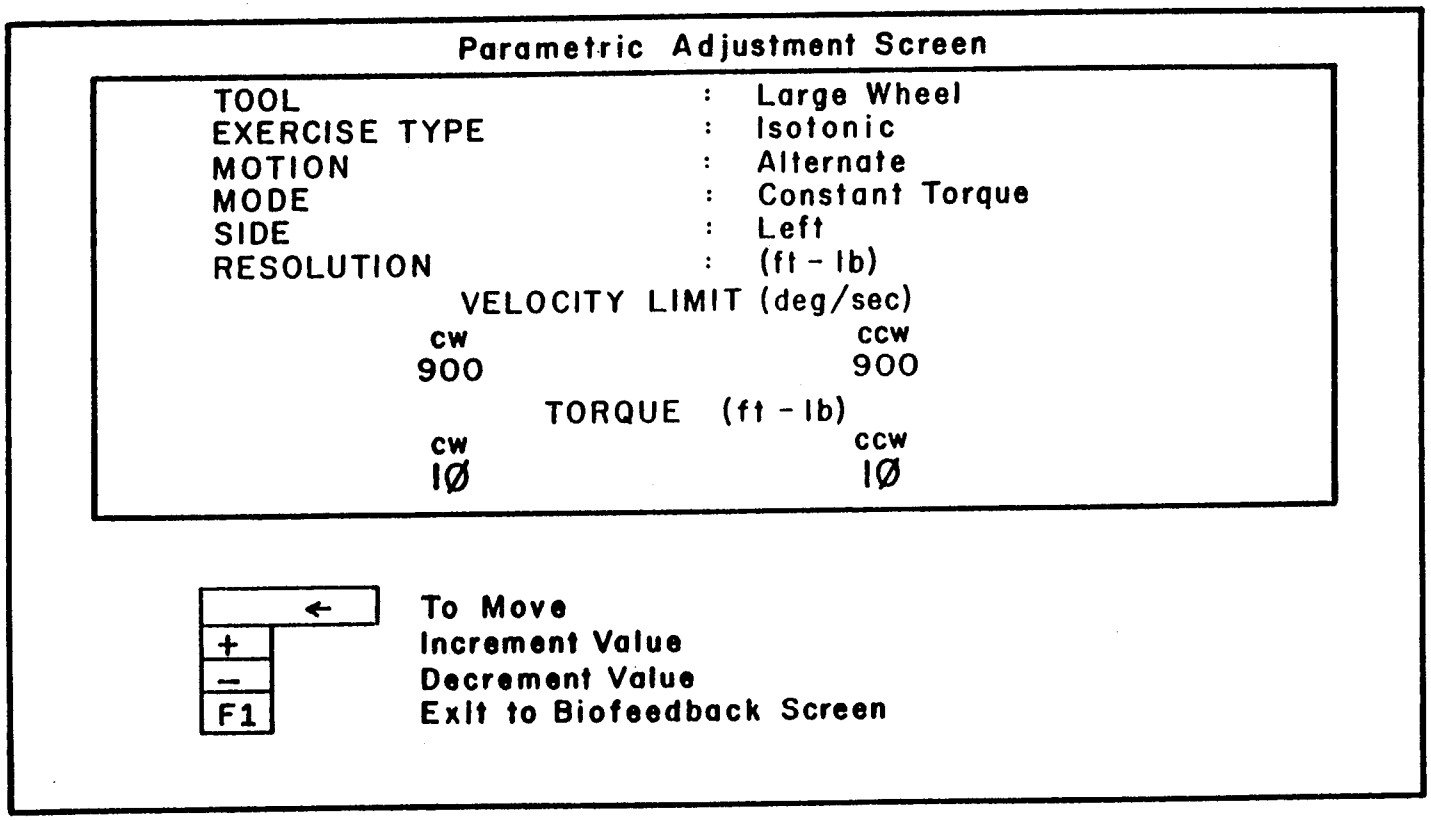

Below the three lines that display the power and work goals, four optional functions are indicated. Pressing function key F1 produces a display of an Adjust Parameters Screen as shown in FIG. 32. The purpose of this routine will be discussed below. Pressing Function key F2 enables a routine for entering the power and work goal values. Pressing the space bar clears the display of the exercise variables to the right of the bar graphs. Pressing the ENTER key clears the variables to zero and starts the testing and data accumulation. It should be understood that the patient can exercise on the system at any time that the biofeedback screen is presented, but test data will not be accumulated until the ENTER key is pressed.

To run an actual test, the ENTER key is depressed and the patient starts the prescribed exercise bout, using the biofeedback screen as an aid to correct performance of the exercise. Data is taken and the exercise continues until the work goal is reached or the therapist presses the ENTER key a second time to stop data collection. If the therapist stops the test prior to achieving the work goal, pressing the ESC key returns the program to the RUN OR DISPLAY TEST screen shown in FIG. 24 so that the data can be cleared or displayed. If the test stops because the patient achieved the work goal, the program automatically returns to the RUN OR DISPLAY TEST SCREEN. (These are merely examples of one program control approach and it should be obvious that alternative approaches could also be implemented.)

Since the test has been completed, the word "TAKEN" will appear at the test location at this time. At this point, the therapist has the option of saving the data to disk or deleting the data and then selecting the same test to run a second time. If the therapist selects the same test for running, a screen prompt is presented that asks if the current data should be deleted. The therapist can select the next test to run without saving the data from the prior test. Up to eight different tests can be run before data must be saved or deleted to continue running tests.

Isometric/Isokinetic Biofeedback Screen (FIG. 31)

As shown in FIG. 31, this screen dynamically displays a bar graph above one of the labels "CW" and "CCW" (in this case) to show the current value of the torque exerted on the shaft by the patient in the current direction of movement of the tool. In other words, the height of the bar increases with increasing torque values giving the patient biofeedback on exercise performance. Although this biofeedback screen does not involve any goal setting by the therapist and no torque goal arrows are shown, it should be apparent that the system could be programmed to permit entry of torque goals and to show torque goal arrows on the biofeedback screen for each direction of movement.

In the case of joint exercise tools, the bar graph labels are FLEX and EXT (or other appropriate abbreviation for the exercise movements being done with the tool). For the linear motion tool, the graph is labelled DIR A and DIR B and for other types of tools the screen labels are changed to be pertinent to the motions involved.

For isometric exercise the numbers above the dynamic bar graph displays are the peak torque on that "repetition" of the exercise. For isokinetic exercise, the numbers above the bars indicate either the maximum torque achieved on the last repetition (when data is not being collected) or the maximum torque achieved during the entire exercise bout (when data is being collected). To the right of the bar graphs are two number displays, the top being the number of repetitions of the exercise already performed, the bottom being the elapsed exercise time. The Torque scale on the Y-axis of the bar graphs is initially set at 25 foot-pounds or whatever scale has been toggled to by the therapist using the S key as noted in the menu under the display.

This scale will change automatically to a higher scale value if one of the actual exercise torque values exceeds this value.

Below the bar graph display four optional functions are indicated Pressing the F1 function key causes a display of the Adjust Parameter screen shown in FIG. 32 and discussed below. Pressing S changes the torque scale on the Y-axis of the bar graph above. Pressing the Space bar resets the displayed variables to zero. Pressing the ENTER key starts the test and data collection. A second press of the ENTER key stops the test.

Adjust Parameters Screen (FIG. 32)

This screen is depicted in FIG. 32. It is accessible from either of the two biofeedback screens discussed above by pressing the F1 function key. The values on the screen and the meaning of the values are dependent on the type and made of exercise corresponding to the particular test. This screen permits changes to be made in velocity and torque limit settings originally selected during the test set up procedure.

In one program configuration, only the primary exercise values are allowed to be changed using this screen and the underlying program routine, i.e. torque values for isotonic exercise and velocity values for isokinetic exercise. In addition, the values are incremented and decremented, not changed by entry of new number. The right and left cursor arrows toggle a cursor between the two fields that can be altered. Then the + and − keys may be pressed to increase or decrease the values. During this process of changing values, the therapist can have the patient exercising with the tool and can thus be making a live assessment of the effectiveness of the settings for that patient.

Displaying Test Results (FIGS. 33 and 34)

Referring back to the RUN OR DISPLAY TEST screen shown in FIG. 24, the data from a test that is shown to be "TAKEN" can be displayed on the computer screen by positioning the cursor window at that test location and then pressing the D key to display the data. FIG. 33 illustrates a test data display for an Isotonic (Torque) type of exercise. FIG. 34 illustrates a test data display for an Isokinetic type of exercise. The data on these reports is basically self explanatory except for the Fatigue Index.

For Isotonic exercise, the fatigue index is a measure of the decline in power output of the patient during the course of the exercise bout. An average power output for each exercise repetition is stored during exercise activity. A relationship between power output and repetition number is established by fitting a straight line to these data points using a statistical technique. The equation for this line is used to calculate the power output at the beginning and at the end of the exercise period. The fatigue index is the ending power output divided by the beginning power output multiplied by 100.

For Isokinetic exercise, the fatigue index is a measure of the decline in work done for each repetition during the course of the exercise bout. An average work value for each repetition is stored during the duration of the activity. A relationship between work and repetition number is established by fitting a straight line to these data points using a statistical technique. The equation for this line is used to calculate the work for a repetition at the beginning and at the end of the exercise period. The fatigue index is the ending work per repetition value divided by the beginning value times 100.

For Isometric exercise, the fatigue index is a measure of the decline in the peak torque achieved for each repetition during the course of the exercise bout. A peak torque for each repetition is stored during the activity. A relationship between peak torque and repetition number is established by fitting a straight line to these data points using a statistical technique. The equation for this line is used to calculate the peak torque for a repetition at the beginning and at the end of the exercise period. The fatigue index is the ending peak torque value divided by the beginning value times 100.

Once a display of test data is on the computer screen, it can be printed by pressing the PrtSc key on the keyboard.

Save or Load Results Routine (FIGS. 35 and 36)

When this routine is accessed from the Main Menu shown in Table I, the screen display depicted in FIG. 35 is provided. The tests for which data has been taken will be identified by the "TAKEN" label corresponding to the test. Test results are temporarily stored on the disk that contains the master program, either a hard disk on which the master program is permanently stored or on a floppy disk entered into main floppy drive of the computer. To save these test results, the cursor window is positioned at the test position to be saved and the S key is pressed to initiate the save routine. An insert box will be displayed at the bottom of the screen, indicating the test about to be saved and requesting confirmation that saving should continue. Depressing the Y key continues the saving operation, writing the data to the data disk or file and removing it from temporary storage in the master program file location.

To load a previously stored test, the L key is depressed to bring up an insert box which asks for selection of one of two load options: 1. patient parameters only; or 2. patient parameters and prior test data. Option 1 is selected when the therapist is retesting a patient and avoids the need for reentering patient data. Option 2 is selected when prior stored test results for one or more patients are to be loaded for review and/or printing.

After selection of one of the options, the insert box will query for the last name of the patient and then the date of the test as shown in FIG. 36. Entering a full last name and test date will load and display only the test data for that patient on that date. If that is the test wanted, pressing the space bar will load it into temporary memory for use. If it is not, the following tests for that same patient can be scanned one at a time by pressing the ENTER key.

Other data loading options involve scanning the entire data base in alphabetical order by patient last name or scanning the data base for all patients whose last names begin with a particular letter. The first option is accessed by pressing the ENTER key instead of entering a patient name and date. This will start a scanning through patients and tests in alphabetical/date order. The second option is accessed by entering the letter of the alphabet and hitting the ENTER key.

Having considered the entire sequence of test setup, test running and test data saving, the details of parameter set up for different types of exercise will now be discussed.

Isotonic (Torque) Exercise

This exercise type offers the greatest opportunity to mimic real world work related tasks and represents the most significant improvement over work simulation systems that are limited to constant preselected resistance values. There are some work tasks that involve either isokinetic or straight isotonic (constant torque) operation. There are more tasks where the resisting torque varies with the position of the tool or the cycles of rotation of the tool.

For example, the closure of a multiturn valve on a pipeline involves a certain starting resistance value with a build up in resistance as the valve nears the fully closed position. Torque wrenches, e.g. wrenches for tightening lug nuts on automobile tire rims or head bolts on automobile engines, are another example of a work task that encounters variable resistance on the tool. Loosening nuts or opening valves often involves encountering a breakaway torque situation, i.e. one in which the initial threshold torque required to set the tool in motion is high and then the torque resistance declines to a lower value.

Referring first to FIG. 22, the set up of parameters for Isotonic (Torque) Exercise will now be described. Note that there are three parameter selection windows. The bottom left window is used to select the exercise motion from the choices shown. Available choices for the mode of exercise are displayed in the bottom center window and the bottom right window contains fields for entry of torque, velocity and cycles parameters. The center window display varies with the MOTION selected and the right window display varies with the MODE selected.

Referring to the bottom left window, the three choices displayed for MOTION relate to the rotary tools, e.g. the large wheel shown selected for this test in the upper window. The MOTION choices depend on the tool selected for the test. For reciprocating tools such as the linear motion device shown in FIGS. 12 and 13, the choices under MOTION are push, pull, and alternate or DIR A, DIR B, and ALTERNATE. For joint exercise devices, the selections are Flexion, Extension and Alternate for the elbow. For the shoulder, depending on the tool selected, there are three different sets of motions.

Referring to the bottom center window, the choices of MODE depend on the type of exercise and the MOTION selected and the available choices displayed are those available for the currently selected motion. In other words, not all MODES are available with all motions. All six of the MOTIONS shown in FIG. 22 are available with the Rotate CW, Rotate (CCW), flexion, extension, adduction, abduction, internal rotation, external rotation, push and pull. When alternate is selected, only the first four MODES are displayed as available for selection. These different motions will be discussed in more detail below.

Referring to the bottom right window, the parameters to be set vary with the MODE selected. For example, in the Constant Torque mode, a single torque value is set along with the velocity limit and there is no cycles parameter to be set.

Alternate—Constant Torque

In this motion-mode combination, the tool can be moved in either direction with an allowed shaft torque which is maintained at a constant level by increasing or decreasing motor speed as needed. A single torque value is set as the allowed shaft torque level and a velocity limit may also be set. The tool does not move until the recorded torque value on the shaft is greater than or equal to the set torque level. Thereafter, the tool can be accelerated to increased velocity values at the allowed shaft torque level up to the value of the velocity limit, at which point the mode switches to isokinetic mode and the allowed shaft torque changes to prevent any further acceleration of the tool. If ROM limits are set, the tool will be decelerated to stop at the position of the set limit in the direction of movement and further movement requires the patient to reverse the direction of application of torque.

Rotate CW—Constant Torque

In this motion-mode combination, the tool moves in the clockwise direction against an allowed shaft torque which is maintained at a constant level by increasing or decreasing motor speed as needed. If the range of motion set is a full rotation of the tool, the tool can only be moved in the cw direction. If a smaller Range of motion is set, the tool is permitted to ratchet at low torque in the CCW direction at any point in the working range of motion set. If a velocity limit is set for this exercise, it operates in the same manner as in the Alternate-Constant Torque motion-mode combination.

Rotate CCW—Constant Toque

This motion-mode combination is the same as the one for clockwise rotation but the direction of motion with resisting torque and the direction of ratcheting is reversed.

Rotate CW—Ramp Up

Figure 37:
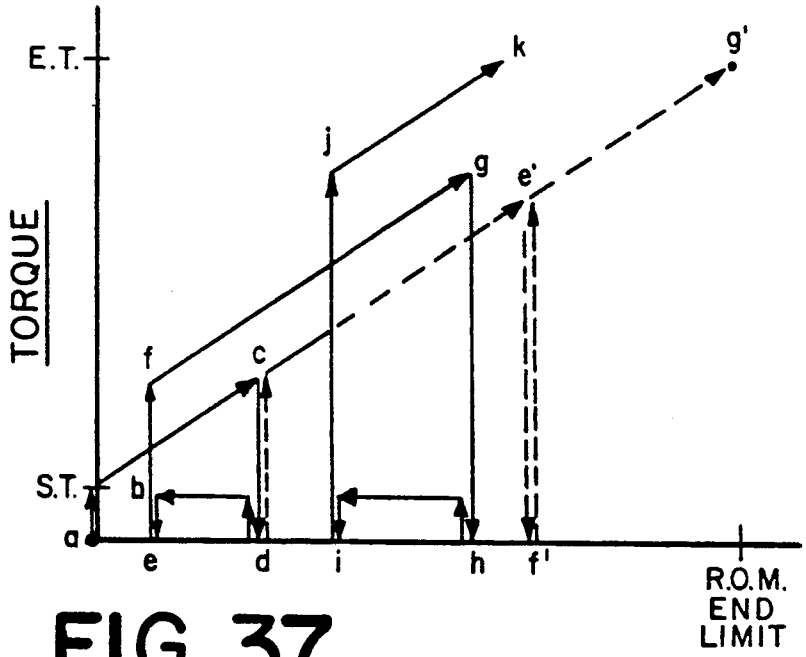
FIGS. 37-40 are torque versus position curves useful in explaining the operation of certain features of muscle exercise and diagnostic apparatus in accordance with this invention.
Figure 38:
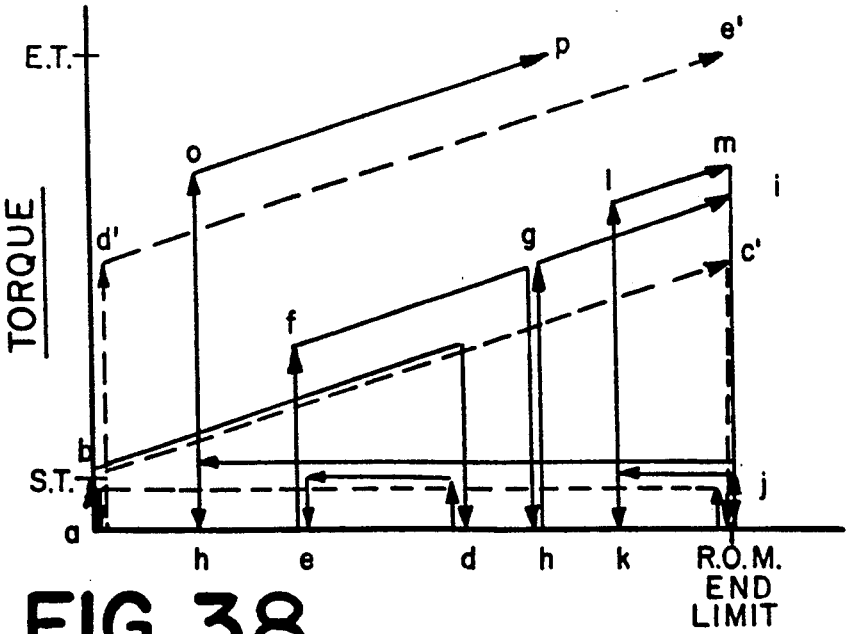

This motion-mode combination is illustrated in FIGS. 37 and 38. For this mode, starting torque and ending torque must be set as well as the number of cycles. FIG. 37 illustrates a one cycle Ramp Up and FIG. 38 illustrates a two cycle Ramp Up. If the range of motion is set at a full rotation, the tool is permitted to rotate in one direction only throughout the number of cycles selected. If the range of motion is set less than a full rotation, then the tool can ratchet in the opposite direction at low torque. If the range of motion is less than a full rotation, then the tool must ratchet back at some point to complete the second cycle. The rate of change of the allowed shaft torque level with change of position of the tool in the direction of increased resistance is dependent on the difference between the starting torque and the ending torque and the number of cycles. This is illustrated in the difference in slope of the torque vs. position curve between FIG. 37 and FIG. 38.

One Cycle (FIG. 37)

FIG. 37 illustrates both unidirectional movement of the tool between start and end positions and ratcheting of the tool. It should be understood that the tool can start in any location within the working range of motion and need not start at a ROM limit point. Two different position versus torque paths are shown in FIG. 37. The one moving along path a-b-c-e'-g' involves unidirectional movement without ratcheting. This path is mandatory where the working range of motion is a full revolution. The one moving along path a-b-c-d-e-f-g-h-i-j-k involves two ratchet back movements which is only permitted when the range of motion is less than a full revolution. The number of ratchet back movements is strictly up to the patient under circumstances where ratcheting is permitted.

Two Cycles (FIG. 38)

FIG. 38 illustrates a two cycle ramp up. In this case it is assumed that the range of motion is less than a full rotation and at least one ratcheting back is required to complete the two cycles in the ramp. If a full rotation range of motion were programmed, the tool would simply complete two rotations with torque Ramp Up throughout the two rotations. After the two cycles, the values are reset by a slight reverse torque so that multiple repetitions of the exercise motion can be completed.

The path a-b-c'-j-a-d'-e' is a straight two cycle path with a single ratchet back to the starting point. The more complicated path involves a first cycle along the path a-b-c-d-e-f-g and a second cycle along the path g-h-i-j-k-l-m-n-o-p.

In this embodiment, the slope of the torque Ramp Up with position is the same for all of the cycles. It should be apparent, however, that it would also be possible to design a system in accordance with this invention that permitted the slope to change between cycles. It should also be apparent that combinations of modes could be designed into a system in accordance with this invention. For example, several cycles of constant torque movement might be followed by one or more cycles of ramping movement. Another variation would be to provide several cycles of constant torque with the torque level stepping up or down by a fixed or programmable amount at the end of each cycle.

Rotate CW—Ramp Down

This motion-mode combination is simply the inverse of the Rotate CW—Ramp Up motion-mode combination previously described. The starting torque value is higher than the end torque value and the allowed shaft torque level decreases as the tool is moved in the CW direction of rotation.

Rotate CW—Ramp UP/Down

This motion-mode combination is simply a combination of the Ramp Up and Ramp Down motion-mode combinations. The number of cycles of ramp up and ramp down is the same. It should be understood, however, that a more complex system in accordance with this invention could be provided in which the number of cycles of ramp up and down are different and the start torque and end torque values are different for the Ramp Up and Ramp Down portions of the operating curve.

Rotate CCW—Ramp Up, Ramp Down or Ramp Up/Down

These motion-mode combinations are essentially the same as the Rotate CW motion-mode combinations described above and need not be separately described. The only difference is in the direction of movement of the tool for increasing torque and the direction of ratcheting if permitted.

Figure 39:
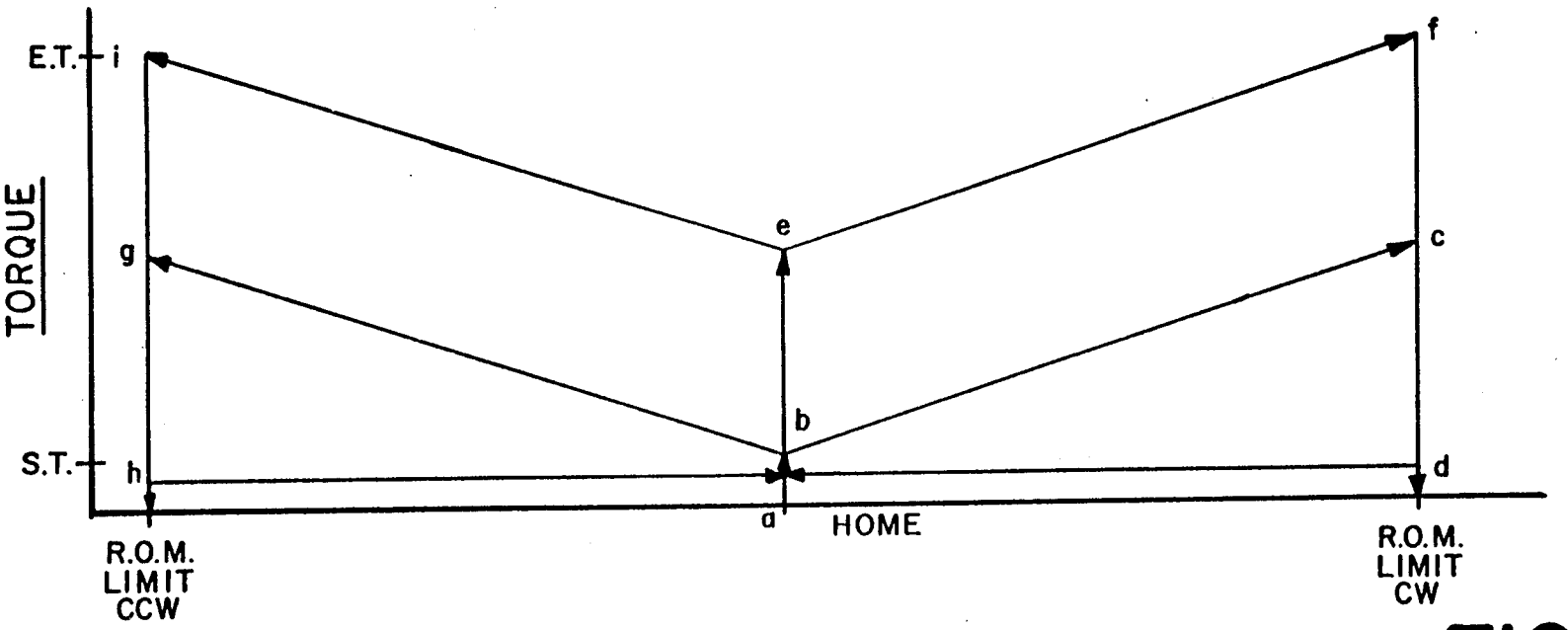

Alternate—Ramp Up (FIG. 39)

FIG. 39 illustrates this motion-mode combination with two cycles and a range of motion less than a full revolution. As programmed the tool begins in the home position half way between the two ROM limit positions. The tool can start in either direction, but must complete the entire set of cycles (two in this case) in that direction and return to the home position before it moves in the other direction and completes the two cycles in that direction. In this case ratcheting is permitted just as in the unidirectional rotation cases discussed above.

If the range of motion programmed were a full revolution, the tool would simply be rotated through two revolutions in one direction with increasing torque and then the patient would not be able to continue in that direction, but must reverse and complete two cycles of revolution in the other direction to complete one repetition of the exercise.

It should be apparent that there are many other programming variations that could be implemented here. For example, both the CW and CCW ramps could be traversed simultaneously instead of forcing one direction to be completed first. The CW and CCW torque vs. position ramps could have different slopes and the number of cycles for each direction might be allowed to be different.

Alternate—Ramp Down

This motion-mode combination is essentially the inverse of the Ramp Up mode and need not be described in detail here.

Figure 40:
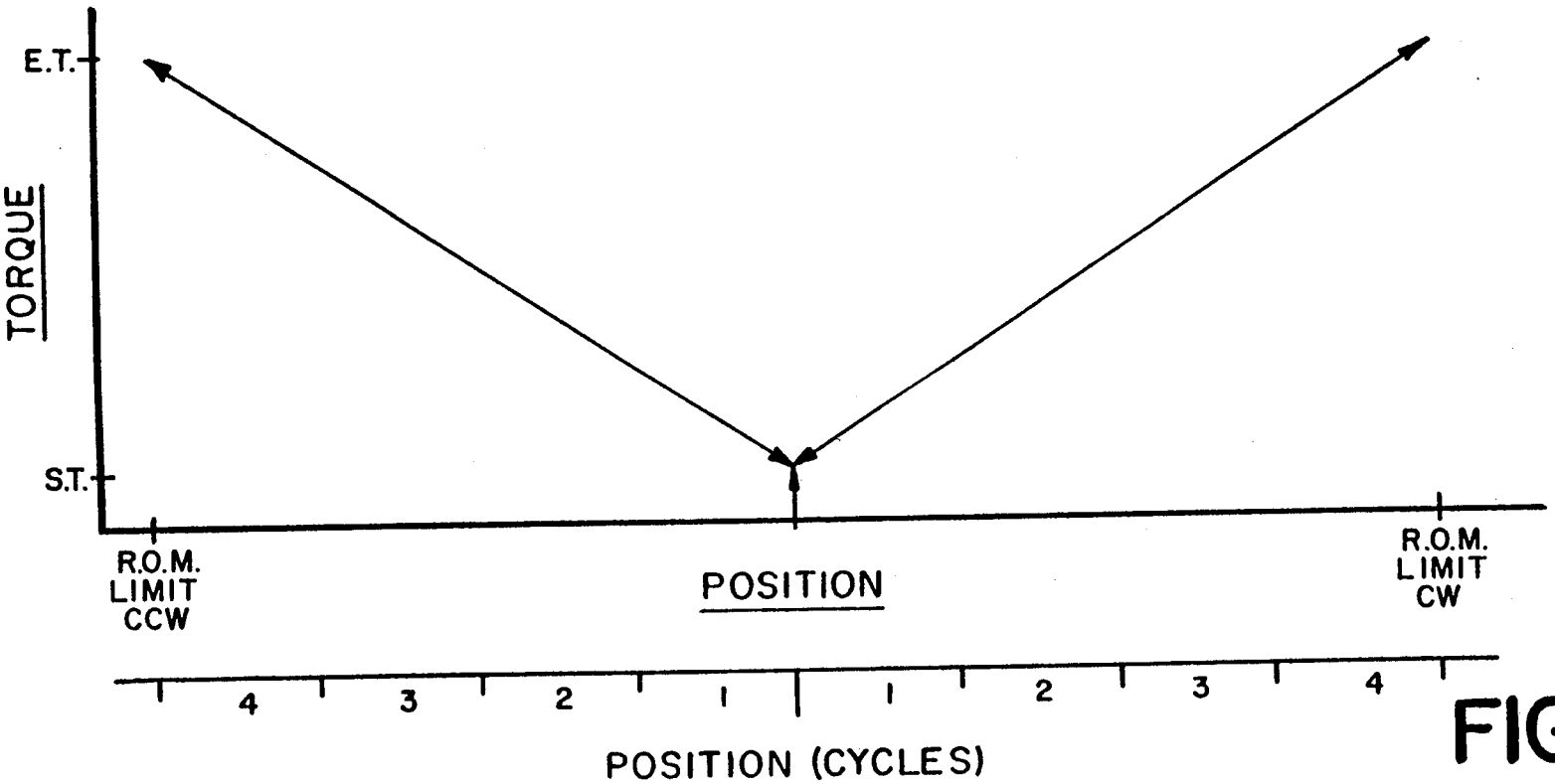

Alternate—Ramp UP/Down (FIG. 40)

FIG. 40 illustrates one version of this motion-mode combination which has different characteristics depending on whether the range of motion is a full rotation or less than a full rotation. If the range of motion is less than a full rotation, there is only one cycle of up and down ramping possible between the start and end torque values because no low torque ratcheting is permitted. Instead, there is a strict one to one correspondence between the position and the allowed shaft torque value so that moving from the home position toward the clockwise ROM limit results in an increase in the allowed shaft torque level while moving counterclockwise back toward the home position results in a decrease in the allowed shaft torque level. If the counterclockwise movement is continued past the home position toward the counterclockwise ROM limit, the allowed shaft torque level starts increasing again. Thus movement from either side toward the home position results in a decrease in the allowed shaft torque level while movement away from the home position toward either ROM limit produces an increase in the allowed shaft torque level.

If the range of motion is set to a full rotation, then a number of cycles can be programmed in so that the allowed shaft torque level increases from the initial starting position of the tool (the home position) in either direction through a number of revolutions corresponding to the number of cycles set. Any movement back toward the home position before completing the full programmed number of cycles of rotation causes ratcheting at low torque. The full number of programmed cycles must be completed in one ramping direction before movement in an opposite direction changes the ramping direction. In other words, when moving clockwise, counterclockwise ratcheting is permitted without limitation until the full number of clockwise cycles has been completed and the torque ramp up in that direction fully traversed. Then movement in the counterclockwise direction causes ramp down of the torque with ratcheting permitted in the CW direction.

It should be apparent that there are several possible variations in this motion-mode combination. For example, the software could be set up to constrain the movement of the tool to complete one full ramp up in one direction before permitting the tool to change direction and ramp down the allowed shaft torque level toward the home position. Alternatively the program could produce absolute tracking of position and torque so that movement clockwise from the Home position would produce allowed shaft torque level increases, but reverse movement toward the home position would produce allowed shaft torque level decreases regardless of how far the CW ramp up had been traversed.

It should also be apparent that the inverse position versus torque curve could be used, namely one that has the highest torque at the home position and ramps down as the tool is moved away from the home position. This could be called a Alternating—Ramp Down/Up motion-mode combination.

Overall, it should be apparent that, with computer control of the changes in the allowed shaft torque level as a function of position, a variety of curve shapes, both linear and non-linear could be programmed into the system. Step function changes with position or from one cycle to another could be provided. The current torque value could be displayed on the biofeedback screen or the biofeedback screen could display the torque vs. position curve with a cursor tracking the current position and torque value.

Breakaway

In this mode, the patient initially performs an isometric contraction against a preselected fixed shaft torque level. When the recorded shaft torque exceeds the allowed shaft torque level, the tool moves suddenly as the allowed shaft torque value drops to a percentage of the prior level. A biofeedback screen (not shown) may be provided to show the breakaway torque value as an arrow on a torque scale with a dynamic bar graph display of the current torque sensed at the shaft. With that display the patient sees when the breakaway torque is near and can anticipate the rapid movement of the tool when the breakaway point is reached.

Constant Torque/Resist

This is a concentric/eccentric exercise mode. The patient moves the tool in the selected direction of motion with a selected allowed shaft torque value. At the ROM limit position, the system actively drives the tool back toward the opposite ROM limit position and the patient resists that movement.

Constant Torque/Return

This motion-mode combination is similar to the Constant Torque/Resist motion-mode combination, but in this case the data taking on the return motion is different. Instead of accumulating work and power on the return motion, the system measures and registers the peak torque on the return motion. This feature can be used for quantifying non-volitional muscle activity such as is seen in the neurological patient with spasticity.

Setting Allowed Torque Levels

After the exercise motion and mode are selected, the allowed shaft torque value or values are entered. Default values are preset into the operating software program and these can be used if desired. More often, the therapist will set these values to tailor the exercise bout to the individual patient.

High torque tools can utilize a set value of allowed shaft torque in the range of 0 to 100 ft-lbs for dynamic exercise or up to 150 ft-lbs for isometric exercise. The allowed shaft torque level can be set in increments of 1 inch-pound. For low torque tools the maximum set resisting torque permitted is 20 ft-lbs with increments of two inch-ounces. For low torque tools the lowest setting is four inch/ozs.

Constant Torque Exercises

For these types of exercise the allowed shaft torque value can be set for each movement direction permitted by the motion selected. In the Rotate CW and Rotate CCW motions, only one allowed shaft torque value is set. In the Alternate motion, separate and different allowed shaft torque values can be set for the two directions of motion.

Ramping Torques

Ramp Up

For the ramp up mode, the start torque (S.T.) value and the end torque (E.T.) values are entered with the former larger than the latter. During exercise in this mode, the tool will not move until the recorded shaft torque matches the initial start torque value. When the end resistance value is reached, the tool will stop further movement in the direction of the ramp up motion and any further effort on the tool will simply result in an isometric contraction being performed.

As a safety measure, in the ramp up mode, torque value is not automatically reset to the start torque value for the next repetition of the exercise since that could result in injury to the patient from a sudden jerking of the tool as the allowed shaft torque value changes suddenly and unexpectedly. Instead, the operating program waits for the patient to move the tool in the opposite direction until a slight reverse torque is generated and then it resets the allowed shaft torque value to the start torque value. Another safe approach would be to wait until the patient relaxes his or her effort on the tool and the measured torque drops below the start torque value. The biofeedback screen could present a suggestive message at this point in the program that the patient should relax and get ready for the next repetition.

Ramp Down

In the ramp down mode the start torque is set higher than the end torque. The allowed shaft torque declines from the start to the end value during the course of each repetition of the exercise. When the end of the ramp is reached, the system automatically resets the allowed shaft torque to the higher start torque value.

Breakaway

In the breakaway mode, a single torque value is entered as the torque value the patient must generate on the shaft before the tool begins to move.

Constant Torque/Resist

This mode requires entry of two allowed shaft torque values. The first value is the shaft torque valued allowed for the concentric exercise movement as determined by the selected exercise movement, i.e. either clockwise rotation or counterclockwise rotation. The second value is the shaft torque value allowed during the return or eccentric phase of the exercise movement. The system automatically limits the second torque value for the eccentric phase to 120% of the first torque value entered.

Constant Torque/Return

This mode also requires two torque values to be entered and they serve the same function as in the Constant Torque/Resist mode except that the second value is the maximum torque that the system will allow the shaft to experience.

Changing Torque Resolution

Referring to the SET UP TEST PARAMETERS screen in FIG. 22, when the cursor is in the bottom right window for torque and velocity setting, the torque resolution can be changed by pressing function key F2. For high-torque tools, pressing F2 will toggle the torque resolution between inch-]Lbs and foot-lbs. For low torque tools the resolution toggles between inch-lbs and inch-ozs.

Setting Velocity Limits

Without any velocity limits being set, isotonic exercise allows the patient to work at any velocity up to the design limit of the system or up to about 900 degrees per second in the commercial embodiment of this invention. If the therapist wants to limit the speed of exercise, a velocity limit can be set, but the exercise will change from isotonic to isokinetic when the set velocity limit is reached and thereafter the allowed shaft torque will increase if the patient attempts further acceleration of the tool.

For safety, the system itself puts velocity restrictions on the resist and return phases of the constant torque/resist and constant torque/return modes of exercise. For rotary tools the maximum settable resist phase velocity is 360 degrees per second and for reciprocating tools the maximum is 90 degrees per second. A maximum return velocity of 25 degrees per second is provided for the constant torque/return mode. These values are examples only and could be changed.

Setting Number of Cycles

A field for entry of a number of cycles is provided on the SETUP TEST PARAMETERS screen only when a ramping mode is selected. The value entered in that field determines the number of repetitions of the activity required to complete the ramp of torque from the start torque to the end torque value and thus determines the slope of the ramp. This is shown by the examples discussed above.

SETUP TEST PARAMETERS FOR ISOKINETIC EXERCISE (FIG. 23)

FIG. 23 illustrates a SETUP TEST PARAMETERS screen for isokinetic exercise in accordance with this invention. The upper window displays the test number being setup, the tool involved, the torque resolution and the type of exercise selected, isokinetic in this case being indicated by the highlighted Isokinetic name field. In the lower left window, the available exercise motions for this type of exercise and the selected tool are shown. The names of the exercise motions are related to the tool selected and the names displayed in FIG. 23 are for all rotary tools capable of full rotations, i.e. without mechanical stops on the tool itself. In the lower central window the available modes of exercise are listed. The available modes depend on the selected motion. In the lower right window, the fields for torque and velocity setting are provided. The fields and field descriptors in this window change from one exercise mode to the next. The ones shown in FIG. 23 are for the ConVel/Resist (Constant Velocity/Resist) mode which is the one shown highlighted in the figure. The settings for other modes will be discussed below. The system automatically presents the appropriate choices to the therapist as selections of the available options in each window ar made in sequence.

Motion Selection

In selecting the motion, the therapist is determining which phase of the exercise cycle will be performed at constant velocity. For the rotary tools the selections available are those shown in FIG. 23. For linear motion tools the available choices are push, pull, and alternate. For the two tools provided for exercise of the wrist and elbow the available choices are flexion, extension and alternate. There are three tools for three different exercise motions of the shoulder and the choices are as follows:

1. internal rotation, external rotation, alternate
2. flexion, extension, alternate
3. adduction, abduction, alternate

Mode Selection

There are three modes available for isokinetic type of exercise: Constant Velocity, ConVel/Resist (Constant Velocity/Resist), and CPM (Continuous Passive Motion). The constant velocity mode is available for all three motions. The constant velocity/resist mode is available for all motions except Alternate because it requires specifying in which direction of movement the eccentric resist phase will be operative. The CPM mode is available only in the Alternate motion for some tools but for all motions with tools that are fee to rotate a full rotation. If CW rotation of a wheel is selected, the CPM mode will cause continuous passive CW rotation of the wheel.

Constant Velocity

In this mode, the maximum velocity of movement of the tool is set to a desired value. For unidirectional movement, there is a single maximum velocity setting for the selected direction of movement and no velocity maximum in the opposite direction of movement except the design limit of the system. For the alternate motion, two maximum velocity settings are selected for the different phases of the movement of the tool.

The patient can move the tool at a velocity lower than the set maximum velocity and will encounter very little resisting torque and do very little work. However, when the patient accelerates the tool to the set maximum velocity, the system limits the velocity to that value and increases the allowed shaft torque to compensate for increased forces exerted by the patient. The system provides an accommodating resistance and the muscles of the patient work in a concentric manner, meaning that the muscle is shortening during the exercise movement. In the alternate mode, two different muscle groups are working concentrically in the two different phases of motion. For example, in alternate movement while exercising the elbow joint, the patient's biceps are exercising the elbow joint, the patient's biceps are exercising concentrically on the flexion phase and the triceps are exercising concentrically on the extension phase.

Torque Limit Set

As will be discussed in more detail below, the system of this invention provides the therapist with the option of setting a torque limit value to be operative during constant velocity exercise. If such a value is set and the patient reaches that torque limit value, the system automatically shifts the exercise mode to isotonic or constant torque and the patient can accelerate the tool past the maximum velocity setting. Once the shaft torque drops below the torque limit value, the system automatically returns to isokinetic mode.

ConVel/Resist

In this mode the patient works against the accommodating resistance of the system at the maximum set velocity in the direction of the selected motion and the system returns the tool in the opposite direction at a selected velocity independent of the forces exerted by the patient (unless a maximum torque value is exceeded and the tool stops in the resist phase as discussed below). The patient must complete the movement in the selected direction to the position of the range of motion limit before the automatic return phase will occur.

This mode of exercise provides alternating concentric and eccentric exercise of a single muscle group in certain exercise setups. For example, in exercise with the elbow tool with motion selection of "Flexion" the biceps of the patient are exercised in a concentric manner during the flexion phase of movement (muscle working while shortening) because the biceps are actively involved in producing the movement of the tool against the accommodating resistance provided by the system. During the extension phase of movement, the biceps are exercised in an eccentric manner (muscle working while lengthening) because the biceps are involved in resisting the return movement of the tool being produced by the system. With the same tool to patient setup and the Extension motion selected, the triceps of the patient would be involved in alternating concentric/eccentric exercise.

Torque Limits Set

In this mode of exercise, the system of this invention provides the therapist with the option of setting separate torque limits on both phases of the exercise motion. For the concentric phase the torque limit value determines the point at which the system will switch from isokinetic to isotonic mode. For the eccentric resist phase, the torque limit value determines what torque value experienced by the shaft will stop the tool movement to protect the patient from exerting too much torque in that direction. The setting of these values will be discussed in more detail below.

CPM (Continuous Passive Motion)

In this mode of exercise, the system moves the tool in a continuous manner through the range of motion set regardless of the action of the patient on the tool, unless a maximum torque value is set and exceeded as discussed below. With this mode, the therapist has the option of having the patient do no work on the tool and just have the system move the patient's limb passively. The therapist also has the option of having the patient work with or against the movement in one or both directions. Thus any combination of concentric or eccentric muscle contractions can be selectively employed in this mode, but the patient has no control over the stopping and starting of the movement of the tool unlike the constant velocity mode.

Setting Velocity Limits

The system automatically presents default velocity limit settings for each of the modes of exercise that can be selected, but the therapist is permitted to change these settings within certain constraints on values permitted to be entered depending on the mode and the tool involved. In the commercial embodiment, the velocities can be set in one deg/sec increments and the velocity limit for each phase of an alternate motion can be set independently.

The system enforces maximum values on velocity limit values depending on the selected tool and exercise mode. For all rotating tools and all modes except ConVel/Resist, the maximum value of the velocity limit is the design limit of the system or 900 deg./sec. in the commercial embodiment. For rotating tools and the ConVel/Resist mode, the upper limit is 360 deg/sec for the resist phase and 900 deg/sec for the constant velocity phase. For reciprocating tools (tools with mechanical range of motion stops) and all modes except ConVel/Resist, the maximum value of the velocity limit is 300 deg/sec. The resist phase maximum for these tools is 90 deg/sec. In the ConVel/Resist mode, the system enforces the further constraint that the resist velocity limit cannot be set higher than the velocity limit for the constant velocity phase of movement. Attempts to enter values above restricted maximum values will result in entry of the maximum permitted value.

Setting Torque Limits

Constant Velocity Mode

If the therapist does not set a torque limit, the patient can exert as much torque as he is capable of during the exercise motion. If the therapist decides to set a torque limit, e.g. to protect the patient from exerting a torque that might damage the involved joint or muscle group, the system will automatically switch from isokinetic to isotonic mode with no velocity limit if the shaft experiences that torque limit. The patient would then have to exceed the design velocity limit of the system itself before a torque above the limit would be encountered during the movement of the tool. Of course at the range of motion limit position, the tool stops moving and the patient could exert greater torque on the shaft at that point and there is no way to protect against that action.

ConVel/Resist Mode

In this mode, a torque limit may be set on the constant velocity phase of motion and will operate in the same manner as a set torque limit in the constant velocity mode discussed above. For the resist phase, the therapist can set a torque limit within certain constraints, but the system also enforces a dynamically changing torque limit based on a percentage of the peak torque exerted by the patient during the constant velocity phase. For purposes of this description, the latter will be called an "accommodating torque limit."

Setting the Accommodating Torque Limit

The therapist can select the percentage value used to determine the accommodating torque limit within limits enforced by the system. Note in FIG. 23 that the lower right hand window includes the field descriptor "RESIST (% CW)" with a value entry field below it. The therapist may place the cursor on that value entry field and enter any value up to a limit of 120%. The percentage value entered is used by the operating program in an algorithm to determine the torque limit for the resist phase of each repetition of the exercise based on the peak torque measured during the constant velocity phase of the repetition. An example will illustrate the interrelated working of this accommodating torque limit and the set torque limit for the resist phase.

Assume for this example that the set torque limit is 20 ft-lb and the accommodating torque limit value is 110%. Assume further that on the first repetition recorded shaft torque is 30 ft-lb. The accommodating torque limit is 110% of that value or 33 ft-lb, but the set torque limit is 20 ft-lb, so the set torque limit will be the operative torque limit on the resist phase and the tool will stop if the patient generates 20 ft-lb during that phase. Now assume that on the tenth repetition the recorded shaft torque is only 15 ft-lb during the constant velocity phase. The accommodating torque limit is calculated by the system to be 16.5 ft-lb, which is less than the 20 ft-lb set torque limit. Thus the accommodating torque limit will be the active limit and the movement of the tool during the resist phase will stop when the recorded shaft torque reaches 16.5 ft-lb.

It is thus seen that the accommodating torque limit provides a further safety factor and prevents the patient from overexertion in the latter stages of exercise repetitions.

As an alternative to the setting of a single value of maximum return phase torque based on peak torque captured during the concentric exercise phase, the system of this invention could be programmed to capture the shaft torque versus position on the concentric phase and dynamically change the maximum torque limit during the eccentric return phase so that at each position, the maximum torque is a preselected percentage of the stored torque value at that position.

The system of this invention could also be programmed to permit incrementing or decrementing the set percentage from one repetition of the exercise to another.

OPERATION OF CONTROLLER FIRMWARE

Firmware is stored in program memory 301 of the controller system depicted in FIG. 15 for operating the exercise apparatus of this invention in various exercise modes or states.

Isometric Mode Control

In the isometric mode, the program is a simple one in that the controller firmware simply operates the brake 207 when the tool is in the prescribed position to prevent movement of the tool and sends data on measured torque to the host computer.

Concentric Isokinetic Movement Control (FIG. 41)

The firmware program for concentric isokinetic movement control is diagrammed in FIG. 41.

Torque Baseline Control Routine

A Torque Baseline Correct routine executes first to obtain a true patient torque value. The current torque and position signals are acquired. The current position signal is used to look up the torque baseline value read and stored during the running of the gravity compensation routine involved in the set the current up program and the baseline value is subtracted from the current value to obtain true patient exerted torque T.CUR. A routine is executed to capture and store peak torque during the movement. This simply involves comparing the T.CUR value just calculated with the immediately prior value stored in memory and either replacing the stored value if the current one is larger or leaving the stored one unchanged if the current one is lower.

Torque to Velocity Conversion Routine

The current torque value is then used in a routine that converts the torque value to a velocity command value based on a prearranged inertial model. The inertial model is based on simulation of a physical system that has a frictional component an a viscous damping component. The model has both velocity, torque and time components with the torque value being current torque and the time component value based on incrementing a timer each time this routine is executed at the 100 Hz rate as previously explained in connection with FIGS. 17 and 18. The current velocity value is the current value of the parameter V.CMD which is fed back from the last routine. The model preferably includes factors related to the tool mounted on the power head since the inertial characteristics of the tool affect the desired behavior of the inertial model.

Isokinetic Velocity Control Routine

Tho velocity command produced by execution of the inertial model routine is utilized in an Isokinetic Velocity Control routine. In this routine the value of V.CMD from the inertial model is compared with the value of the velocity limit set and stored in memory during execution of the parameter entry routines. If the V.CMD value is less than or equal to the stored limit value, the V.CMD value is passed to the next routine. If the V.CMD value is greater than the stored limit value, the value of V.CMD calculated by the inertial model is replaced with the stored limit value in the V.CMD register.

Isotonic Velocity Control Routine

The next routine to be executed is an Isotonic Velocity Control routine. This routine operates on the basis of the current torque value calculated in the Torque Baseline Correct routine, and a torque limit set value which is optionally set by the therapist. The Isotonic Velocity Control routine compares the current torque value with the limit torque value. If the current value is greater than the limit, the routine increments the value of V.CMD in a direction that will tend to reduce the value of current torque. An inertial model is also employed in this routine to provide appropriate "breakaway" characteristics to the acceleration of the tool.

Depending on what the patient is doing to the tool, it may take several executions of this firmware module at the 100 Hz rate before the actual and limit torque values become equal. This is somewhat like implementing a torque servo loop in software, but it should be understood that the routine does not enforce a set torque value but acts to keep the torque at or below a set value. There is no change in the V.CMD value if the current torque value is less than the operative torque limit value.

Emergency Stop Control Routine

The value of V.CMD determined in the Isotonic Velocity Control routine is passed to an Emergency Stop Control routine in which a number of possible fault conditions are examined and the V.CMD value set to zero if a fault condition is determined. Other actions of the controller under various detected fault conditions are discussed above. In normal operation of the system, the Emergency Stop Control routine does not alter the value of V.CMD. There are other protection routines that may desirably be in included in the system. The commercial version of the apparatus of this invention includes a routine that acquires motor current and protects against motor burn out by altering the velocity command if the motor current exceeds a certain set value. It should be understood that the controller system also uses other methods to stop the system, such as applying the mechanical brake under some detected fault conditions. These are generally described above.

Position Stop Control Routine

The next routine to be executed is the Position Stop Control routine which looks at the value of the active ROM limit setting and the current position and alters the value of V.CMD if the current position value is close to the value of the ROM limit. This routine executes a deceleration model that gradually decelerates the tool to a stop at the limit.

D/A Conversion Correction Routine

This routine alters the value of V.CMD if needed to correct for drift in either the baseline or gain of the digital to analog conversion circuit. This routine operates when the V.CMD value is zero to determine from the current position signal if the motor is actually moving. If the motor is moving, the baseline value for the D/A conversion is incorrect and this routine produces a baseline correction factor that will be applied to the V.CMD value. If the motor is being commanded to move at substantial velocity, but the change in position signal value doesn't correspond to the commanded velocity, this routine will determine a scaling correction factor and apply it to the V.CMD value. Thus this routine automatically maintains the D/A conversion in calibration. The value of V.CMD produced by this routine is sent to the D/A Converter 315 shown in FIG. 15.

It should be understood that the concentric isokinetic movement control may operate in two directions in a concentric-concentric isokinetic mode which is produced when the "Alternate" motion and "Constant Velocity" mode are entered from the Set Up Test Parameters screen. In that case, different velocity limits may be operative for the two directions of movement and the ROM limits are different for the two directions of movement. Switching between these entered values is performed in the various routines based on a program steps which determine in what direction the tool is moving.

Eccentric Isokinetic Movement Control (FIG. 42)

Eccentric isokinetic movement control is operative only in the Resist phase of the Constant Torque/Resist mode or the Constant Velocity/Resist mode. This phase of a motion occurs automatically when a range of motion stop is reached and the first routine to be executed is a velocity ramp generator.

Velocity Ramp Generator Routine

In this routine, the last value of V.CMD sent to the D/A is incremented each time this firmware module is executed at the 100 Hz rate to create a velocity ramp, with velocity increasing in the direction opposite to the prior movement toward the ROM limit to drive the tool with the servo motor against the resistance of the patient. In other words, the velocity command to the servo motor is independent of the torque exerted by the patient except for maximum torque regulation as discussed below. The slope of the ramp is determined by the amount of incrementing of the value of V.CMD and is set at a safe level of acceleration away from the ROM limit position.

Isokinetic Velocity Control Routine

This routine operates here just like it did in the concentric phase and limits the value of V.CMD to be less than or equal to the set velocity limit entered by the therapist during execution of the parameter setting routine.

Torque Limit Control Routine

The value of V.CMD passed from the Isokinetic Velocity Control routine is altered in the Torque Limit Control routine only if the value of the current torque is greater than the torque limit set. The torque limit may be a parameter set by the therapist for a Constant Torque/Resist mode (within maximum predefined limits as explained above) or it may be a dynamic parameter calculated from the peak torque stored from the concentric movement phase by applying the entered percentage factor. In this case, the Torque Limit Control routine alters the value of V.CMD in a direction to slow down the movement of the tool and eventually bring it to a stop if the current torque value remains above the torque limit value during a series of sequential executions of the routine.

The other routines in this firmware module are the same as for the concentric isokinetic movement module previously discussed.

Concentric Isotonic Movement Control (FIG. 43)

FIG. 43 shows the routines of the firmware module for Concentric Isotonic Movement Control. The first routine executed simply sets the V.CMD to a zero value since the tool is to remain stationary until the value of T.CUR is equal to the set torque value which may be a fixed value or a ramping value depending on the exercise mode selected. The Isotonic Velocity Control routine leaves the V.CMD value at zero until the value of T.CUR equals the set value and then it begins to execute an inertial model to increment the value of V.CMD to keep the value of current torque at the torque setpoint value.

The Isokinetic Velocity Control routine alters the value of V.CMD only if it exceeds the value of the set limit velocity. The Emergency Stop Control routine, Position Stop Control routine and D/A Conversion Correction routines operate in the same manner as in the Concentric Isokinetic Movement Control module.

Continuous Passive Motion Control (FIG. 44)

FIG. 44 sets forth the firmware module for Continuous Passive Motion control. This module is very similar to the Eccentric Movement control module, the difference being that the servo motor is driven in both directions and the velocity ramp generator is reset to a near zero value by the feedback of the value of V.CMD from the Position Stop routine which decelerates toward zero value near the active limit position and is triggered to ramp in the opposite direction when the direction flag is changed upon reaching a range of motion limit position.

In this case the Torque Limit Control routine also stops the movement of the servo motor and the tool on the output shaft when the set torque limit value is reached and the torque is being applied by the patient on the shaft in a direction opposite to the torque applied by the motor. However, the movement is not allowed to reverse and further movement of the tool occurs only when the patient reduces the torque applied to the shaft. If the patient is applying force to the tool in the same direction as the V.CMD value, there are alternative possibilities for programming the system to respond to this. The system could be programmed to remain isokinetic, i.e. the velocity will not change regardless of the torque applied by the patient and the system will provided accommodating resistance but without slowing down when the patient reduces the applied torque. Alternatively, the Torque Limit Control routine could also include an Isotonic Velocity Control routine that limits torque to a certain value if the patient is applying force in the direction of movement. In such a case, the tool accelerates in the direction of patient applied torque when it exceeded the set value. In the case of torque applied in the direction of movement, the acceleration would increase the velocity to maintain torque constant at the set value. In the case of torque applied in opposition to the movement, the acceleration would slow the movement until it came to a stop.

Alternative and Additional Firmware Control Functions

It should be apparent that the microcomputer based controller system utilized in this invention provides possibilities for many other control functions to be implemented in firmware. For example, "tool specific" firmware routines could be stored in the controller to control the operation of the servo motor to exactly imitate the response function of a particular tool. In most cases this degree of sophistication in program control is not warranted and adequate, Assessment of a patient's capabilities to perform prescribed work tasks can be made on the basis of the more control routines discussed above. However, as occupational therapists become familiar with the improved functional capabilities of the system of this invention, demand for more sophisticated "tool specific" control routines may be generated. The advantage of the system of this invention is that changes and additions to the control routines can be easily made.

It should be apparent from the above description that the objects and features of the invention have been met in a specific embodiment, but that numerous modifications could be made without departing from the scope of the invention as claimed in the following claims.

What is claimed is:

1. A patient interface for a muscle exercise and diagnostic apparatus wherein an output shaft is coupled to an exercise controller which includes a torque signal processing unit, the interface comprising:

the output shaft having first and second shaft sections, said first shaft section having a larger diameter than said second shaft section to handle higher torque loads, said second shaft section being coaxial with said first shaft section; first torque sensing means for sensing torque applied to said first shaft section and for providing a first torque output signal to said torque signal processing unit; second torque sensing means for sensing torque applied to said second shaft section and for providing a second torque output signal to said torque signal processing unit; a plurality of high torque tools each adapted for use by a user of said apparatus in performing an exercise motion with a high torque; a plurality of low torque tools each adapted for use by said user of said apparatus in performing an exercise motion with a low torque; first coupling means for removably coupling said high torque tools to said first shaft section; and second coupling means for removably coupling said low torque tools to said second shaft section.

2. Apparatus as claimed in claim 1, wherein said second shaft section extends forward from said first shaft section, and said first coupling means comprises a first mating surface configuration formed on a forward end surface of said first shaft section surrounding said second shaft section, a hollow tool mounting shaft carried on each of said high torque tools adapted to extend over said second shaft section and having a second mating surface configuration formed on a rearward end surface thereof adapted to mate with said first mating surface configuration to form a torque transfer mating relationship between said first shaft section and said hollow tool mounting shaft, and a shaft coupler adapted to mount over both said forward end of said first shaft section and said rearward end of said tool mounting shaft for coupling said first shaft section to said tool mounting shaft including means for urging said first and second mating surface configurations into tight mating engagement.

3. Apparatus as claimed in claim 2, wherein one of said first and second mating surface configurations comprises a pair of tapered projections formed at diametrically opposite locations on an associated end surface and the other of said first and second mating surface configurations comprises a pair of tapered slots formed at corresponding diametrically opposite locations on an associated end surface, said tapered slots being adapted to receive said tapered projections in a wedged coupling relation.

4. The interface as claimed in claim 1, further comprising shaft mounting means for mounting said output shaft for multiple full turns thereof during one of said exercise motion, and support means for supporting said output shaft and said shaft mounting means in a selectable stationary position; said first torque sensing means comprising first torque measuring means carried on and rotating with said first shaft section and producing said first torque output signal corresponding to the measured torque thereon; said second torque sensing means comprising second torque measuring means carried on and rotating with said second shaft section and producing said second torque output signal corresponding to the measured torque thereon; and torque signal receiving means carried on said support means and comprising first and second torque signal channels and first and second signal coupling means for coupling said first and second torque output signals into said first and second torque signal channels.

5. A muscle exercise and diagnostic apparatus comprising:

an output shaft having first and second shaft sections, said first shaft section having a larger diameter than said second shaft section to handle higher torque loads, said second shaft section being coaxial with said first shaft section;

first torque sensing means for sensing torque applied to said first shaft section;

second torque sensing means for sensing torque applied to said second shaft section;

a plurality of high torque tools each adapted for use by a user of said apparatus in performing an exercise motion with a high torque;

a plurality of low torque tools each adapted for use by said user of said apparatus in performing an exercise motion with a low torque;

first coupling means for removably coupling said high torque tools to said first shaft section;

second coupling means for removably coupling said low torque tools to said second shaft section;

shaft mounting means for mounting said output shaft for multiple full turns thereof during one of said exercise motion, said shaft mounting means including servo motor means coupled in driving relation to said output shaft;

support means for supporting said output shaft and said shaft mounting means in a selectable stationary position;

said first torque sensing means comprising first torque measuring means carried on and rotating with said first shaft section and producing a first torque output signal corresponding to the measured torque thereon;

said second torque sensing means comprising second torque measuring means carried on and rotating with said second shaft section and producing a second torque output signal corresponding to the measured torque thereon;

torque signal receiving means carried on said support means and comprising first and second torque signal channels and first and second signal coupling means for coupling said first and second torque output signals into said first and second torque signal channels;

shaft position sensing means for sensing the angular position of said output shaft and producing an output shaft position signal; and servo control means responsive to a preselected command signal for controlling operation of said servo motor and including servo signal measuring means for measuring a preselected servo control signal parameter associated with said servo motor and output shaft and operatively related to said command signal; and exercise control means coupled to said servo control means and receiving said output shaft position signal and said first and second torque signals for controlling said servo motor and shaft in accordance with a preselected exercise control algorithm.

6. Apparatus as claimed in claim 5, wherein said preselected exercise control algorithm includes torque control means for controlling said servo motor means to limit the maximum torque on an operative one of said first and second shaft sections as a prearranged function of said shaft position signal.

7. Apparatus as claimed in claim 5, wherein said exercise control means comprises programmable computer means including program storage means storing a plurality of exercise mode control programs operative to control said servo control means and said servo motor in accordance with a plurality of prearranged exercise control algorithms each having a set of control parameters associated therewith, and program interface means providing program facilities for selecting an exercise mode and for entering values for said control parameters associated therewith.

8. Apparatus as claimed in claim 7, wherein said program interface means comprises type means for selecting an exercise type from a set of prearranged exercise types, motion means for selecting an exercise motion from a set of prearranged exercise motions associated with said selected exercise type, mode means for selecting said exercise mode from a set of prearranged exercise modes associated with said selected exercise motion, and parameter means for entering said values of control parameters associated with said selected exercise mode.

9. Apparatus as claimed in claim 5, wherein said servo motor and said output shaft are carried in a power head housing with said output shaft projecting from a front faceplate, and said apparatus further comprises head mounting means including a mounting yoke for carrying said power head housing, means for positioning said mounting yoke at a selectable height, and means for mounting said power head housing in said mounting yoke for rotation about a mounting axis orthogonal to said output shaft including means for releasable connecting said power head housing to said mounting yoke at one of a plurality of rigidly fixed, angular orientations in at least one vertical plane.

10. Apparatus as claimed in claim 9, wherein said mounting yoke has first and second mounting arms; and said means for mounting said power head housing in said mounting yoke further comprises a pair of mounting shafts mounted on opposite sides of said power head housing along said mounting axis, bearing means carried on said first and second mounting arms for receiving said mounting shafts for journalling said mounting shafts for rotation relative to said mounting arms about said mounting axis; one of said mounting shafts extending outside of an associated one of said mounting arms and carrying a first detent coupler element with a first mating surface thereon in a rigidly fixed position thereon, a second detent coupler element having a second mating surface thereon and being mounted on said associated mounting arm in a position with said second mating surface facing said first mating surface, and coupler means carried on said first and second detent coupler elements for coupling said first and second detent coupler elements together in tight mating engagement with each other; one of said first and second detent coupler elements having a pair of tapered projections formed at diametrically opposite locations on the associated mating surface and the other of said first and second detent coupler elements having a plurality of pairs of tapered slots formed at preselected positions defining detent mounting angles for said mounting shafts relative to said mounting arms.

11. Apparatus as claimed in claim 10, wherein said first coupling means comprises a first mating surface configuration formed on a forward end surface of said first shaft section surrounding said second shaft section, a hollow tool mounting shaft carried on each of said high torque tools adapted to extend over said second shaft section and having a second mating surface configuration formed on a rearward end surface thereof adapted to mate with said first mating surface configuration to form a torque transfer mating relationship between said first shaft section and said hollow tool mounting shaft, and a shaft coupler adapted to mount over both said forward end of said first shaft section and said rearward end of said hollow tool mounting shaft for coupling said first shaft section to said hollow tool mounting shaft including means for urging said first and second mating surface configuration into tight mating engagement.

12. Apparatus as claimed in claim 11, wherein one of said first and second mating surface configurations comprises a pair of tapered projections formed at diametrically opposite locations on an associated end surface and the other of said first and second mating surface configurations comprises a pair of tapered slots formed at corresponding diametrically opposite locations on an associated end surface, said tapered slots being adapted to receive said tapered projections in a wedged coupling relation.

13. Apparatus as claimed in claim 12, wherein each of said high torque tools and each of said low torque tools is assigned a unique tool number, said exercise control means includes storage means for registering each of said assigned tool numbers as being associated with one of said high and low torque tools, means for inputting said tool number, means for checking the output of each of said first and second torque sensing means to determine the active shaft section as the one of said first and second shaft sections at which one of said torque tools is actually mounted on, and means for indicating a wrong tool number when said input tool number does not correspond properly with said active shaft section.

14. Apparatus as claimed in claim 9, wherein said front faceplate of said power head housing has a plurality of registration apertures formed in a circular array therein, and a set of said high torque tools each having a mounting baseplate thereon with registration pins extending therefrom and adapted to be received in said registration apertures to position said mounting baseplate in a selectable fixed position relative to said front faceplate when said first coupling means couples said one of said high torque tools to said first shaft section, each of said high torque tools in said set further comprising at least one tool handle rotatably mounted to said base plate for applying torque to said first shaft section and for rotating with said first shaft section.

15. Apparatus as claimed in claim 14, wherein each of said high torque tools in said set includes a mechanical stop mounted in a prearranged location on said baseplate for limiting the rotation of said tool handle and a torque limiting coupler means mounting said tool handle to a hollow tool mounting shaft carried on each of said high torque tools adapted to extend over said second shaft section and adapted to provide slippage between said tool handle and said hollow tool mounting shaft when the torque on said coupler means exceeds a prearranged maximum torque value, thereby preventing the application of destructive forces to said mechanical stop on said baseplate.

16. Apparatus as claimed in claim 14, wherein one of said high torque tools is a linear motion tool apparatus comprising an elongated carriage track mounted to said baseplate and defining a linear motion track for a variety of linear motion tools, a carriage mounted for traversing said carriage track and adapted to mount one of said variety of linear motion tools thereto, and transmission means coupled to said hollow tool mounting shaft and said carriage for translating linear motion of said carriage into rotation of said hollow tool mounting shaft, said registration pins on said mounting baseplate cooperating with said registration apertures on said front faceplate to permit said linear motion track to be mounted in one of a plurality of different orientations on said power head housing including horizontal and vertical orientations.

17. Apparatus as claimed in claim 9, wherein said preselected exercise control algorithm includes torque control means for controlling said servo motor means to limit the maximum torque on an operative one of said first and second shaft sections as a prearranged function of said shaft position signal.

18. Apparatus as claimed in claim 9, wherein said exercise control means comprises programmable computer means including program storage means storing a plurality of exercise mode control programs operative to control said servo control means and said servo motor in accordance with a plurality of prearranged exercise control algorithms each having a set of control parameters associated therewith, and program interface means providing program facilities for selecting an exercise mode and for entering values for said control parameters associated therewith.

19. Apparatus as claimed in claim 18, wherein said program interface means comprises type means for selecting an exercise type from a set of prearranged exercise types, motion means for selecting an exercise motion from a set of prearranged exercise motions associated with said selected exercise type, mode means for selecting said exercise mode from a set of prearranged exercise modes associated with said selected exercise motion, parameter means for entering said values of control parameters associated with said selected exercise mode, and range of motion means for entering range of motion limit positions for the associated one of said plurality of torque tools mounted on said output shaft.

20. In muscle exercise and diagnostic apparatus said apparatus comprises:

an output shaft; a servo motor coupled in driving relation to said output shaft for producing multiple full turns thereof; support means for mounting said output shaft and said servo motor in a selectable stationary position; a plurality of tools; coupling means including coupling arrangements on said output shaft and each of said tools for removably coupling one of said tools to said output shaft; torque measuring means carried on and rotating with said output shaft and producing a torque output signal corresponding to measured torque applied thereto by said servo motor and said tool; torque signal receiving means carried on said support means including a torque signal channel and signal coupling means for coupling said torque output signal into said torque signal channel; shaft position sensing means for sensing the angular position of said output shaft and producing an output shaft position signal; servo control means responsive to a preselected command signal for controlling operation of said servo motor and including servo signal measuring means for measuring a preselected servo control signal parameter associated with said servo motor and output shaft and operatively related to said command signal; and exercise control means coupled to said servo control means and receiving said output shaft position signal and said torque output signal for controlling said servo motor and output shaft in accordance with a preselected exercise control algorithm.

21. Apparatus as claimed in claim 20, wherein said preselected exercise control algorithm includes torque control means for controlling said servo motor means to limit the maximum torque on said output shaft as prearranged function of said shaft position signal.

22. Apparatus as claimed in claim 20, wherein said exercise control means comprises programmable computer means including program storage means storing a plurality of exercise mode control programs operative to control said servo control means and said servo motor in accordance with a plurality of prearranged exercise control algorithms each having a set of control parameters associated therewith, and program interface means providing program facilities for selecting an exercise mode and for entering values for said control parameters associated therewith.

23. Apparatus as claimed in claim 22, wherein said program interface means comprises type means for selecting an exercise type from a set of prearranged exercise types, motion means for selecting an exercise motion from a set of prearranged exercise motions associated with said selected exercise type, mode means for selecting said exercise mode from a set of prearranged exercise modes associated with said selected exercise motion, and parameter means for entering said values of control parameters associated with said selected exercise mode.

24. Apparatus as claimed in claim 20, wherein said servo motor and said output shaft are carried in a power head housing with said output shaft projecting from a front faceplate, and said apparatus further comprises head mounting means including a mounting yoke for carrying said power head housing, means for positioning said mounting yoke at a selectable height, and means for mounting said power head housing in said mounting yoke for rotation about a mounting axis orthogonal to said output shaft including means for releasably connecting said power head housing to said mounting yoke at one of a plurality of rigidly fixed, angular orientations in at least one vertical plane.

25. Apparatus as claimed in claim 24, wherein said mounting yoke has first and second mounting arms; and said means for mounting said power head housing in said mounting yoke further comprises a pair of mounting shafts mounted on opposite sides of said power head housing along said mounting axis, bearing means carried on said first and second mounting arms for receiving said mounting shafts for journalling said mounting shafts for rotation relative to said mounting arms about said mounting axis; one of said mounting shafts extending outside of an associated one of said mounting arms and carrying a first detent coupler element with a first mating surface thereon in a rigidly fixed position, a second detent coupler element having a second mating surface thereon and being mounted on said associated mounting arm in a position with said second mating surface facing said first mating surface, and coupler means carried on said first and second detent coupler elements for coupling said first and second detent coupler elements together in tight mating engagement with each other; one of said first and second detent coupler elements having a pair of tapered projections formed at diametrically opposite locations on the associated mating surface and the other of said first and second detent coupler elements having a plurality of pairs of tapered slots formed at preselected positions defining detent mounting angles for said mounting shafts relative to said mounting arms.

26. Apparatus as claimed in claim 24, wherein said front faceplate of said power head housing has a plurality of registration apertures formed in a circular array therein, and a set of said tools each have a mounting baseplate thereon with registration pins extending therefrom and adapted to be received in said registration apertures to position said mounting baseplate in a selectable fixed position relative to said front faceplate when said coupling means couples said tool to said output shaft, each of said tools in said set further comprising at least one tool handle rotatably mounted to said base plate for applying torque to said first shaft section and for rotating with said first shaft section.

27. Apparatus as claimed in claim 26, wherein each of said tools in said set includes a mechanical stop mounted in a prearranged location on said baseplate for limiting the rotation of said tool handle and a torque limiting coupler means mounting said tool handle to a hollow tool mounting shaft carried on each of said plurality of tools and adapted to provide slippage between said tool handle and said hollow tool mounting shaft when the torque on said coupler means exceeds a prearranged maximum torque value, thereby preventing the application of destructive forces to said mechanical stop on said baseplate.

28. Apparatus as claimed in claim 26, wherein one of said tools is a linear motion tool apparatus comprising an elongated carriage track mounted to said baseplate and defining a linear motion track for a variety of linear motion tools, a carriage mounted for traversing said carriage track and adapted to mount one of said variety of linear motion tools thereto, and transmission means coupled to a hollow tool mounting shaft carried on each of said plurality of tools and said carriage for translating linear motion of said carriage into rotation of said hollow tool mounting shaft, said registration pins on said mounting baseplate cooperating with said registration apertures on said front faceplate to permit said linear motion track to be mounted in one of a plurality of different orientations on said power head housing including horizontal and vertical orientations.

29. Apparatus as claimed in claim 24, wherein said preselected exercise control algorithm includes torque control means for controlling said servo motor means to limit the maximum torque on said output shaft as a prearranged function of said shaft position signal.

30. Apparatus as claimed in claim 24, wherein said exercise control means comprises programmable computer means including program storage means storing a plurality of exercise mode control programs operative to control said servo control means and said servo motor in accordance with a plurality of prearranged exercise control algorithms each having a set of control parameters associated therewith, and program interface means providing program facilities for selecting an exercise mode and for entering values for said control parameters associated therewith.

31. Apparatus as claimed in claim 30, wherein said program interface means comprises type means for selecting an exercise type from a set of prearranged exercise types, motion means for selecting an exercise motion from a set of prearranged exercise motions associated with said selected exercise type, mode means for selecting said exercise mode from a set of prearranged exercise modes associated with said selected exercise motion, and parameter means for entering said values of control parameters associated with said selected exercise mode.

32. In muscle exercise and diagnostic apparatus, said apparatus comprises an output shaft; a servo motor coupled in driving relation to said output shaft; support means for mounting said output shaft and said servo motor in a selectable stationary position; a plurality of work simulation tools; and coupling means including coupling arrangements on said output shaft and each of said tools for removably coupling one of said tools to said output shaft; torque measuring means carried on said output shaft and producing a torque output signal corresponding to measured torque applied thereto by said servo motor and said tool; shaft position sensing means for sensing the angular position of said output shaft and producing an output shaft position signal; servo control means responsive to a preselected command signal for controlling operation of said servo motor and including servo signal measuring means for measuring a preselected servo control signal parameter associated with said servo motor and output shaft and operatively related to said command signal; and exercise control means coupled to said servo control means and receiving said output shaft position signal and said torque signal for controlling said servo motor and output shaft in accordance with a preselected exercise control algorithm; said exercise control means comprising programmable computer means including program storage means storing a plurality of exercise mode control programs operative to control said servo control means and said servo motor in accordance with a plurality of prearranged exercise control algorithms each having a set of control parameters associated therewith, and program interface means including type means for selecting an exercise type from a set of prearranged exercise types, motion means for selecting an exercise motion from a set of prearranged exercise motions associated with said selected exercise type, mode means for selecting said exercise mode from a set of prearranged exercise modes associated with said selected exercise motion, and parameter means for entering the values of control parameters associated with said selected exercise mode.

33. Apparatus as claimed in claim 32, wherein said preselected exercise control algorithm includes torque control means for controlling said servo motor means to limit the maximum torque on said output shaft as a prearranged function of said shaft position signal.

34. A muscle exercise and diagnostic apparatus comprising:

a power head including output shaft means defining an output axis of said power head, a servo motor coupled to said output shaft means for alternatively applying braking and driving power to said output shaft means, torque measuring means for measuring torque applied to said output shaft means; and servo signal measuring means for measuring a preselected operational parameter associated with said output shaft means;

a plurality of work task simulating tools;

tool mounting means for removably mounting a selected one of said work task simulating tools on said output shaft means;

control means coupled to said servo motor, said torque measuring means and said servo signal measuring means for controlling the operation of said servo motor in accordance with a selected one of a plurality of servo control functions to simulate at least one operational characteristic of said selected one of said tools;

head mounting means including a mounting yoke for carrying said power head, means for positioning said mounting yoke at a selectable height, and means for mounting said power head in said mounting yoke for rotation about a mounting axis orthogonal to said output axis including means for releasably connecting said power head to said mounting yoke at one of a plurality of rigid, fixed, angular orientations in at least one vertical plane; and wherein said mounting yoke has first and second mounting arms; and said means for mounting said power head in said mounting yoke further comprises a pair of mounting shafts mounted on opposite sides of said power head along said mounting axis, bearing means carried on said first and second mounting arms for receiving said mounting shafts for journalling said mounting shafts for rotation relative to said mounting arms about said mounting axis; one of said mounting shafts extending outside an associated one of said mounting arms and carrying a first detent coupler element with a first mating surface thereon in a rigidly fixed position, a second detent coupler element having a second mating surface thereon and being mounted on said associated mounting arm in a position with said second mating surface facing said first mating surface, and coupler means carried on said first and second detent coupler elements for coupling said first and second detent coupler elements together in tight mating engagement with each other; one of said first and second detent coupler elements having a pair of tapered projections formed at diametrically opposite locations on the associated mating surface and the other of said first and second detent coupler elements having a plurality of pairs of tapered slots formed at preselected positions defining detent mounting angles for said mounting shafts relative to said mounting arms.

35. A muscle exercise and diagnostic apparatus comprising:

a power head including output shaft means defining an output axis of said power head, a servo motor coupled to said output shaft means for alternatively applying braking and driving power to said output shaft means, torque measuring means for measuring torque applied to said output shaft means; and servo signal measuring means for measuring a preselected operational parameter associated with said output shaft means;

a plurality of work task simulating tools;

tool mounting means for removably mounting a selected one of said work task simulating tools on said output shaft means;

control means coupled to said servo motor, said torque measuring means and said servo signal measuring means for controlling the operation of said servo motor in accordance with a selected one of a plurality of servo control functions to simulate at least one operational characteristic of said selected one of said tools;

wherein said plurality of work task simulating tools having a first subset of said work task simulating tools comprise high torque tools and a second subset of said work task simulating tools comprise low torque tools;

said output shaft means comprises a first larger diameter shaft section; a second smaller diameter shaft section extending forward from and coaxial with said first shaft section;

said tool mounting means comprises first coupling means for removably coupling said high torque tools to said first shaft section and second coupling means for removably coupling said low torque tools to said second shaft section; and said torque measuring means comprises first torque sensing means mounted in a torque sensing relationship with said first shaft section; and second torque sensing means mounted in a torque sensing relationship with said second shaft section.

36. Apparatus as claimed in claim 35, wherein said power head includes a power head housing with a front faceplate thereon having a plurality of registration apertures formed in a circular array therein, and said plurality of high torque tools each having a mounting baseplate thereon with registration pins extending therefrom and adapted to be received in said registration apertures to position said mounting baseplate in a selectable fixed position relative to said front faceplate when said first coupling means couples one of said high torque tools to said first shaft section, each of said high torque tools further comprising at least one tool handle rotatably mounted to said base plate for applying torque to said first shaft section and for rotating with said first shaft section.

37. Apparatus as claimed in claim 36, wherein each of said plurality of high torque tools includes a mechanical stop mounted in a prearranged location on said baseplate for limiting the rotation of said tool handle and a torque limiting coupler means mounting said tool handle to a hollow tool mounting shaft carried on each of said high torque tools adapted to extend over said second shaft portion and adapted to provide slippage between said tool handle and said hollow tool mounting shaft when the torque on said coupler means exceeds a prearranged maximum torque value, thereby preventing the application of destructive forces to said mechanical stop on said baseplate.

38. Apparatus as claimed in claim 37, wherein one of said high torque tools is a linear motion tool apparatus comprising an elongated carriage track mounted to said baseplate and defining a linear motion track for a variety of linear motion tools, a carriage mounted for traversing said carriage track and adapted to mount one of said variety of linear motion tools thereto, and transmission means coupled to said hollow tool mounting shaft and said carriage for translating linear motion of said carriage into rotation of said hollow tool mounting shaft, said registration pins on said mounting baseplate cooperating with said registration apertures on said front faceplate to permit said linear motion track to be mounted in one of a plurality of different orientations on said power head housing including horizontal and vertical orientations.

39. A muscle exercise and diagnostic apparatus comprising:

a power head including output shaft means defining an output axis of said power head, a servo motor coupled to said output shaft means for alternatively applying braking and driving power to said output shaft means, torque measuring means for measuring torque applied to said output shaft means; and servo signal measuring means for measuring a preselected operational parameter associated with said output shaft means;

a plurality of work task simulating tools;

tool mounting means for removably mounting a selected one of said work task simulating tools on said output shaft means;

control means coupled to said servo motor, said torque measuring means and said servo signal measuring means for controlling the operation of said servo motor in accordance with a selected one of a plurality of control functions to simulate at least one operational characteristic of said selected one of said tools; and wherein said control means comprises programmable computer means including program storage means storing a plurality of exercise mode control programs operative to control said servo motor in accordance with a plurality of prearranged exercise control algorithms each having a set of control parameters associated therewith, and program interface means providing program facilities for selecting an exercise mode and for entering values for said control parameters associated therewith, said program interface means comprising type means for selecting an exercise type from a set of prearranged exercise types, motion means for selecting an exercise motion from a set of prearranged exercise motions associated with said selected exercise type, mode means for selecting said exercise mode from a set of prearranged exercise modes associated with said selected exercise motion, parameter means for entering said values of control parameters associated with said selected exercise mode, and range of motion means for entering range of motion limit positions for the associated one of said work task simulating tools mounted on said output shaft.

40. A muscle exercise and diagnostic apparatus comprising: an output shaft; a servo motor coupled in driving relation to said output shaft for producing multiple rotations thereof; support means for mounting said output shaft and said servo motor in a selectable stationary position; said output shaft having first and second shaft sections, said first shaft section having a larger diameter than said second shaft section to handle higher torque loads, said second shaft section being coaxial with said first shaft section; first torque sensing means for sensing torque applied to said first shaft section; second torque sensing means for sensing torque to said second shaft section; a plurality of high torque tools; a plurality of low torque tools, first coupling means for removably coupling said high torque tools to said first shaft section; second coupling means for removably coupling said low torque tools to said second shaft section; torque signal receiving means carried on said support means and coupled to said first torque sensing means and said second torque sensing means for producing an output torque signal; shaft position sensing means for sensing the angular position of said output shaft and producing an output shaft position signal; servo control means responsive to a preselected command signal for controlling operation of said servo motor and including servo signal measuring means for measuring a preselected servo control signal parameter associated with said servo motor and said output shaft and operatively related to said command signal; and exercise control means coupled to said servo control means and receiving said output shaft position signal and said output torque signal for controlling said servo motor and said output shaft in accordance with a preselected exercise control algorithm.

* * * * *